US007522866B2

(12) United States Patent
Deguchi et al.

(10) Patent No.: US 7,522,866 B2
(45) Date of Patent: Apr. 21, 2009

(54) DEVELOPER CONTAINER AND IMAGE FORMING APPARATUS

(75) Inventors: Masanobu Deguchi, Kashiba (JP); Hitoshi Nagahama, Uji (JP); Kazuya Koyama, Ikoma (JP); Shigeki Hayashi, Ikoma-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 607 days.

(21) Appl. No.: 10/548,445

(22) PCT Filed: Mar. 10, 2004

(86) PCT No.: PCT/JP2004/003131

§ 371 (c)(1),
(2), (4) Date: Sep. 9, 2005

(87) PCT Pub. No.: WO2004/081673

PCT Pub. Date: Sep. 23, 2004

(65) Prior Publication Data

US 2006/0133856 A1 Jun. 22, 2006

(30) Foreign Application Priority Data

Mar. 10, 2003 (JP) ..... 2003-063887
Apr. 11, 2003 (JP) ..... 2003-108198
Apr. 23, 2003 (JP) ..... 2003-118983

(51) Int. Cl.
*G03G 15/08* (2006.01)

(52) U.S. Cl. ..... 399/262; 399/120

(58) Field of Classification Search ..... 399/262, 399/260, 119, 120, 103, 105, 106
See application file for complete search history.

(56) References Cited

U.S. PATENT DOCUMENTS 5,455,662 A 10/1995 Ichikawa et al. ..... 399/260
5,500,719 A 3/1996 Ichikawa et al. ..... 399/238
5,568,237 A * 10/1996 Ishida et al. ..... 399/260 X
5,612,769 A 3/1997 Sugihara et al. ..... 399/119
5,627,631 A 5/1997 Ichikawa et al. ..... 399/260
5,722,020 A 2/1998 Matsuoka et al. ..... 399/262

(Continued)

FOREIGN PATENT DOCUMENTS

JP 6-59576 A 3/1994
JP 6-102758 4/1994
JP 6-102758 A 4/1994
JP 6-222665 A 8/1994
JP 6-348127 A 12/1994

(Continued)

OTHER PUBLICATIONS

International Preliminary Report on Patentability and English translation thereof mailed Sep. 29, 2005 and Feb. 23, 2006, respectively.
International Search Report for PCT/JP2004/003131 dated Jun. 15, 2004.

*Primary Examiner*—Sophia S Chen
(74) *Attorney, Agent, or Firm*—Nixon & Vanderhye, P.C.

(57) ABSTRACT

A developer container (130) for an image forming apparatus includes a developer container main body (131) having an axial intermediate portion radially opened and a supporting member (132) for supporting an intermediate portion in an axial line direction of the developer container main body (131) over the entire periphery thereof from radially outside as the developer container main body (131) is rotatable around the axial line (L131). A through hole (151) for guiding the developer from the developer container main body (131) to outside.

29 Claims, 50 Drawing Sheets

U.S. PATENT DOCUMENTS

| | | | | |
|---|---|---|---|---|
| 5,768,662 | A | 6/1998 | Sugihara et al. | 399/119 |
| 5,771,427 | A * | 6/1998 | Makino | 399/120 |
| 5,822,663 | A | 10/1998 | Ichikawa et al. | 399/262 |
| 5,867,757 | A * | 2/1999 | Okazaki et al. | 399/262 |
| 5,918,090 | A | 6/1999 | Ichikawa et al. | 399/120 |
| 5,966,574 | A * | 10/1999 | Ui et al. | 399/260 X |
| 6,075,963 | A | 6/2000 | Ichikawa et al. | 399/262 |
| 6,289,195 | B1 | 9/2001 | Ichikawa et al. | 399/262 |
| 6,298,208 | B1 * | 10/2001 | Kawamura et al. | 399/262 |
| 6,334,037 | B1 | 12/2001 | Ise | 399/262 |
| RE40,021 | E * | 1/2008 | Ise et al. | 399/262 |
| 2002/0001485 | A1 | 1/2002 | Ichikawa et al. | 399/262 |
| 2003/0138273 | A1 | 7/2003 | Ichikawa et al. | 399/262 |
| 2004/0131389 | A1 * | 7/2004 | Tazawa et al. | 399/262 X |
| 2004/0161267 | A1 | 8/2004 | Ichikawa et al. | 399/262 |

FOREIGN PATENT DOCUMENTS

| | | | |
|---|---|---|---|
| JP | 7-20705 | A | 1/1995 |
| JP | 7-152239 | | 6/1995 |
| JP | 7-152239 | A | 6/1995 |
| JP | 8-339115 | A | 12/1996 |
| JP | 9-211947 | A | 8/1997 |
| JP | 11-223990 | A | 8/1999 |
| JP | 2000-347489 | A | 12/2000 |
| JP | 2001-183896 | A | 7/2001 |
| JP | 2001-228693 | A | 8/2001 |
| JP | 2003-50502 | | 2/2003 |
| JP | 2003-50502 | A | 2/2003 |
| JP | 2003-255684 | A | 9/2003 |

* cited by examiner

PRIOR ART

DEVELOPER CONTAINER AND IMAGE FORMING APPARATUS

This application is the US national phase of international application PCT/JP2004/003131 filed 10 Mar. 2004 which designated the U.S. and claims benefit of JP 2003-063887 filed 10 Mar. 2003, JP 2003-108198 filed 11 Apr. 2003, and JP 2003-118983, filed 23 Apr. 2003, the entire contents of each of which are hereby incorporated by reference.

TECHNICAL FIELD

The present invention relates to a developer container for containing a developer such as toner for use in formation of electrographic images and an image forming apparatus on which the developer container is mounted removably.

1. Background Art

FIG. 58 is a cross-sectional view showing an image forming apparatus 2 to which a toner cartridge 1, which is a first conventional technique, is attached. FIG. 59 is a cross-sectional enlarged view showing the vicinity of the toner cartridge 1 and a developing portion 3 of the image forming apparatus 2. In FIGS. 58 and 59, for easy understanding, the thickness is not shown. The electrophotographic image forming apparatus 2 such as a printer and a copier includes the toner cartridge 1 and the main body of the image forming apparatus (hereinafter, which may be referred to as "apparatus main body") 2*a*. The toner cartridge 1 that contains toner is attached removably to the developing portion 3 that is provided in the apparatus main body 2*a*.

The toner cartridge 1 includes a housing 1*a*, a first agitating member 4, a second agitating member 5 and a supply roller 6. The first and the second agitating members 4 and 5 are disposed in a housing space 7, which is an inner space of the housing 1*a* in which unshown toner is contained. More specifically, the first agitating member 4 is disposed in a first housing area 7*a*, which is one area of the housing space 7, and the second agitating member 5 is disposed in a second housing area 7*b*, which is an other area of the housing space 7. The first agitating member 4 is rotated in the direction shown by an arrow U1 around its axial line by a driving force from an unshown driving portion such as a motor that is provided in the apparatus main body 2*a* while being attached to the apparatus main body 2*a* so as to agitate the toner contained in the first housing area 7*a*, and supplies the toner to the second housing area 7*b*. The second agitating member 5 is rotated in the direction shown by an arrow U2 around its axial line by the driving force from the driving portion so as to agitate the toner contained in the second housing area 7*b*, and supplies the toner to the supply roller 6.

The first agitating member 4 has a sheet 4*a* made of a polymer resin that can be partially in contact with the inner face of the housing 1*a* facing the first housing area 7*a*. The second agitating member 5 has a sheet 5*a* made of a polymer resin that can be partially in contact with the inner face of the housing 1*a* facing the second housing area 7*b*. The first and the second agitating members 4 and 5 rotate while the sheets 4*a* and 5*a* are in contact with the inner face of the housing 1*a*. Accordingly, even if the amount of the remaining toner that is contained in the housing space 7 is decreased, the sheets 4*a* and 5*a* scrape the toner, so that the toner that remains in the housing space 7 without being supplied to the supply roller 6 can be reduced as much as possible.

The outer circumferential portion of the supply roller 6 is formed of porous resin such as a sponge, and is rotated around its axial line by the driving force of the driving portion so as to supply the toner supplied by the second agitating member 5 to the developing portion 3 provided in the apparatus main body 2*a*. The developing portion 3 produces a two-component developer by agitating the toner supplied from the toner cartridge 1 and a previously prepared carrier, which is constituted by magnetic particles.

The apparatus main body 2*a* further includes a recording paper cassette 8, a photoreceptor drum 9, a charging portion 10, a laser irradiation portion 11 and a fixing portion 12, as shown in FIG. 58. The recording paper cassette 8 holds recording paper on which an image is to be formed. The photoreceptor drum 9 is a cylindrical drum whose outer circumferential portion is provided with a photoreceptor and is rotated in the direction shown by an arrow U3 around its axial line by the driving force of the driving portion. The charging portion 10 charges the photoreceptor of the photoreceptor drum 9 to let the photoreceptor photosensitive. The laser irradiation portion 11 exposes the charged photoreceptor of the photoreceptor drum 9 to laser light to form an electrostatic latent image on the photoreceptor.

The developing portion 3 agitates the two-component developer and supplies the two-component developer to the photoreceptor of the photoreceptor drum 9 on which the electrostatic latent image is formed to develop the image so that a toner image corresponding to the electrostatic latent image can be formed. The photoreceptor drum 9 transfers the toner image on the photoreceptor drum 9 onto recording paper that is fed from the recording paper cassette 11. The fixing portion 12 fixes the toner image that is transferred to the recording paper onto the recording paper. The recording paper on which the image is formed by fixing the toner image is let out to a paper-out tray 13. In order to keep the toner concentration of the two-component developer in the developing portion 4, the supply roller 6 of the toner cartridge 1 has the outer circumferential portion formed of a sponge, and its rotation is controlled. Thus, the supply roller 6 supplies an appropriate amount of toner in the form of fine powder to the developing portion 3.

FIG. 60A is a cross-sectional view showing a toner bottle 15, which is a second conventional technique. FIG. 60B is a perspective view showing the toner bottle 15. The toner bottle 15 is formed into a substantially cylindrical form having a bottom, and is provided with a housing space 16 for containing toner. The toner bottle 15 is provided with a protruding piece 17 projecting inward in the radial direction and extending from one end 15*a*to the other end 15*b* in the axial line direction spirally with the axial line L15 as the center. The other end 15*b* in the axial line direction of the toner bottle 15 is provided an opening 18 in which a hole having a smaller inner diameter than that of the remaining portions is formed so that the housing space 16 is in communication with the space outside the toner bottle 15.

The toner bottle 15 is coupled to the main body of an image forming apparatus (not shown) such that the axial line L15 is parallel to the horizontal direction by coupling the opening 18 to the toner supply port that is provided in the main body of the image forming apparatus. In this state, when the toner bottle 15 is rotated around the axial line L15 by the driving force of the driving portion that is provided in the main body of the image forming apparatus, the toner contained in the housing space 16 is led to the opening 18 by the protruding piece 17 and supplied to the toner supply port from the opening 18 (see JP H7-20705A, for example).

FIG. 61 is a perspective view showing a developer supply container 20, which is a third conventional technique. The developer supply container 20 is formed into a cylindrical form having closed opposite ends, and is provided with a housing space for containing toner. The developer supply container 20 is provided with a first protruding piece 21*a* projecting inward in the radial direction and extending from one end 20*a* to the central portion 20*c* in the axial line direction spirally with the axial line L20 as the center, and a second protruding piece 21*b* projecting inward in the radial direction and extending from the other end 20*b* to the central portion 20*c* in the axial line direction spirally with the axial line L20 as the center. In the central portion 20*c* in the axial line direction of the developer supply container 20, a through-hole 22 that penetrates the container in the radial direction to communicate the housing space and the space outside the developer supply container 20 is formed.

The developer supply container 20 is coupled to the main body of the image forming apparatus (not show) such that the axial line L20 is parallel to the horizontal direction and the central portion 20*c* in the axial line direction is opened upward so as to face the toner supply port provided in the main body of the image forming apparatus. In this state, the developer supply container 20 is rotated around the axial line L20 by the driving force of the driving portion that is provided in the main body of the image forming apparatus. Then, the toner contained in the housing space of the developer supply container 20 is led to the central portion 20*c* in the axial line direction by the protruding pieces 21*a* and 21*b*, and when the through-hole 22 is disposed at the position facing the toner supply port, the toner is supplied to the toner supply port via the through-hole 22 (see JP H8-339115A, for example).

FIG. 62 is perspective view showing the toner cartridge 25, which is a fourth conventional technique. The toner cartridge 25 is formed into a cylindrical form having closed opposite ends, and is provided with a housing space for containing toner. In the central portion in the axial line direction of the toner cartridge 25, a through-hole 26 extending in the axial line direction and penetrates the toner cartridge in the radial direction to communicate the housing space and the space outside the toner cartridge 25 is formed.

The toner cartridge 25 is coupled to the main body of the image forming apparatus (not show) such that the axial line L25 is parallel to the horizontal direction and the central portion in the axial line direction is opened upward so as to face the toner supply port provided in the main body of the image forming apparatus. In this state, the toner cartridge 25 is rotated around the axial line L25 by the driving force of the driving portion that is provided in the main body of the image forming apparatus. Then, the toner contained in the housing space of the toner cartridge 25 is supplied to the toner supply port via the through-hole 26 when the through-hole 26 is disposed at the position facing the toner supply port, (see JP H6-348127A, for example).

In recent years, for image forming apparatuses such as printers and copiers, there is a demand for high speed mass printing. For example, among high speed image forming apparatuses that can form images on at least 50 sheets of recording paper for one minute, some image forming apparatuses can form images on 999 sheets of recording paper at the maximum at a time. In such image forming apparatuses, continuous printing of more than 999 sheets is performed, depending on the setting of the number of sheets for printing. For such high speed image forming apparatuses, a toner cartridge having a very large capacity for containing toner is required, and for example, some toner cartridges can contain about 1400 g of toner.

In order to contain such a large volume of toner, in the toner cartridge 1, which is the first conventional technique, the housing space 7 is constituted by two housing areas 7*a* and 7*b*, that is, the first housing area 7*a* and the second housing area 7*b*, which have different shapes, as shown in FIG. 59. Therefore, the toner cartridge 1 is very large, and it is difficult for a user to attach and remove the toner cartridge 1 to and from the apparatus main body 2*a*. Furthermore, the toner cartridge 1 includes the first agitating member 4, the second agitating member 5 and the supply roller 6 inside, and their mechanisms are not only complicated, but also have large weights. Therefore, the toner cartridge 1 is not only heavy, but also the production cost is high, and the consumption cost of toner is also high. When the toner cartridge 1 becomes large, there arise not only problems of difficulties of packaging and transport and a problem of ensuring storage space caused, but also a problem caused in relation to disposal of the toner cartridge 1. Moreover, there is a possibility that toner may leak from gaps between bearings of the first agitating member 4, the second agitating member 5 and the supply roller 6 of the toner cartridge 1 because of, for example, vibration and fall during transport and storage and changes in atmospheric pressure.

Furthermore, when the toner cartridge 1 is stored for a long time in various ambient conditions while toner is present in the housing space 7, packing occurs in which toner, which is substantially a powder, aggregates in the housing space 7, and finally may be formed into amass. When attaching the toner cartridge 1 in such a state to the apparatus main body 2*a*, the toner may be rotated in the direction that makes the aggregated toner even more aggregated, depending on the angular positions of the agitating members 4 and 5. When the agitating members 4 and 5 are rotated in such a state, a burden on the driving portion such as motors or gears that serve to supply the driving force to the agitating members 4 and 5 becomes excessive. When the burden on the driving portion becomes excessive in this manner, at worst, the image forming apparatus 1 may fail, because of deformation and damages of the lock of the motor and the sheets 4*a* and 5*a* of the agitating members 4 and 5, and tooth skip of the gears constituting the driving portion.

In recent years, there has been prominent tendency of toner aggregation due to storage of the toner cartridge 1, because of a reduction of the diameter of toner particles for high image quality when forming an image on recording paper and a reduction of the melting point due to fixing at low temperatures to counter environmental problems, and thus the failure as described above tends to occur. In order to prevent such failure, a user has to keep the toner in the form of powder as much as possible by relaxing the toner contained in the toner cartridge 1 before attaching a new toner cartridge 1 or a toner cartridge 1 that has been stored for a long time to the apparatus main body 2*a*. For this purpose, the user has to do a burdensome task such as swinging the large and heavy toner cartridge 1 vertically and horizontally.

In order to solve such problems of the toner cartridge 1, in some toner cartridges, an opening that can be opened and closed through which toner is filled from the outside of the toner cartridge is provided, and toner is supplied from the opening while the toner cartridge is not completely removed from the apparatus main body 2*a*. However, when toner is supplied to the toner cartridge, the toner may be scattered and thus the toner cannot be filled well, which is a problem.

The toner bottle 15 shown in FIGS. 60A and 60B, which is the second conventional technique, has advantages that the number of components is smaller than that of the first conventional toner cartridge 1, which makes the weight less, and suppresses the production cost. However, when the toner bottle 15 is rotated around the axial line L15 while the toner bottle 15 is full of toner, for example, as a new toner bottle 15, there is a risk that excessive toner concentrates in the vicinity of the opening 18, and the toner may aggregate in the vicinity of the opening 18.

In order to reduce the risk that toner aggregates in the vicinity of the opening 18 and toner is prevented from being supplied to the toner supply port of the main body of the image forming apparatus, a method of rotating the toner bottle 15 in the direction opposite to the direction in which the toner is supplied to the opening 18 when the image forming apparatus is turned on or at predetermined time intervals can be conceivable. However, in this method, the state of the toner contained in the toner bottle 15 is varied, depending on the period during which the toner bottle 15 is stored without being rotated and the ambient conditions in which the image forming apparatus is installed, so that it is very difficult to control the rotation of the toner bottle 15 for preventing toner aggregation.

Regarding the amount of the toner contained in the toner bottle 15, when the upper surface of the toner layer is below the opening 18 in a state where the toner bottle 15 is attached to the main body of the image forming apparatus, the toner may not be supplied from the opening 18 to the toner supply port, even if the toner bottle 15 is rotated.

In the main body of the image forming apparatus to which such a toner bottle 15 is attached, in general, the developing portion, to which the toner is supplied, is disposed in the central portion between the front portion and the back portion of the main body of the image forming apparatus. Such a toner bottle 15 is, in general, inserted from the front portion of the main body of the image forming apparatus and attached thereto. Therefore, with an configuration in which the opening 18 is provided only in an end of the toner bottle 15, the size of the toner bottle 15 in the axial line direction is restricted to the size from the central portion to the front portion of the main body of the image forming apparatus. Thus, the volume of the toner to be contained in the toner bottle 15 is restricted.

In the developer supply container 20 shown in FIG. 61, which is the third conventional technique, in order to address the restriction of the size in the axial line direction, the through-hole 22 through which the toner flows out is formed in the central portion 20*c* in the axial line direction. However, it is difficult to seal completely between the central portion 20*c* of the rotating developer supply container 20 and the main body of the image forming apparatus, and when the developer supply container 20 is rotating, the toner from the through-hole 22 may leak out from between the central portion 20*c* and the main body of the image forming apparatus and may be scattered inside the main body of the image forming apparatus. The toner cartridge 25 shown in FIG. 62, which is the fourth conventional technique, has the same problem as the developer supply container 20, which is the third conventional technique.

The second conventional toner bottle 15 shown in FIGS. 60A and 60B advantageously has a reduced number of components and can reduce the weight and suppress the production cost, compared with the first conventional toner cartridge 1. However, the amount of the toner supplied to the toner supply port by rotating once the toner bottle 15 around the axial line L15 is changed with the amount of the toner that remains in the toner bottle 15. For example, the amount of the toner supplied by rotating once the toner bottle 15 when the upper surface of the toner layer is at a higher position than the axial line L15 is larger than when the upper surface of the toner layer is at a lower position than the axial line L15. Therefore, when the toner bottle 15 is rotated around the axial line L15 while the toner bottle 15 is full of toner, for example, as a new toner bottle 15, there is a risk that excessive toner concentrates in the vicinity of the opening 18, and the toner may aggregate in the vicinity of the opening 18.

Regarding the amount of the toner contained in the toner bottle 15, when the upper surface of the toner layer is at a higher position than the axial line L15 in a state where the toner bottle 15 is attached to the main body of the image forming apparatus, the toner may flow out from the opening 18 to the toner supply port, even if the toner bottle 15 is not rotated. Regarding the amount of the toner contained in the toner bottle 15, when the upper surface of the toner layer is at a lower position than the opening 18 in a state where the toner bottle 15 is attached to the main body of the image forming apparatus, the toner may not be supplied from the opening 18 to the toner supply port, even if the toner bottle 15 is rotated.

Furthermore, since the toner is a powder having a flowability as high as 4 to 10 micrometers, when the developer supply container 20 is stopped rotating in a state in which the through-hole 22 faces the toner supply port of the main body of the image forming apparatus, there is a risk that a large amount of toner may flow out from the through-hole 22 to the toner supply port. When a large amount of toner is supplied from the toner supply port to the developing portion in this manner, there is a risk that the toner concentration in the developing portion at that point of time becomes very high, and thus development non-uniformity may occur. In order to avoid this risk, it is necessary to provide a new agitating member, which leads to a problem of increasing the size of the developing portion.

BRIEF SUMMARY

Therefore, an example embodiment of the technology disclosed herein provides a developer container without a complicated mechanism that allows a powdered developer to be supplied to the main body of an image forming apparatus while the developer container main body containing a developer is rotatably supported stably and the developer contained therein is prevented from aggregating during rotation, and to provide an image forming apparatus in which the developer container is removably mounted.

Furthermore, an example embodiment of the technology disclosed herein provides a developer container without a complicated mechanism, capable of rotatably stably supporting a developer container main body containing a developer, preventing the developer contained therein from aggregating during its rotation, and supplying the developer to the main body of an image forming apparatus with an amount as constant as possible per one rotation of the developer, and to provide an image forming apparatus in which the developer container is removably mounted.

Furthermore, an example embodiment of the technology disclosed herein is provides a developer container capable of rotatably stably supporting a developer container main body containing a developer, and supplying the developer to the main body of an image forming apparatus with an amount as constant as possible regardless of an amount of the developer contained in the developer container main body, and to provide an image forming apparatus in which the developer container is removably mounted.

An example embodiment of the technology disclosed herein comprises a developer container that is mounted removably in an image forming apparatus, comprising:

a developer container main body that is formed into a cylindrical shape for containing a developer for use in image formation, is provided with an exhausting hole through which the developer is let out, and conveys the contained developer toward the exhausting hole by being rotated around its axial line; and a supporting member that supports the developer container main body rotatably around the axial line throughout a full circumference from an outer side in a radial direction of the developer container main body and is provided with a through hole for guiding the developer let out from the exhausting hole of the developer container main body to the outside.

According to an example embodiment of the technology disclosed herein, when a developer container main body that is supported rotatably around the axial line by a supporting member is rotated around the axial line, the contained developer is conveyed to an exhausting hole provided in the developer container main body. Thus, since the supporting member supports the developer container main body in an intermediate portion in the axial line direction of the developer container main body, even if a driving force for rotating the developer container main body is applied to the developer container main body, the developer container main body rotating around the axial line can be supported stably. The supporting member is also provided with a through hole for guiding the developer let out from the exhausting hole of the developer container main body to the outside. Thus, the developer that is conveyed toward the exhausting hole by rotating the developer container main body and is let out from the exhausting hole can be guided out through the through hole. For example, in the case of a conventional structure in which only an exhausting hole for letting out the developer contained in a rotating container is provided, the exhausting hole is also rotated together with the rotation of the container. Therefore, in order to prevent the developer let out from the rotating exhausting hole from leaking to an undesired potion, it is necessary to provide sealing means between the rotating container and the image forming apparatus. On the other hand, in an example embodiment of the technology disclosed herein, the developer contained in the developer container main body is guided out from the through hole of the supporting member that is not rotated with the developer container main body, and therefore the developer is easily prevented from leaking between the through hole that is not displaced and the image forming apparatus as much as possible. Furthermore, simply rotating the developer container main body can achieve both conveying the developer contained in the developer container main body and letting out the developer to the outside at the same time.

An example embodiment of the technology disclosed herein is characterized in that the exhausting hole of the developer container main body is provided in a substantially intermediate portion in the axial line direction of the developer container main body, and the supporting member supports the substantially intermediate portion in the axial line direction of the developer container main body including at least the exhausting hole throughout the full circumference from the outer side in the radial direction of the developer container main body.

According to an example embodiment of the technology disclosed herein, the exhausting hole of the developer container main body is provided in a substantially intermediate portion, so that the developer that is conveyed toward the exhausting hole by rotating the developer container main body and is contained on one end side in the axial line direction of the developer container main body and the developer that is contained on the other end side in the axial line direction of the developer container main body collide with each other near the exhausting hole in the developer container main body. For example, in a conventional structure in which the developer is conveyed to one end in the axial line direction of a container, there is a risk that the conveyed developer may aggregate by being pressed against the inner wall perpendicular to the axial line direction in the one end in the axial line direction of the container. In an example embodiment of the technology disclosed herein, the developer from one side in the axial line direction that is contained in the developer container main body and the developer from the other side in the axial line direction collide with each other near the exhausting hole in the developer container main body, that is, in a substantially intermediate portion in the axial line direction where there is no wall perpendicular to the axial line, unlike the conventional container, so that the developer can be agitated. Thus, even if the developer contained in the developer container main body is aggregated, the developer can be agitated and turned into a powder by rotating the developer container main body.

An example embodiment of the technology disclosed herein is characterized in that the developer container main body includes a first container portion formed into a cylindrical shape having a bottom, a second container portion formed into a cylindrical shape having a bottom and a coupling member formed into a cylindrical shape and provided with an exhausting hole, and one end in an axial line direction of the coupling member is coupled removably with an open end of the first container portion, and the other end in the axial line direction of the coupling member is coupled removably with an open end of the second container portion.

According to an example embodiment of the technology disclosed herein, the developer container main body includes a first container portion formed into a cylindrical shape having a bottom, a second container portion formed into a cylindrical shape having a bottom and a coupling member formed into a cylindrical shape and provided with an exhausting hole. One end in the axial line direction of the coupling member is coupled removably with an open end of the first container portion. The other end in the axial line direction of the coupling member is coupled removably with an open end of the second container portion. Thus, a cylindrical developer container main body that is provided with an exhausting hole in an intermediate portion in the axial line direction and whose opposite ends in the axial line direction are closed can be realized. Furthermore, for example, when the contained developer is all let out and any one of the first container portion, the second container portion and the coupling member is worn out or damaged, then only the worn-out or damaged component can be replaced, and the developer can be contained again. Consequently, the recycling properties of the developer container can be improved.

Furthermore, an example embodiment of the technology disclosed herein is characterized in that in an inner circumferential portion of the first container portion is provided a first protrusion portion projecting inward in the radial direction of the first container portion and extending in one direction spirally around the axial line from the bottom to the open end thereof, and in an inner circumferential portion of the second container portion is provided a second protrusion portion projecting inward in the radial direction and extending in a direction opposite to the one direction spirally around the axial line from the bottom to the open end thereof.

According to an example embodiment of the technology disclosed herein, in an inner circumferential portion of the first container portion is provided a first protrusion portion projecting inward in the radial direction and extending in one direction spirally around the axial line from the bottom to the open end. Thus, rotating the developer container main body around the axial line easily achieves conveying the developer contained in the first container portion on the one end side in the axial line direction of the developer container main body toward the exhausting hole of the coupling member by the first protrusion portion. In an inner circumferential portion of the second container portion is provided a second protrusion portion projecting inward in the radial direction and extending in a direction opposite to the one direction spirally around the axial line from the bottom to the open end thereof. Thus, rotating the developer container main body around the axial line easily achieves conveying the developer contained in the second container portion on the other end side in the axial line direction of the developer container main body toward the exhausting hole of the coupling member by the second protrusion portion. This easily achieves that the developer from one side in the axial line direction that is contained in the developer container main body and the developer from the other side in the axial line direction collide with each other in a substantially intermediate portion, that is, near the exhausting hole in the developer container main body so that the developer can be agitated.

Furthermore, an example embodiment of the technology disclosed herein is characterized in that sealing means extending throughout the full circumference in the circumferential direction is provided between the developer container main body and the supporting member on the one end side in the axial line direction and the other end side in the axial line direction of the developer container main body from the exhausting hole and the through hole.

According to an example embodiment of the technology disclosed herein, sealing means extending throughout the full circumference in the circumferential direction is provided between the developer container main body and the supporting member on the one end side in the axial line direction and the other end side in the axial line direction of the developer container main body from the exhausting hole and the through hole, and therefore, the developer is prevented from leaking from between the developer container main body and the supporting member.

Furthermore, an example embodiment of the technology disclosed herein is characterized in that a holding portion for holding a developer between an outer circumferential portion of the developer container main body and an inner circumferential portion of the supporting member is provided on the upstream side in the rotation direction from the exhausting hole of the developer container main body.

According to an example embodiment of the technology disclosed herein, a holding portion for holding a developer between an outer circumferential portion of the developer container main body and an inner circumferential portion of the supporting member is provided on the upstream side in the rotation direction from the exhausting hole of the developer container main body. Therefore, when the developer container main body is rotated, the holding portion provided on the upstream side in the rotation direction from the exhausting hole of the developer container main body is positioned at a position facing the through hole, supplies the developer held in the holding portion to the through hole and lets out the developer through the through hole. When the developer container main body is disposed such that its axial line is parallel to the horizontal plane and the through hole of the supporting member is disposed near a central portion in the vertical direction, even if the amount of the developer contained in the developer container main body is reduced, the developer remaining in a lower portion in the coupling member of the developer container main body is also held by the holding portion and is conveyed to the through hole. Thus, the amount of the developer remaining without being conveyed to the through hole can be reduced, and all the developer can be guided out from the through hole as much as possible.

Furthermore, the an example embodiment of the technology disclosed herein is characterized in that the developer container main body is provided with a recess that is recessed inward in the radial direction in its outer circumferential portion, and the exhausting hole is formed in the recess, and the supporting member supports a portion including at least the recess of the developer container main body rotatably around the axial line throughout the full circumference from the outer side in the radial direction of the developer container main body.

According to an example embodiment of the technology disclosed herein, when the developer container main body that is supported rotatably around the axial line by the supporting member is rotated around the axial line, the contained developer is conveyed to the exhausting hole provided in the developer container main body. Since the supporting member supports the developer container main body in this manner, even if a driving force for rotating the developer container main body is applied to the developer container main body, the developer container main body rotating around the axial line can be supported stably. The developer container main body is provided with a recess that is recessed inward in the radial direction in its outer circumferential portion. Therefore, in a state where the portion including at least recess of the developer container main body is supported rotatably around the axial line by the supporting member, a space facing the recess and the exhausting hole of the developer container main body and the inner circumferential portion of the supporting member (hereinafter, which may be referred to as "holding space") is formed. The developer that is conveyed toward the exhausting hole by rotating the developer container main body and is let out from the exhausting hole is let out to the holding space. Furthermore, the supporting member is provided with a through hole for guiding out the developer let out from the exhausting hole of the developer container main body. The volume of the space is not changed, so that a change in the amount of the developer let out from the exhausting hole to the holding space and held therein, which depends on the amount of the developer contained in the developer container main body, can be prevented as much as possible. Therefore, when the developer container main body is rotated, the developer is let out from the exhausting hole to the holding space, and the developer in an amount based on the volume of the holding space is held in the holding space. The developer held in the holding space in this manner is guided out by the through hole, so that the amount of the developer let out per one rotation of the developer container main body can be kept as constant as possible.

For example, in the case of a conventional structure in which only an exhausting hole for letting out the developer contained in a rotating container is provided, the exhausting hole is also rotated together with the rotation of the container. Therefore, in order to prevent the developer let out from the rotating exhausting hole from leaking to an undesired potion, it is necessary to provide sealing means between the rotating container and the image forming apparatus. On the other hand, in an example embodiment of the technology disclosed herein, the developer contained in the developer container main body is guided out from the through hole of the supporting member that is not rotated with the developer container main body, and therefore the developer is easily prevented from leaking between the through hole that is not displaced and the image forming apparatus as much as possible. Furthermore, simply rotating the developer container main body can achieve both conveying the developer contained in the developer container main body and letting out the developer to the outside at the same time. Conventionally, the amount of the developer contained in the developer container main body affected the amount of the developer that is to let out from the developer container main body when the developer container main body makes one rotation. However, by letting the holding space whose volume is not changed hold the developer let out from the exhausting hole, the amount of the developer let out per one rotation of the developer container main body can be kept as constant as possible without depending the amount of the developer contained in the developer container main body.

Furthermore, an example embodiment of the technology disclosed herein is characterized in that the recess is formed, extending in the rotation direction, and the size thereof in the axial line direction is smaller than the size in the rotation direction, and the exhausting hole is formed on the downstream side in the rotation direction of the recess.

According to an example embodiment of the technology disclosed herein, the exhausting hole is formed on the downstream side in the rotation direction of the recess. Therefore, by rotating the developer container main body in the rotation direction, the developer in the developer container main body can be easily let out from the exhausting hole to the holding space. Furthermore, the recess is formed, extending in the rotation direction, and the size thereof in the axial line direction is smaller than the size in the rotation direction. Therefore, the holding space also can be formed, extending in the rotation direction, and the size thereof in the axial line direction is smaller than the size in the rotation direction. Consequently, the developer held in the holding space can be prevented from returning to the developer container main body through the exhausting hole as much as possible. Since the holding space is formed extending in the rotation direction, by setting the size in the rotation direction of the recess as appropriate, a desired amount of the developer can be held in the holding space.

Furthermore, an example embodiment of the technology disclosed herein is characterized in that the recess has an end wall portion intersecting the rotation direction at an end on the downstream side in the rotation direction, and the exhausting hole is formed in a portion of the end wall portion.

According to an example embodiment of the technology disclosed herein, the recess has an end wall portion intersecting the rotation direction at an end on the downstream side in the rotation direction, and the exhausting hole is formed in a portion of the end wall portion. For example, when the exhausting hole is opened entirely in the end wall portion, the developer is let out from the exhausting hole to the holding space while being forced out densely along the recess portion of the developer container main body and the inner circumferential portion of the supporting member by the developer container main body being rotated. In such a state, by the developer container main body being further rotated, there is a risk that the developer held in the holding space may be aggregated by being pressed by the recess portion of the developer container main body and the inner circumferential portion of the supporting member. In this embodiment, as described above, the exhausting hole is formed in a portion of the end wall portion. In other words, the exhausting hole can be formed such that the opening area thereof is smaller than the area of the end wall portion, so that the developer is let out to the holding space while being diffused near the exhausting hole in the holding space. Thus, the developer that is let out to the holding space can be turned into a powder, and aggregation of the developer due to the rotation of the developer container main body as described above can be prevented as much as possible. Thus, the powdered developer can be guided out by the through hole.

Furthermore, an example embodiment of the technology disclosed herein is characterized in that lead-out means for guiding the developer let out from the exhausting hole of the developer container main body to the through hole is provided in the inner circumferential portion of the supporting member.

According to an example embodiment of the technology disclosed herein, lead-out means for guiding the developer let out from the exhausting hole of the developer container main body to the through hole is provided in the inner circumferential portion of the supporting member. Thus, the developer let out from the exhausting hole of the developer container main body and held in the holding space can be guided to the through hole by the lead-out means.

Furthermore, an example embodiment of the technology disclosed herein is characterized in that the lead-out means is formed into a sheet form having flexibility and elasticity, and extends on the upstream side in the rotation direction with its fixed end provided in a portion facing the through hole of the supporting member and with its free end capable of being elastically contacted with the outer circumferential portion of the recess of the developer container main body.

According to an example embodiment of the technology disclosed herein, the lead-out means is formed into a sheet form having flexibility and elasticity, and extends on the upstream side in the rotation direction with its fixed end provided in a portion facing the through hole of the supporting member and with its free end capable of being elastically contacted with the outer circumferential portion of the recess of the developer container main body. In the state where the developer container main body is being rotated, by the free end of the lead-out means extending on the upstream side in the rotation direction and is elastically in contact with the outer circumferential surface of the recess of the developer container main body, the developer is scraped sequentially from the developer held in the holding space on the downstream in the rotation direction so as to be detached from the outer circumferential surface of the recess, and guided to the fixed end, and further guided to the through hole. In this manner, the developer that is let out from the exhausting hole of the developer container main body and held in the holding space can be guided to the through hole reliably by the lead-out means.

Furthermore, an example embodiment of the technology disclosed herein is characterized in that the free end of the lead-out means is in contact with the outer circumferential surface of the recess with an angle of more than 90 degrees.

According to an example embodiment of the technology disclosed herein, the free end of the lead-out means is in contact with the outer circumferential surface of the recess with an angle of more than 90 degrees. Therefore, in the state where the developer container main body is being rotated, the lead-out means prevents the free end from being curved to the downstream side in the rotation direction and being detached from the outer circumferential surface of the recess by the frictional force applied from the outer circumferential surface of the recess, so that the free end can be in contact with the outer circumferential surface of the recess stably. In this manner, the developer that is let out from the exhausting hole of the developer container main body and held in the holding space can be guided to the through hole reliably by the lead-out means.

Furthermore, an example embodiment of the technology disclosed herein is characterized by further including blocking means for closing the exhausting hole when the developer container main body is in an initial state with respect to the supporting member and opening the exhausting hole by rotating the developer container main body from the initial state.

According to an example embodiment of the technology disclosed herein, blocking means closes the exhausting hole when the developer container main body is in an initial state with respect to the supporting member and opens the exhausting hole by rotating the developer container main body from the initial state. Thus, in the initial state, the developer can be prevented from being let out undesirably from the developer container main body, and the exhausting hole can be opened easily to let out the developer in the developer container main body, not by the user directly removing the blocking means, but by rotating the developer container main body.

Furthermore, an example embodiment of the technology disclosed herein is characterized in that the recess and the exhausting hole of the developer container main body are provided in a substantially intermediate portion in the axial line direction.

According to an example embodiment of the technology disclosed herein, the recess and the exhausting hole of the developer container main body are provided in a substantially intermediate portion in the axial line direction, and therefore, the developer that is conveyed toward the exhausting hole by rotating the developer container main body and is contained on the one end side in the axial line direction of the developer container main body and the developer that is contained on the other end side in the axial line direction of the developer container main body collide with each other near the exhausting hole in the developer container main body. For example, in a conventional structure in which the developer is conveyed to the one end in the axial line direction of a container, there is a risk that the conveyed developer may aggregate by being pressed against the inner wall perpendicular to the axial line direction in the one end in the axial line direction of the container. In an example embodiment of he technology disclosed herein, the developer from one side in the axial line direction that is contained in the developer container main body and the developer from the other side in the axial line direction collide with each other near the exhausting hole in the developer container main body, that is, in a substantially intermediate portion in the axial line direction where there is no wall perpendicular to the axial line, unlike the conventional container, so that the developer can be agitated. Thus, even if the developer contained in the developer container main body is aggregated, the developer can be agitated and turned into a powder by rotating the developer container main body.

An example embodiment of the technology disclosed herein is characterized in that the developer container main body includes a first container portion formed into a cylindrical shape having a bottom, a second container portion formed into a cylindrical shape having a bottom and a third container portion formed into a cylindrical shape and provided with a recess and an exhausting hole, and the developer container main body is formed into one piece by coupling one end in the axial line direction of the third container portion with an open end of the first container portion, and coupling the other end in the axial line direction of the third container portion with an open end of the second container portion.

According to an example embodiment of the technology disclosed herein, the developer container main body includes a first container portion formed into a cylindrical shape having a bottom, a second container portion formed into a cylindrical shape having a bottom and a third container portion formed into a cylindrical shape and provided with a recess and an exhausting hole. The developer container main body is formed into one piece by coupling one end in the axial line direction of the third container portion with an open end of the first container portion, and coupling the other end in the axial line direction of the third container portion with an open end of the second container portion. Thus, a cylindrical developer container main body that is provided with a recess and an exhausting hole in an intermediate portion in the axial line direction and whose opposite ends in the axial line direction are closed can be realized. Furthermore, the contained developer including the first container portion, the second container portion and the third container portion can be produced easily by, for example blow molding for integral formation. Thus, the number of the components of the developer container can be reduced.

Furthermore, an example embodiment of the technology disclosed herein is characterized in that in an inner circumferential portion of the first container portion is provided a first protrusion portion projecting inward in the radial direction and extending in one direction spirally around the axial line from the bottom to the open end of the first container portion, and in an inner circumferential portion of the second container portion is provided a second protrusion portion projecting inward in the radial direction and extending in a direction opposite to the one direction spirally around the axial line from the bottom to the open end of the second container portion is provided.

According to an example embodiment of the technology disclosed herein, a first protrusion portion projecting inward in the radial direction and extending in one direction spirally around the axial line from the bottom to the open end is provided in the inner circumferential portion of the first container portion. Thus, rotating the developer container main body around the axial line easily achieves conveying the developer contained in the first container portion on the one end side in the axial line direction of the developer container main body toward the exhausting hole of the third container portion by the first protrusion portion. A second protrusion portion projecting inward in the radial direction and extending in a direction opposite to the one direction spirally around the axial line from the bottom to the open end is provided in an inner circumferential portion of the second container portion. Thus, rotating the developer container main body around the axial line easily achieves conveying the developer contained in the second container portion on the other end side in the axial line direction of the developer container main body toward the exhausting hole of the third container portion by the second protrusion portion. This easily achieves that the developer from one side in the axial line direction that is contained in the developer container main body and the developer from the other side in the axial line direction collide with each other in a substantially intermediate portion, that is, near the exhausting hole in the developer container main body so that the developer can be agitated.

Furthermore, an example embodiment of the technology disclosed herein is characterized in that sealing means extending throughout the full circumference in the circumferential direction of the developer container main body are provided between the developer container main body and the supporting member on the one end side and the other end side in the axial line direction of the developer container main body with respect to the recess and the exhausting hole of the developer container main body and the through hole of the supporting member.

According to an example embodiment of the technology disclosed herein, sealing means extending throughout the full circumference in the circumferential direction is provided between the developer container main body and the supporting member on the one end side in the axial line direction and the other end side in the axial line direction of the developer container main body with respect to the recess and the exhausting hole of the developer container main body and the through hole of the supporting member, and therefore the developer is prevented from leaking from between the developer container main body and the supporting member.

Furthermore, an example embodiment of the technology disclosed herein is characterized in that the inner diameter of the third container portion of the developer container main body is larger than the inner diameter of the remaining portions.

According to an example embodiment of the technology disclosed herein, the inner diameter of the third container portion of the developer container main body is larger than the inner diameter of the remaining portions. The powdered developer has a property that even if the developer is mounted on a horizontal surface in a sharp hill shape, the hill shape immediately becomes moderate. For example, in the case where the inner diameter of the third container portion of the developer container main body is formed so as to be equal to or smaller than the inner diameters of the remaining portions, the developer conveyed toward the exhausting hole by the rotation of the developer container main body becomes away from the third container portion when the rotation of the developer container main body stops. In this case, when the amount of the developer contained in the developer container main body becomes very small, it is difficult to convey a sufficient amount of the developer toward the exhausting hole immediately after the rotation of the developer container main body is started again. In this embodiment, the inner diameter of the third container portion of the developer container main body is formed so as to be larger than the inner diameters of the remaining portions, and therefore it is prevented as much as possible that the developer conveyed to the third container portion becomes away from the third container portion. Thus, even if the amount of the developer contained in the developer container main body becomes very small, a sufficient amount of the developer can be conveyed toward the exhausting hole as much as possible, immediately after the rotation of the developer container main body is started again. Furthermore, all the developer contained in the developer container main body can be let out as much as possible.

Furthermore, an example embodiment of the technology disclosed herein is characterized in that as the recess, a plurality of recesses are provided in the circumferential direction of the developer container main body with intervals.

According to an example embodiment of the technology disclosed herein, a plurality of recesses are provided in the circumferential direction of the developer container main body with intervals, and therefore, even if the developer has leaked on the upstream side in the rotation direction from the holding space facing the recess in which the exhausting hole of the developer container main body is formed and the inner circumferential portion of the supporting member, the leaked developer can be held by a holding space facing another recess that is disposed on the upstream side in the rotation direction with an interval in the circumferential direction of the recess and the inner circumferential portion of the supporting member. thus, the predetermined amount of the developer that is let out for every rotation of the developer container main body can be kept as constant as possible.

An example embodiment of the technology disclosed herein is characterized in that the supporting member supports a portion including at least an exhausting hole of the developer container main body rotatably around the axial line throughout the full circumference from the outer side in the radial direction, and the through hole is disposed above the axial line of the developer container main body when the container is mounted in an image forming apparatus.

According to an example embodiment of the technology disclosed herein, when the developer container main body that is supported by the supporting member rotatably around the axial line is rotated around the axial line, the contained developer is conveyed to the exhausting hole provided in the outer circumferential portion of the developer container main body. Since the supporting member supports the developer container main body in this manner, the supporting member can support stably the developer container main body rotating around the axial line, even if a driving force for rotating the developer container main body is supplied to the developer container main body. Furthermore, the supporting member is provided with a through hole for guiding the developer let out from the exhausting hole of the developer container main body to the outside. For example, in the case of a conventional structure in which only an exhausting hole for letting out the developer contained in a rotating container is provided, the exhausting hole is also rotated together with the rotation of the container. Therefore, in order to prevent the developer let out from the rotating exhausting hole from leaking to an undesired potion, it is necessary to provide sealing means between the rotating container and the image forming apparatus. On the other hand, in an example embodiment of the technology disclosed herein, the developer contained in the developer container main body is guided outside from the through hole of the supporting member that is not rotated with the developer container main body, and therefore the developer is easily prevented from leaking between the through hole that is not displaced and the image forming apparatus as much as possible. Furthermore, simply rotating the developer container main body can achieve both conveying the developer contained in the developer container main body and letting out the developer to an external portion at the same time. Furthermore, the through hole is disposed above the axial line of the developer container main body when the container is mounted in an image forming apparatus. For example, in the case where the through hole is disposed below the axial line of the developer container main body when the container is mounted in an image forming apparatus, since the amount of the developer that is guided from the through hole to the outside depends on the self-weight of the developer layer, that is, the amount of the contained developer, when the amount of the contained developer is large, then the amount of the developer that is guided outside becomes large. When the amount of the contained developer is small, then the amount of the developer that is guided outside becomes small. Therefore, as an example embodiment of the technology disclosed herein, by disposing the through hole above the axial line of the developer container main body when the container is mounted in an image forming apparatus, the developer can be supplied to the image forming apparatus main body with the developer supplied to the image forming apparatus as constant as possible regardless of the amount of the contained developer.

Furthermore, an example embodiment of the technology disclosed herein is characterized in that an angle formed by a virtual straight line connecting the axial line of the developer container main body and the center of the through hole with respect to a horizontal plane is from 30 degrees to 70 degrees when the container is mounted in an image forming apparatus.

According to an example embodiment of the technology disclosed herein, an angle formed by a virtual straight line connecting the axial line of the developer container main body and the center of the through hole with respect to a horizontal plane is from 30 degrees to 70 degrees when the container is mounted in an image forming apparatus. For example, in the case where an angle formed by a virtual straight line connecting the axial line of the developer container main body and the center of the through hole with respect to a horizontal plane is less than 30 degrees when the container is mounted in an image forming apparatus, when a large amount of the developer is present in the developer container, a large amount of the developer tends to be let out. In the case where the angle exceeds 70 degrees, when the amount of the developer in the developer container is reduced, the amount of the developer let out may be reduced. Therefore, when an angle formed by a virtual straight line connecting the axial line of the developer container main body and the center of the through hole with respect to a horizontal plane is from 30 degrees to 70 degrees when the container is mounted in an image forming apparatus, the developer can be supplied to the image forming apparatus main body with the developer supplied to the image forming apparatus as constant as possible regardless of the amount of the contained developer.

Furthermore, an example embodiment of the technology disclosed herein is characterized in that the main body of an image forming apparatus comprises a supply port opening/closing means for switching a developer supply port that is connected thereto via a passage for guiding a developer to a developing portion between an open state and a close state, the developer container is mounted in the image forming apparatus with the through hole facing the developer supply port, and the supporting member comprises a through hole opening/closing means for switching the through hole between an open state and a close state.

According to an example embodiment of the technology disclosed herein, since the main body of an image forming apparatus comprises a supply port opening/closing means for switching a developer supply port that is connected thereto via a passage for guiding a developer to a developing portion between an open state and a close state, by letting the developer supply port open, the developer can be supplied to the developing portion. Even if the developer flows back to the developer supply port via the passage from the developing portion, it is ensured to prevent the developer that has flown back from the developer supply port from leaking out by keeping the developer supply port closed. Furthermore, the supporting member is provided with a through hole opening/closing means for switching the through hole between the open state and the closed state. Therefore, the developer contained in the developer container can be led out from the through hole by rotating the developer container main body around the axial line with the through hole open. Furthermore, by letting the through hole closed, even if the developer container main body is rotated around the axial line by mistake, it is ensured to prevent the developer contained in the developer container from being led out from the through hole. Moreover, the developer container is mounted in an image forming apparatus with the through hole facing the developer supply port. Therefore, the developer contained in the developer container can be supplied to the developing portion of the image forming apparatus through the through hole and the passage by mounting the developer container in the image forming apparatus and rotating the developer container main body around the axial line with the developer supply port and the through hole open.

Furthermore, an example embodiment of the technology disclosed herein is characterized in that the developer container is mounted in an image forming apparatus so that the through hole faces the developer supply port of the image forming apparatus and sealing is achieved between a periphery facing the through hole of the developer container and a periphery facing the developer supply port of the image forming apparatus, and when the developer container is mounted in the image forming apparatus, the through hole opening/closing means switches the through hole to the open state in connection with an operation of the supply port opening/closing means switching the developer supply port to the open state.

According to an example embodiment of the technology disclosed herein, when the developer container is mounted in the image forming apparatus, the through hole opening/closing means switches the through hole to the open state in connection with an operation of the supply port opening/closing means switching the developer supply port to the open state, and therefore, it is not necessary to let the developer supply port and the through hole open in advance, before mounting the developer container on the image forming apparatus. Thus, for example, it is ensured to prevent the developer contained in the developer container from being let out through the through hole undesirably by rotating the developer container main body of the developer container around the axial line by mistake with the through hole being opened before mounting the developer container on the image forming apparatus. Furthermore, the developer container is mounted in the image forming apparatus with the through hole facing the developer supply port of the image forming apparatus and with sealing achieved between the peripheral portion facing the through hole of the developer container and the peripheral portion facing the developer supply port of the image forming apparatus. Thus, it is ensured to prevent the developer from leaking to an undesired portion when supplying the developer contained in the developer container to the developing portion of the image forming apparatus through the through hole and the passage by rotating the developer container main body around the axial line with the developer container mounted in the image forming apparatus.

Furthermore, an example embodiment of the technology disclosed herein is characterized in that the supporting member can be divided into a plurality of pieces in the circumferential direction.

According to an example embodiment of the technology disclosed herein, the supporting member can be divided into a plurality of pieces in the circumferential direction. Therefore, when supporting the developer container main body, the supporting member is previously divided, and the divided pieces of the supporting member support a portion including the exhausting hole of the developer container main body or a portion including the recess portion and the exhausting hole of the developer container main body from the outer side in the radial direction, so that the developer container main body can be supported throughout the full circumference of the developer container main body, and such assembling work can be easily performed.

Furthermore, an example embodiment of the technology disclosed herein is characterized in that the supporting member comprises a support stand having at least three contact portions on a virtual plane that is parallel to the axial line.

According to an example embodiment of the technology disclosed herein, the supporting member comprises a support stand having at least three contact portions on a virtual plane that is parallel to the axial line, so that by bringing the contact portions into contact with the horizontal plane, the supporting member can support the developer container main body stably such that its axial line is parallel to the horizontal plane.

Furthermore, an example embodiment of the technology disclosed herein is characterized in that a coupling portion that is coupled removably to a driving source provided in an image forming apparatus is formed in the developer container main body.

According to an example embodiment of the technology disclosed herein, a coupling portion that is coupled removably to a driving source provided in an image forming apparatus is formed in one end in the axial line direction of the developer container main body. By coupling the coupling portion to the driving source of the image forming apparatus, a driving force from the driving source is supplied to the developer container main body so that the developer container main body can be rotated around the axial line.

Furthermore, an example embodiment of the technology disclosed herein is characterized in that a coupling portion is provided in one end in the axial line direction of the developer container main body, the length from the supporting member of the developer container main body to an end face of the one end in the axial line direction is smaller than the length from the supporting member to an end face of the other end in the axial line direction, and the supporting member is attached to an image forming apparatus main body such that the through hole is in communication with the developer supply port that is in communication with the developing portion of the image forming apparatus main body.

According to an example embodiment of the technology disclosed herein, the sup porting member is disposed in the substantially central portion in the axial line direction of the developer container main body. Therefore, the developer container is attached to the central portion in the front-back direction of the image forming apparatus main body such that the through hole of the supporting member is in communication with the developer supply port. Thus, the developer container main body can be extended from the central portion in the front-back direction to the front portion of the image forming apparatus main body and extended from the central portion in the front-back direction to the back portion, and thus the capacity can be increased significantly compared with the conventional container. Furthermore, when the length from the supporting member of the developer container main body to the end face of the one end in the axial line direction is smaller than the length from the supporting member to the end face of the other end in the axial line direction, a region in which the driving portion coupled to the coupling portion of the one end in the axial line direction of the developer container main body is provided can be ensured in the back portion of the apparatus main body.

Furthermore, an example embodiment of the technology disclosed herein is an image forming apparatus in which the above-described developer container is removably mounted.

According to an example embodiment of the technology disclosed herein, in the image forming apparatus, the developer container that can achieve the above-described functions can be removably mounted.

BRIEF DESCRIPTION OF DRAWINGS

Other and further objects, features, and advantages of the invention will be more explicit from the following detailed description taken with reference to the drawings wherein.

DETAILED DESCRIPTION

Figure 1:
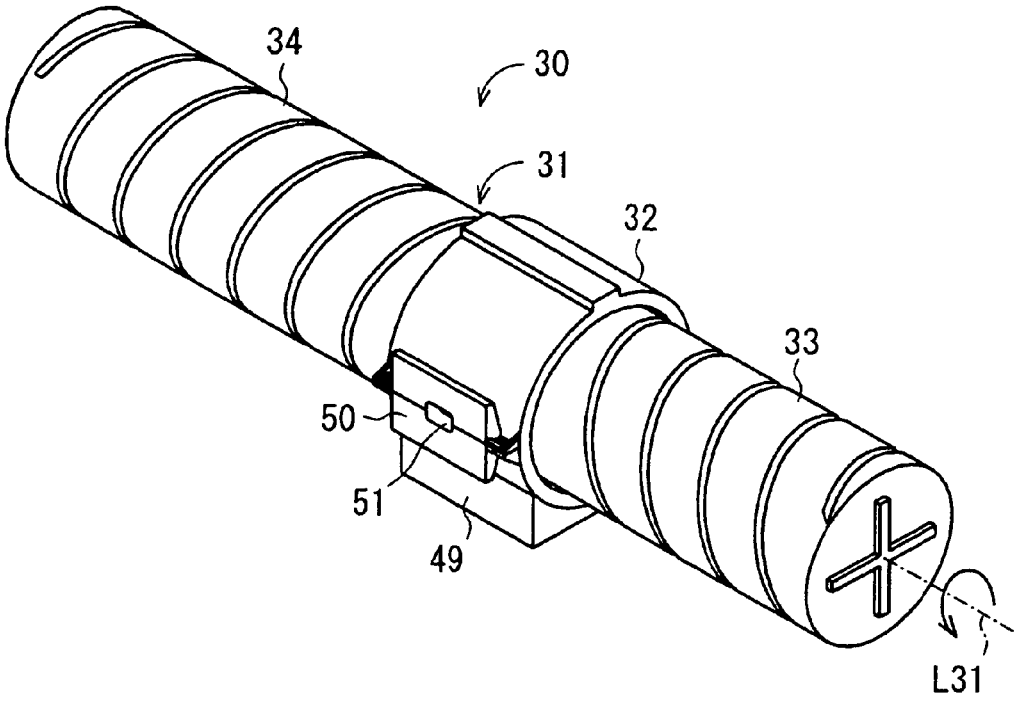
FIG. 1 is a perspective view showing a developer container of a first example embodiment.

Now referring to the drawings, preferred example embodiments are described below.

Figure 2:
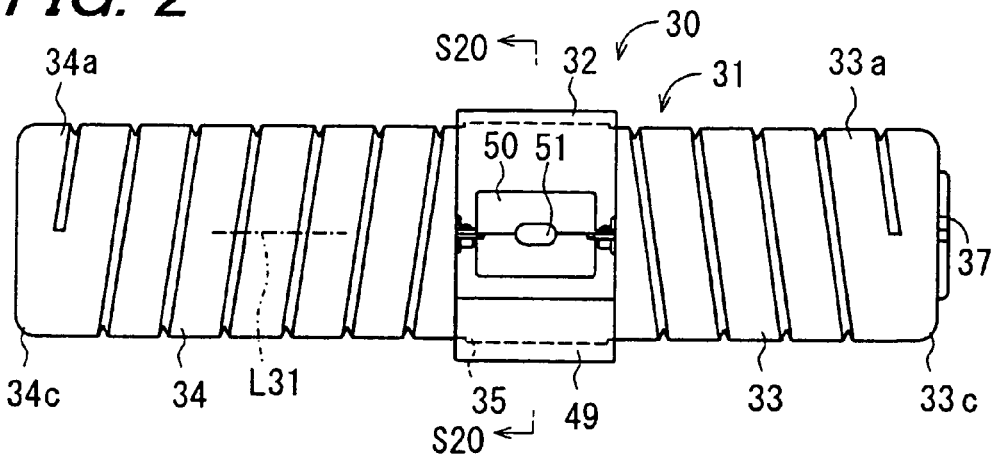
FIG. 2 is a front view showing the developer container 30.
Figure 3:
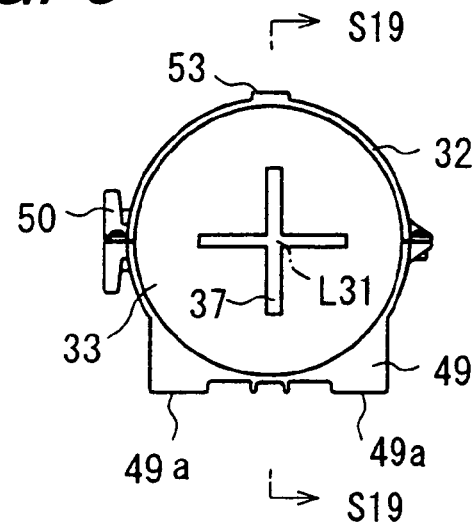
FIG. 3 is a side view showing the developer container 30.

FIG. 1 is a perspective view showing a developer container 30 of a first example embodiment. FIG. 2 is a front view showing the developer container 30. FIG. 3 is a side view showing the developer container 30. The developer container 30 includes a developer container main body 31 and a supporting member 32. The developer container main body 31 is formed substantially into a cylindrical shape, and contains a developer such as a toner used for forming electrophotographic images. The supporting member 32 supports the developer container main body 31 rotatably around its axial line L31. The developer container 30 can contain, for example, 1400 g of a developer.

Figure 4:
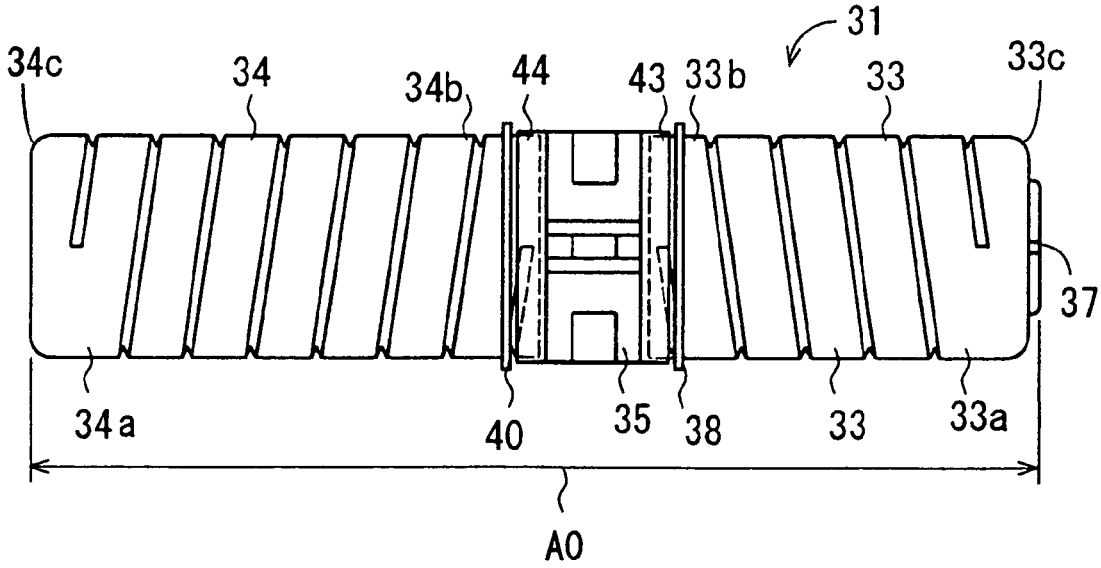
FIG. 4 is a front view showing the developer container main body 31.

FIG. 4 is a front view showing the developer container main body 31. The developer container main body 31 includes a first container portion 33, a second container portion 34 and a coupling member 35. The length A0 in the axial line L31 direction of the developer container main body 31 may be, for example, 450 mm.

Figure 5:
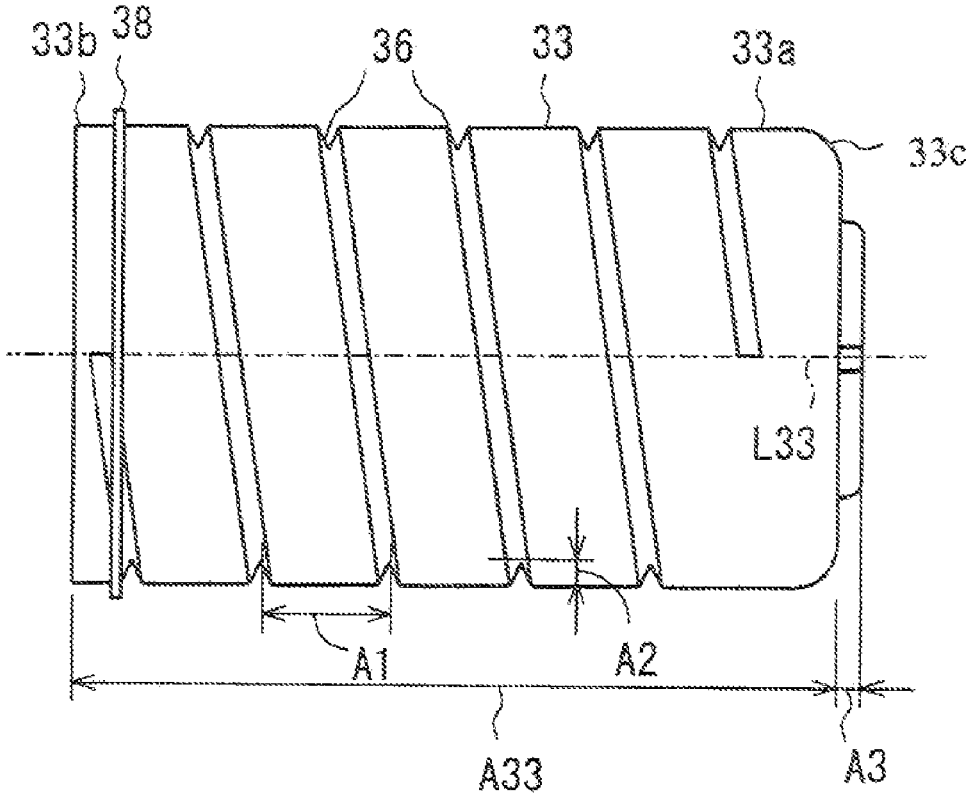
FIG. 5 is a front view showing the first container portion 33.
Figure 6:
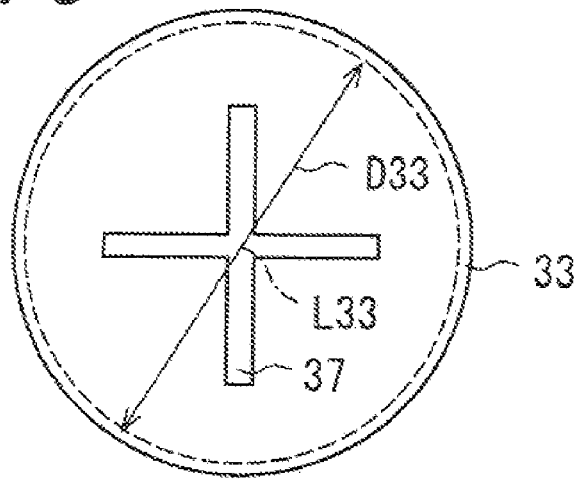
FIG. 6 is a right side view showing the first container portion 33.

FIG. 5 is a front view showing the first container portion 33. FIG. 6 is a right side view showing the first container portion 33. The first container portion 33 is formed into a cylindrical shape having a bottom. The length A33 in the axial line direction of the first container portion 33 may be, for example, 150 mm. The first container portion 33 is provided with a first protruding piece 36 projecting inward in the radial direction and extending spirally from a bottom 33*a*, which is one end in the axial line direction, to an open end 33*b*, which is the other end in the axial line direction, in its inner circumferential portion. More specifically, the first protruding piece 36 is formed, extending spirally so as to rotate clockwise around the axial line L33 of the first container portion 33, from the bottom 33*a* to the open end 33*b*, when viewed from the bottom 33*a*. The pitch A1 of the first protruding piece 36 may be, for example, 30 mm. The amount A2 of the projection inward in the radial direction from the remaining portion of the inner circumferential portion of the first protruding piece 36 may be, for example, 6 mm.

An engaging projecting portion 37, which is a coupling portion projecting in the direction from the open end 33*b* to the bottom 33*a*, is formed on the bottom 33*a* of the first container portion 33. More specifically, the engaging projecting portion 37 has a cruciform section taken along a plane perpendicular to the axial line L33 of the first container portion 33, and is formed such that the intersectional portion passes through the axial line L33. The amount A3 of the projection of the engaging projecting portion 37 in the axial line L33 direction from the remaining portion of the bottom 33*a* may be, for example, 8 mm. A surface 33*c* in which the outer circumferential surface and the end face in the bottom 33*a* of the first container portion 33 are in communication with each other is formed into a curved face that inclines inward in the radial direction from the open end 33*b* to the bottom 33*a*. A flange portion 38 projecting outward in the radial direction and extending around the full circumference in the circumferential direction is provided in the outer circumferential portion at the position spaced away from the end face of the open end 33*b* of the first container portion 33 toward the bottom 33*a*. An external thread is provided throughout the outer circumferential portion from the end face of the open end 33*b* of the first container portion 33 to the flange portion 38. Such a first container portion 33 may be produced by blow molding with a synthetic resin such as polyethylene.

Figure 7:
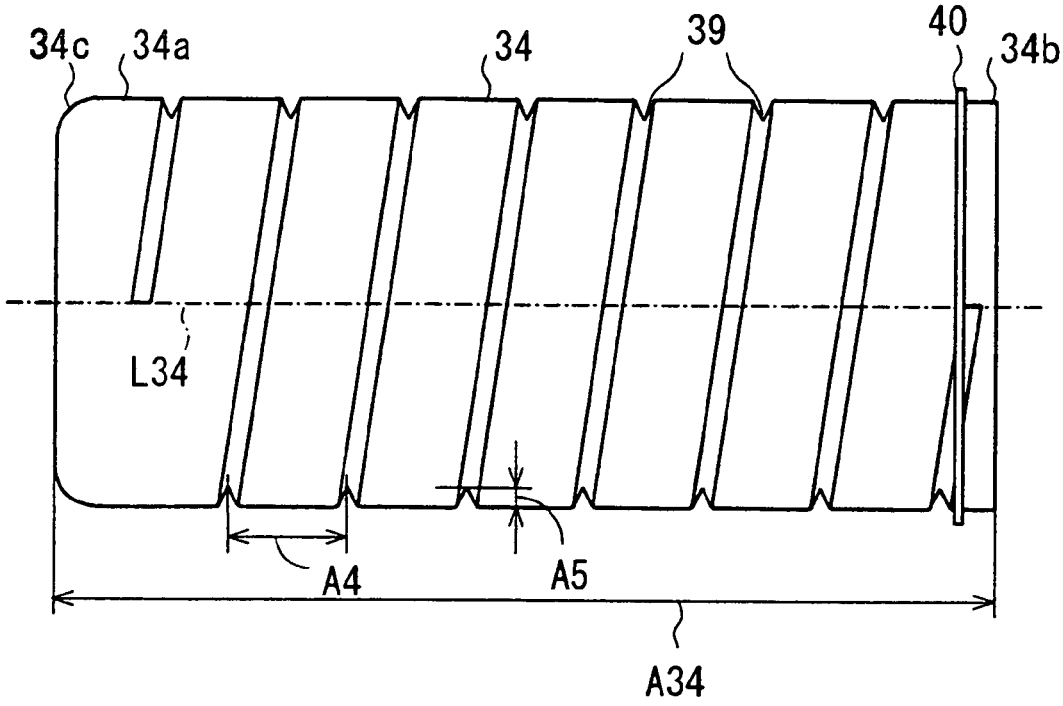
FIG. 7 is a front view showing the second container portion 34.
Figure 8:
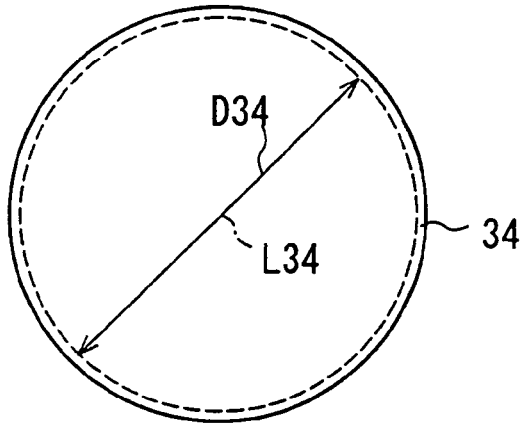
FIG. 8 is a left side view showing the second container portion 34.

FIG. 7 is a front view showing the second container portion 34. FIG. 8 is a left side view showing the second container portion 34. The first container portion 33 is formed into a cylindrical shape having a bottom. The length A34 in the axial line direction of the second container portion 34 may be, for example, 215 mm. The second container portion 34 is provided with a second protruding piece 39 projecting inward in the radial direction and extending spirally from a bottom 34*a*, which is the other end in the axial line direction, to an open end 34*b*, which is one end in the axial line direction, in its inner circumferential portion. More specifically, the second protruding piece 39 is formed, extending spirally so as to rotate counter-clockwise around the axial line L34 of the second container portion 34, from the bottom 34*a* to the open end 34*b*, when viewed from the bottom 34*a*. The second projection piece 39 is formed so as to extend in the direction opposite to the first protruding piece 36. The pitch A4 of the second protruding piece 39 may be, for example, 30 mm. The amount A5 of the projection inward in the radial direction from the remaining portion of the inner circumferential portion of the second protruding piece 39 may be, for example, 6 mm.

A surface 34*c* in which the outer circumferential surface and the end face in the bottom 34*a* of the second container portion 34 are in communication with each other is formed into a curved face that inclines inward in the radial direction from the open end 34*b* to the bottom 34*a*. A flange portion 40 projecting outward in the radial direction and extending around the full circumference in the circumferential direction is provided in the outer circumferential portion at the position spaced away from the end face of the open end 34*b* of the second container portion 34 toward the bottom 34*a*. An external thread is provided throughout the outer circumferential portion from the end face of the open end 34*b* of the second container portion 34 to the flange portion 40. Such a second container portion 34 can be produced in the same manner as the first container portion 33.

The length A34 in the axial line direction of the second container portion 34 is larger than the length A33 in the axial line direction of the first container portion 33, and is set to be longer by, for example, 30 mm or more. The length A33 in the axial line direction of the first container portion 33 may be 150 mm, and the length A34 in the axial line direction of the second container portion 34 may be, for example, 210 mm. The inner diameter D33 of the inner circumferential portion excluding the first protruding piece 36 of the first container portion 33 and the inner diameter D34 of the inner circumferential portion excluding the second protruding piece 39 of the second container portion 33 may be, for example, 105 mm.

Figure 9:
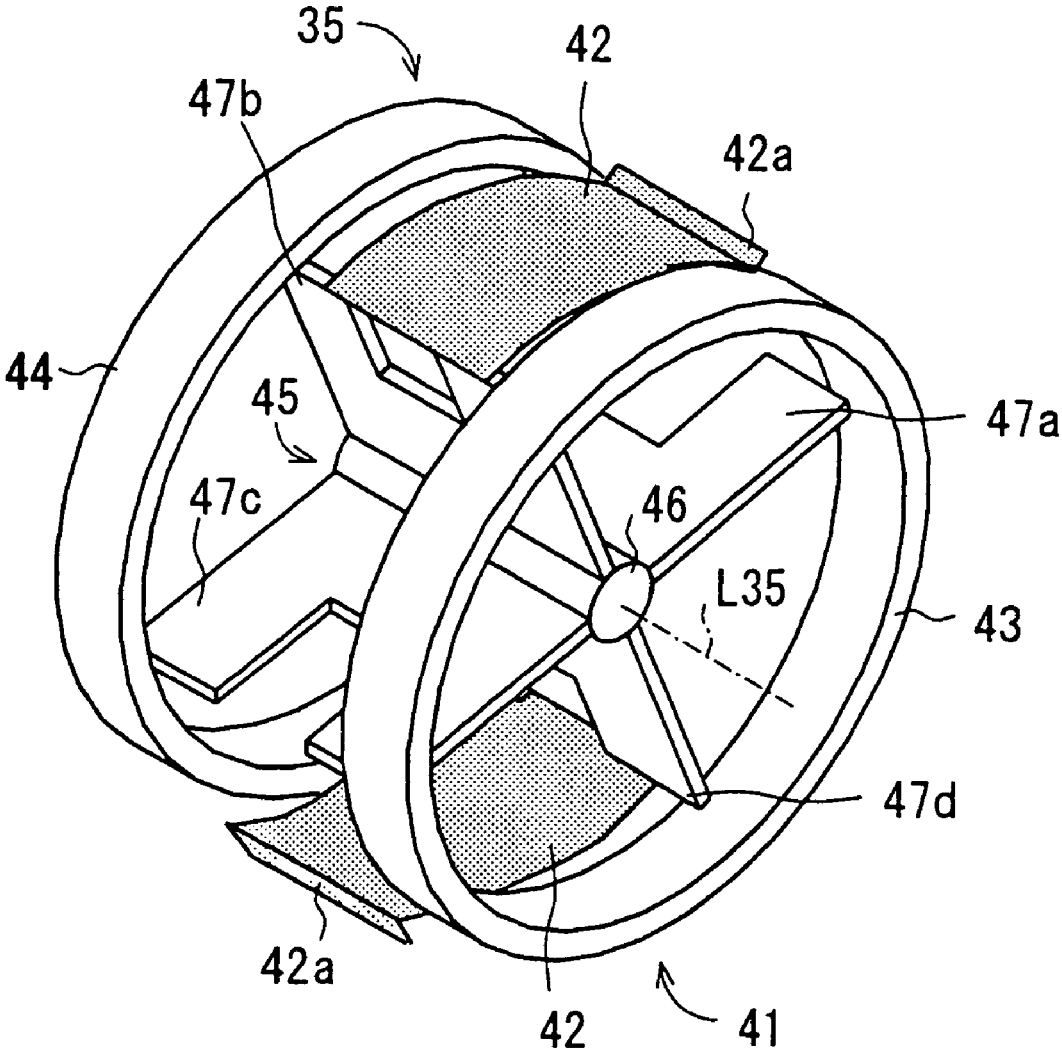
FIG. 9 is a perspective view showing the coupling member 35.
Figure 10:
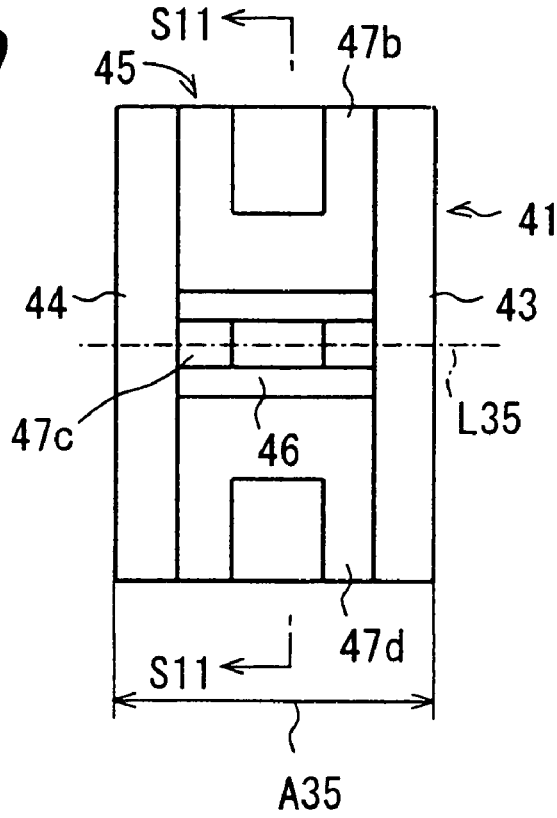
FIG. 10 is a front view showing the coupling member 35.
Figure 11:
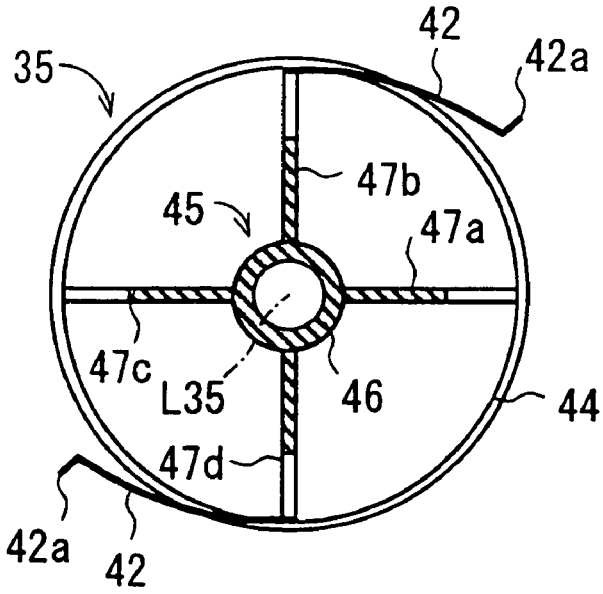
FIG. 11 is a cross-sectional view showing the coupling member 35.

FIG. 9 is a perspective view showing the coupling member 35. FIG. 10 is a front view showing the coupling member 35. FIG. 11 is a cross-sectional view showing the coupling member 35. FIG. 11 is a cross-sectional view taken along line S11-S11 of FIG. 10. The coupling member 35 is formed into a substantially cylindrical shape. More specifically, the coupling member 35 includes a coupling member main body 41 and a scraping member 42. The coupling member main body 41 includes a first cylinder portion 43, a second cylinder portion 44 and a rib 45. The first cylinder portion 43 and the second cylinder portion 44 are formed into a cylindrical shape. An inner thread is provided in the inner circumferential portions of the first cylinder portion 43 and the second cylinder portion 44. The length A35 in the axial line direction of the coupling member 35 may be, for example, 80 mm.

Regarding the rib 45, the first cylinder portion 43 is fixed to one end in the axial line direction of the rib 45 whose section taken along a plane perpendicular to the axial line L35 is formed substantially into an approximate cruciform, and the second cylinder portion 44 is fixed to the other end in the axial line direction, spaced away from the first cylinder portion 43 in the axial line direction. More specifically, the rib 45 includes an axle portion 46, a first agitating plate member 47*a*, a second agitating plate member 47*b*, a third agitating plate member 47*c* and a fourth agitating plate member 47*d*. The axle portion 46 is formed into an approximately cylindrical shape, and its axial line and the axial line of the rib 45 are coaxial.

The first to the fourth agitating plate members 47*a* to 47*d* are formed substantially in a flat plate-like shape. The first to the fourth agitating plate members 47*a* to 47*d* are fixed to the axle portion so as to be projected outward in the radial direction from the axle portion 46. Referring to FIG. 11, when viewed in the axial line direction from the one end in the axial line direction of the rib 45, the second agitating plate member 47*b* is displaced by an angle of 90 degrees counter-clockwise around the axial line L35 from the first agitating plate member 47*a*. The third agitating plate member 47*c* is displaced by an angle of 90 degrees counter-clockwise around the axial line L35 from the second agitating plate member 47*b*, and the fourth agitating plate member 4 7*d* is displaced by an angle of 90 degrees counter-clockwise around the axial line L35 from the third agitating plate member 47*c*.

The portions of the first to the fourth agitating plate members 47*a* to 47*d* that correspond to the outer end in the radial direction and the central portion in the axial line direction of the rib 45 are withdrawn inward in the radial direction from the remaining portions. In other words, the first to the fourth agitating plate members 47*a* to 47*d* are formed into a substantially U-shape that is open outward in the radial direction of the rib 45. The portions of the first to the fourth agitating plate members 47*a* to 47*d* that correspond to the one end in the axial line direction in the outer end in the radial direction of the rib 45 are fixed to the inner circumferential portion of the first cylinder portion 43. The portions of the first to the fourth agitating plate members 47*a* to 47*d* that correspond to the other end in the axial line direction in the outer end in the radial direction of the rib 45 are fixed to the inner circumferential portion of the second cylinder portion 44.

The scraping member 42 is a rectangular sheet-like member having an elasticity, and comprised of, for example, a polymer resin such as polyethylene terephthalate (abbreviated as "PET"). In the present embodiment, two scraping members 42 are used. One of the scraping member 42 is provided such that the one end thereof is fixed to the outer end in the radial direction of the second agitating plate member 47*b* between the first cylinder portion 43 and the second cylinder portion 44 with an adhesive, that the scraping member extends substantially in the circumferential direction from the second agitating plate member 47*b* to the first agitating plate member 47*a*. The other scraping member 42 is provided so as to be fixed to the free end of the fourth agitating plate member 47*d* between the first cylinder portion 43 and the second cylinder portion 44 with an adhesive, and so as to extend substantially in the circumferential direction from the fourth agitating plate member 47*d* to the third agitating plate member 47*c*. A free end 42*a* of each scraping member 42 is bent from the remaining portions so as to be projected outward in the radial direction from the first and the second cylinder portions 43 and 44.

The length from the end that is fixed to the second agitating plate member 47*b* to the free end 42*a* of each scraping member 42 is set to be shorter the length in the circumferential direction of the first and the second cylinder portion 43 and 44 across from the first agitating plate member 47*a* to the second agitating plate member 47*b*. Therefore, this is the same as the following state: in the portion between the first cylinder portion 43 and the second cylinder portion 44 of the coupling member 35, an exhausting hole that penetrates in the radial direction is provided at least between the second agitating plate member 47*b* and the third agitating plate member 47*c*, and between the fourth agitating plate member 47*d* and the first agitating plate member 47*a*.

Again, referring to FIG. 4, the inner thread of the first cylinder portion 43, which is one end in the axial line direction of the coupling member 35, is engaged with the outer thread of the open end 33*b* of the first container portion 33, so that the one end in the axial line direction of the coupling member 35 is removably coupled to the open end 33*b* of the first container portion 33. The inner thread of the second cylinder portion 44, which is the other end in the axial line direction of the coupling member 35, is engaged with the outer thread of the open end 34*b* of the second container portion 34, so that the other end in the axial line direction of the coupling member 35 is removably coupled to the open end 34*b* of the second container portion 34. In this case, the axial line L33 of the first container portion 33, the axial line L34 of the second container portion 34, and the axial line L35 of the coupling member 35 are provided so as to be coaxial. Thus, the first container portion 33, the second container portion 34, and the coupling member 35 are removably coupled to each other, so that for example, when all the contained developer is let out and any one of the first container portion 33, the second container portion 34 and the coupling member 35 has been worn out or damaged, only the one that has been worn out or damaged can be replaced and then a developer can be contained again. Therefore, the recycle properties of the developer container 30 can be improved.

The bottom 33*a* of the first container portion 33 corresponds to one end 33*a* in the axial line direction of the developer container main body 31, and the bottom 34*a* of the second container portion 34 corresponds to the other end 34*a* in the axial line direction of the developer container main body 31. The first container portion 33, the second container portion 34 and the coupling member 35 are coupled in this manner, so that the developer container main body 32 is formed. In this state, the coupling member 35 is disposed in an intermediate portion in the axial line direction excluding the opposite ends 33*a* and 34*a* in the axial line direction of the developer container main body 31. Therefore, the exhausting hole of the coupling member 35 is disposed in an intermediate portion in the axial line direction excluding the opposite ends 33*a* and 34*a* in the axial line direction of the developer container main body 31. The axial line L32 of the developer container main body 32 includes the axial line L33 of the first container portion 33, the axial line L34 of the second container portion 34, and the axial line L35 of the coupling member 35.

Figure 12:
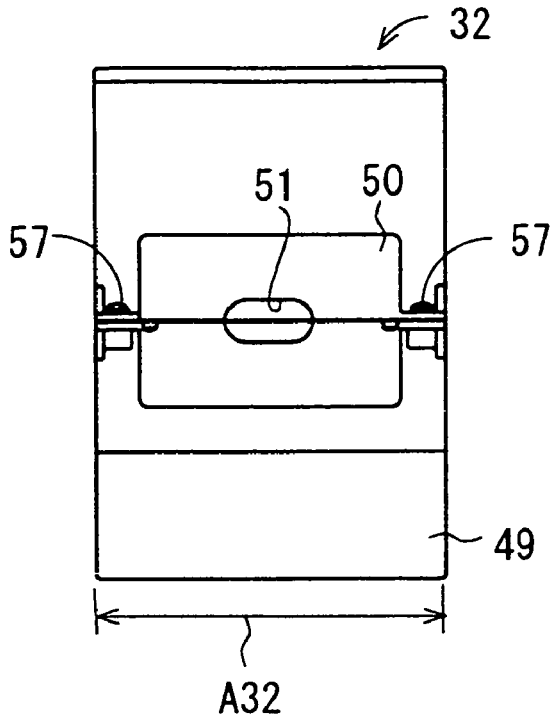
FIG. 12 is a front view showing the supporting member 32.
Figure 13:
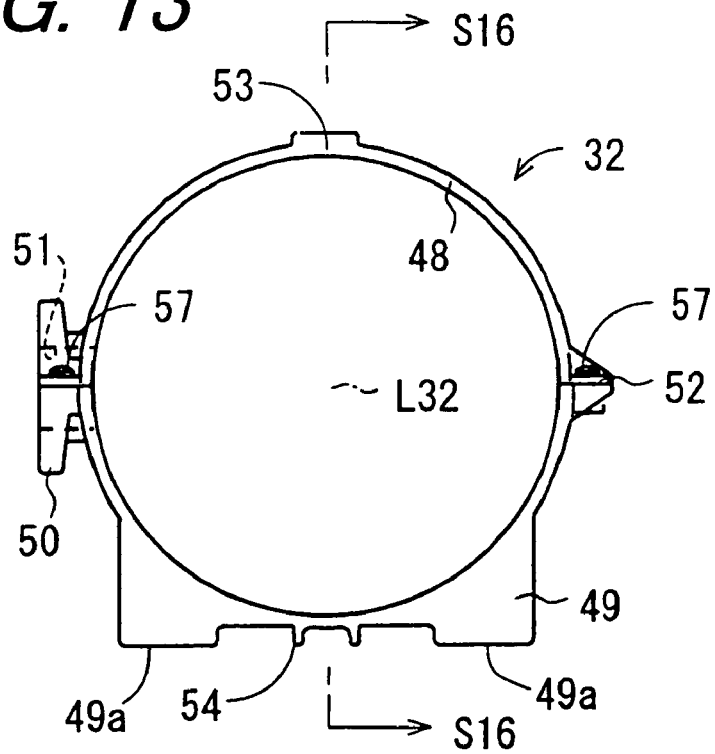
FIG. 13 is a right side view showing the supporting member 32.

FIG. 12 is a front view showing the supporting member 32. FIG. 13 is a right side view showing the supporting member 32. The supporting member 32 is formed substantially into a cylindrical shape, and has an inner circumferential portion 48 that supports portions including at least the coupling member 35 of the developer container main body 31 configured in the above-described manner throughout the full circumference from the outer side in the radial direction. The inner circumferential portion 48 has a cylindrical inner circumferential surface with the axial line L32 as the center. The supporting member 32 includes a support stand 49 having at least 3 contact portions 49*a* on a virtual plane parallel to the axial line L32. The contact portions 49*a* of the support stand 49 may be formed, for example, into two rectangular flat faces having a direction parallel to the axial line L32 as its longitudinal direction. By bringing the contact portions 49*a* of the support stand 49 in contact with the horizontal plane, an axial line of the inner circumferential portion 48 of the supporting member 32 can be disposed parallel to the horizontal plane. The length A32 in the axial line direction of the supporting member 32 is set to be larger than the length A35 in the axial line direction of the coupling member 35. The length A32 in the axial line direction of the supporting member 32 may be, for example, 100 mm.

An outlet portion 50 projecting outward in the radial direction that is perpendicular to the direction to which the support stand 49 projects is formed in a central portion in the axial line direction of the supporting member 32. A through hole 51 that is an elliptic opening, that penetrates in the radial direction and extending in the direction parallel to the axial line L32 of the supporting member is formed in a central portion in the axial line direction of the outlet portion 50. The inner diameter in the longitudinal direction of the through hole 51 is set to be smaller than the size in the axial line direction of the free end 42*a* of the scraping member 42 of the coupling member 35. The through hole 51 is above the support stand 49, and penetrates along a direction that is orthogonal to the axial line L48 of the inner circumferential portion 48 of the supporting member 32 and that is parallel to the horizontal plane in a state where the supporting member 32 is provided on the horizontal plane.

A protrusion portion 52 projecting outward in the radial direction that is opposite to the direction of the outlet portion 50 is formed in the supporting member 32. Furthermore, a first guide piece 53 projecting outward in the radial direction which is opposite to the direction of the support stand 49, and extending parallel to the axial line L32 is formed in the supporting member 32. Furthermore, a second guide piece 54 projecting outward in the radial direction that is the same direction to which the support stand 49 projects, and extending parallel to the axial line L32 is formed at a position axially symmetrical to the first guide piece 53 with respect to the axial line L32 in the central portion of the support stand 49. The second guide piece 54 does not project outward in the radial direction beyond the support stand 49.

Figure 14:
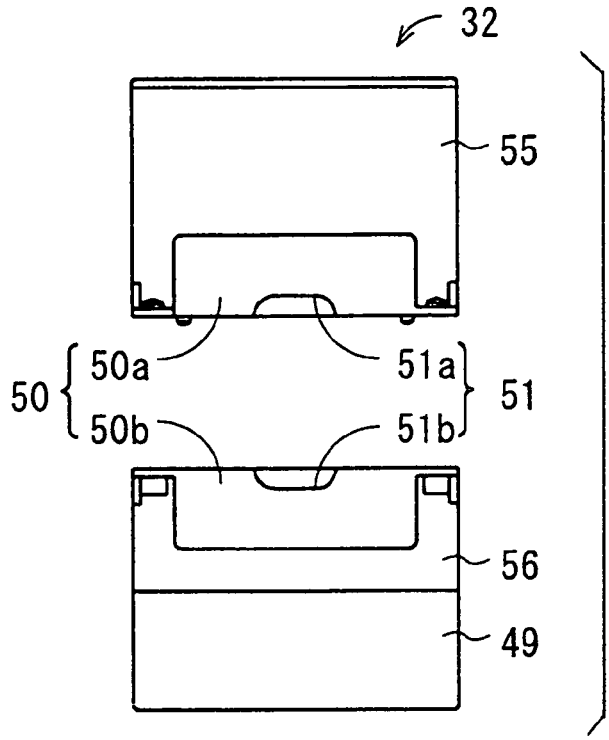
FIG. 14 is an exploded front view showing the supporting member 32.
Figure 15:
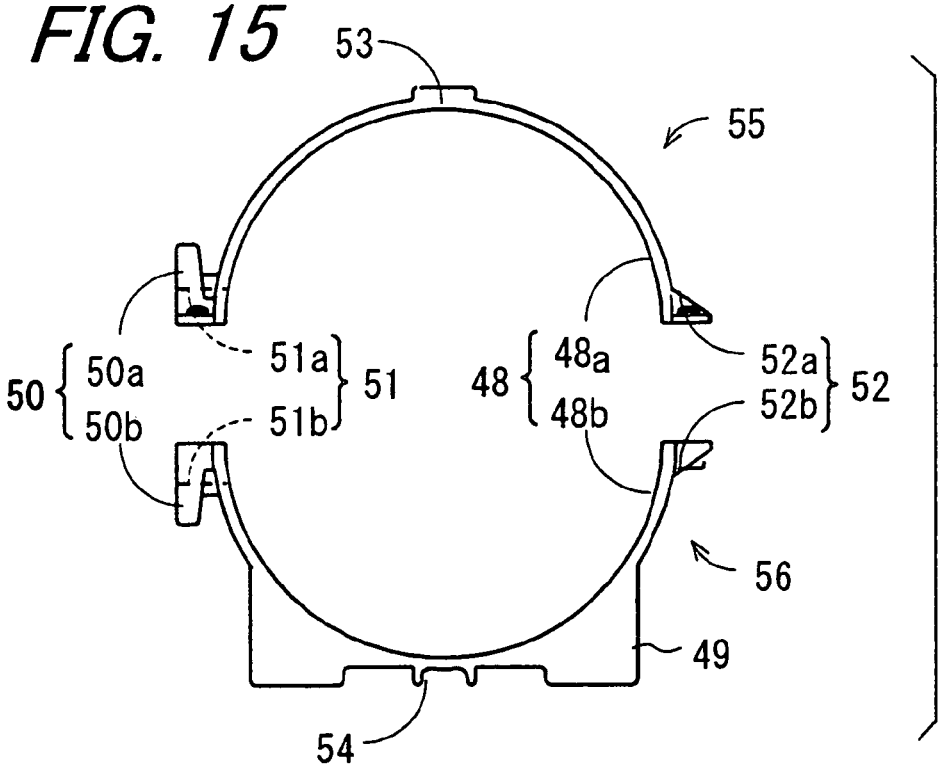
FIG. 15 is an exploded right side view showing the supporting member 32.

FIG. 14 is an exploded front view showing the supporting member 32. FIG. 15 is an exploded right side view showing the supporting member 32. In a state where the supporting member 32 is provided on the horizontal plane, which is a virtual plane perpendicular to the radial direction, the supporting member 32 can be divided into two portions in a virtual plane that passes through the axial line L32 and is parallel to the horizontal plane. More specifically, the supporting member can be divided into a first supporting portion 55, which is above the virtual plane, and a second supporting portion 56, which is below the virtual plane.

The first supporting portion 55 includes the first guide piece 53, a portion 50*a* on the first guide piece 53 side of the outlet portion 50, a portion 52*a* on the first guide piece 53 side of the protrusion portion 52, and a portion 48*a* on the first guide piece 53 side of the inner circumferential portion 48 in the supporting member 32. The second supporting portion 56 includes the support stand 49, the second guide piece 54, a portion 50*b* on the support stand 49 side of the outlet portion 50, a portion 52*b* on the support stand 49 side of the protrusion portion 52, and a portion 48*b* on the support stand 49 side of the inner circumferential portion 48 in the supporting member 32. A groove 51*a* that is recessed toward the first guide piece 53 side is formed in the portion 50*a* on the first guide piece 53 side of the outlet portion 50 of the first supporting portion 55. A groove 51*b* that is recessed toward the support stand 49 side is formed in the portion 50*b* on the support stand 49 side of the outlet portion 50 of the second supporting portion 56.

The first supporting portion 55 and the second supporting portion 56 are coupled to each other by a screw members 57. More specifically, the portion 50*a* on the first guide piece 53 side of the outlet portion 50 of the first supporting portion 55 is coupled to the portion 50*b* on the support stand 49 side of the outlet portion 50 of the second supporting portion 56 by the screw member 57. Moreover, the portion 52*a* on the first guide piece 53 side of the protrusion portion 52 of the first supporting portion 55 is coupled to the portion 52*b* on the support stand 49 side of the protrusion portion 52 of the second supporting portion 56 by the screw member 57. In this case, the groove 51*a* in the portion 50*a* on the first guide piece 53 side of the outlet portion 50 of the first supporting portion 55 and the groove 51*b* in the portion 50*b* on the support stand 49 side of the outlet portion 50 of the second supporting portion 56 constitute the through hole 51.

Figure 16:
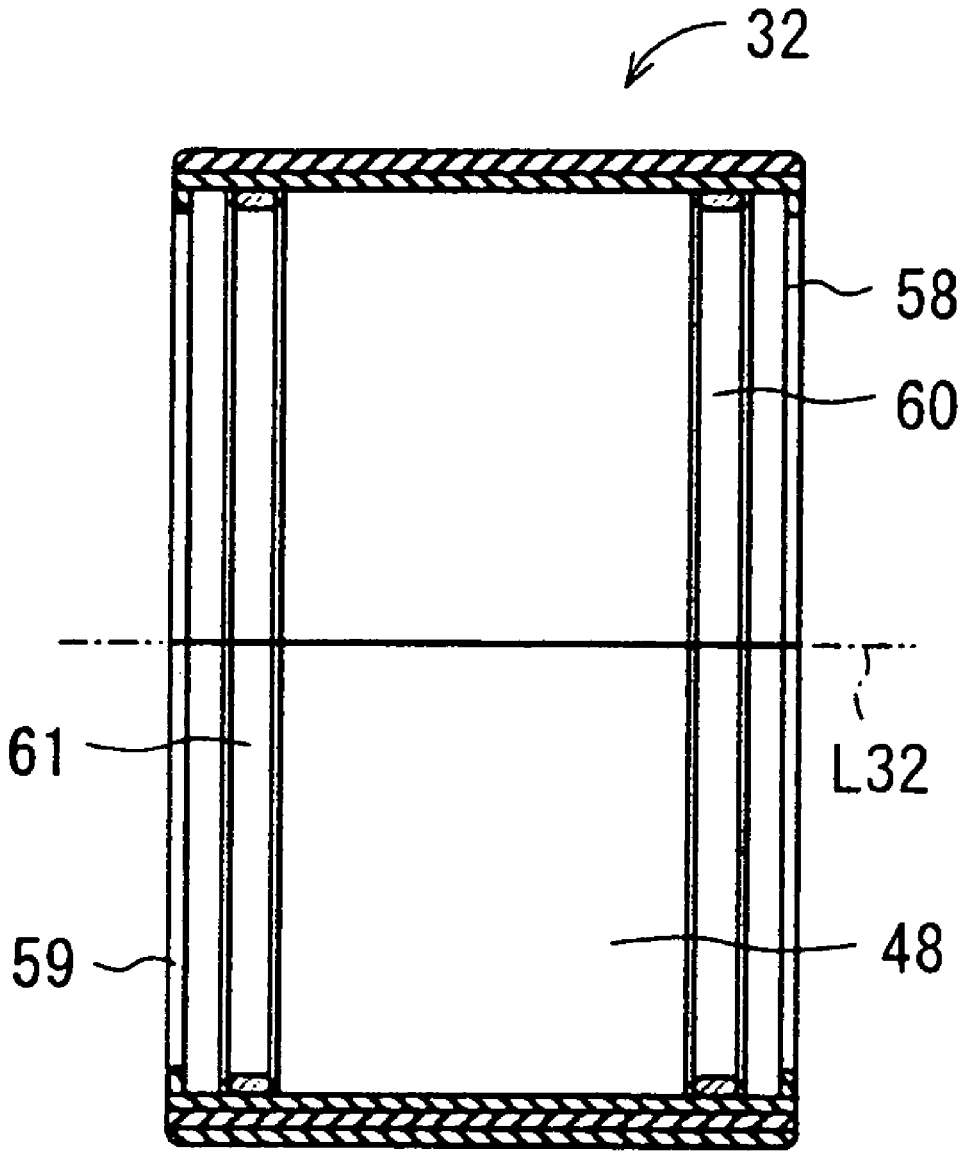
FIG. 16 is a cross-sectional view taken along line S16-S16 of FIG. 13.

FIG. 16 is a cross-sectional view taken along line S16-S16 of FIG. 13. A first projecting portion 58 projecting inward in the radial direction is provided in one end in the axial line direction of the inner circumferential portion 48 of the supporting member 32, and a second projecting portion 59 projecting inward in the radial direction is provided in the other end in the axial line direction. The inner diameters of the first projecting portion 58 and the second projecting portion 59 are set to be slightly larger than the outer diameter of the outer circumferential portion excluding the flange portions 38 and 40 of the first and the second container portion 33 and 34.

A circular first seal material 60 is fixed on the side of the other end in the axial line direction from the first projecting portion 58 in the one end in the axial line direction of the inner circumferential portion 48 of the supporting member 32 so as to project inward in the radial direction throughout the full circumference in the circumferential direction. A circular second seal material 61 is fixed on the side of the one end in the axial line direction from the second projecting portion 59 in the other end in the axial line direction of the inner circumferential portion 48 of the supporting member 32 so as to project inward in the radial direction throughout the full circumference in the circumferential direction. More specifically, a recess that is recessed outward in the radial direction and extends around the full circumference in the circumferential direction is formed in a position of the inner circumferential portion 48 of the supporting member 32 in which the first seal material 60 is to be fixed, and the first seal material 60 and the second seal material 61 are engaged in this recess, and fixed to the inner circumferential portion 48 of the supporting member 32 with at least a displacement in the axial line direction being regulated. The first seal material 60 and the second seal material 61 are made of, for example, a synthetic resin such as silicon rubber, having elasticity. The inner diameters of the portions of the inner circumferential portion 48 of the supporting member 32 excluding the first and the second projecting portions 58 and 59, the first and the second seal materials 60 and 61 and the recesses are set to be larger than the outer diameters of the first and the second cylinder portion 43 and 44 of the coupling member 35.

Figure 17:
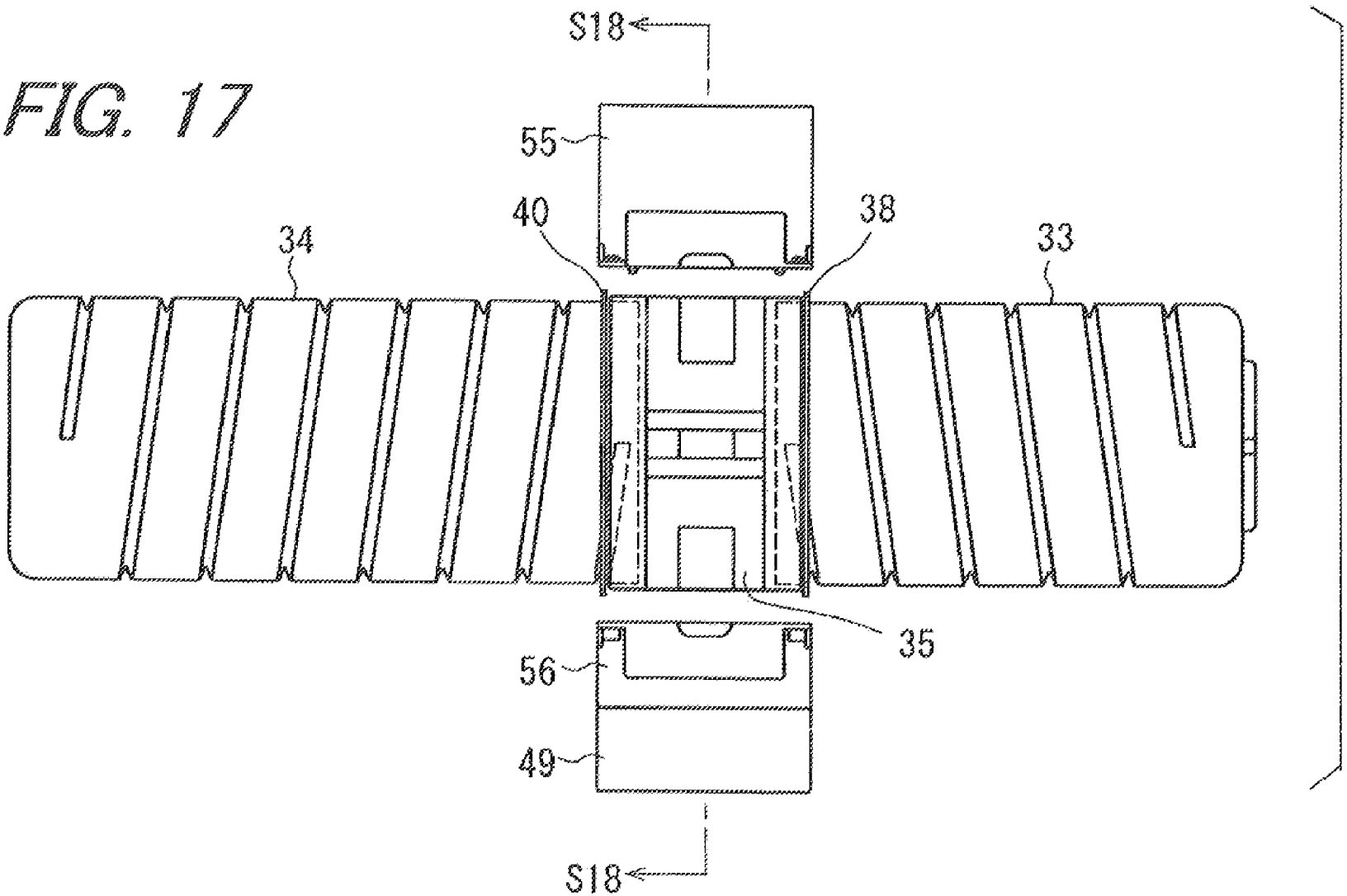
FIG. 17 is a front view showing the manner of assembling the developer container 30.
Figure 18:
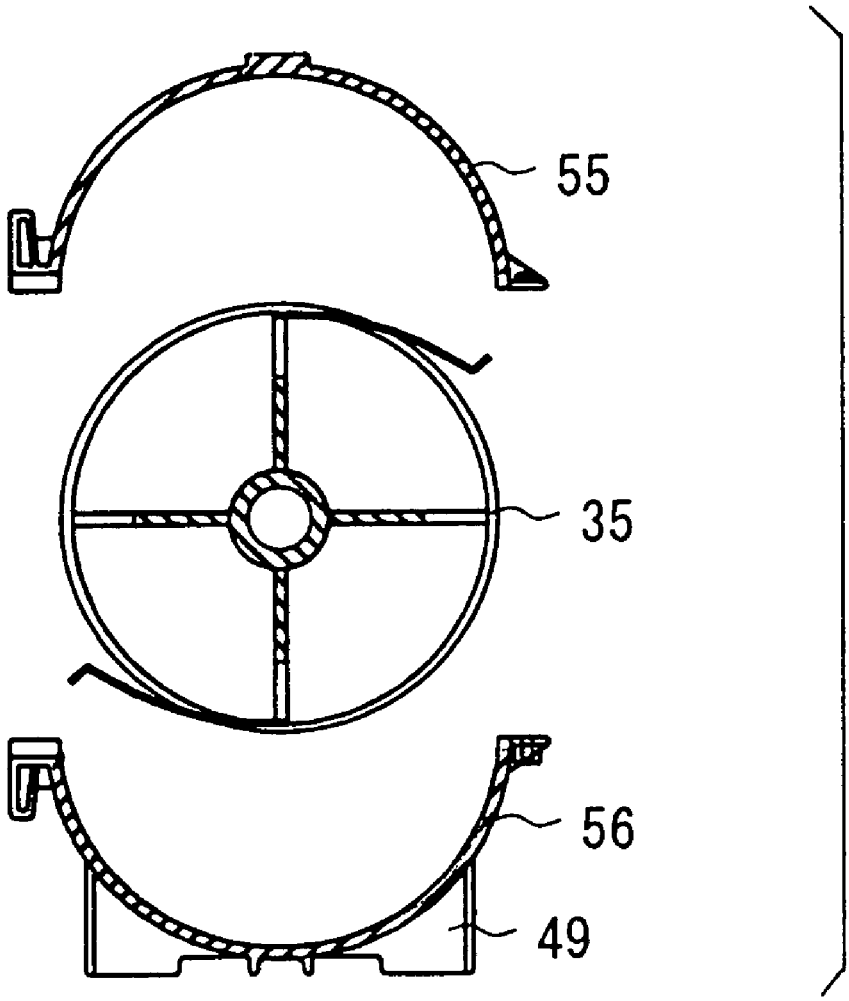
FIG. 18 is a cross-sectional view taken along line S18-S18 of FIG. 17.

FIG. 17 is a front view showing the manner of assembling the developer container 30. FIG. 18 is a cross-sectional view taken along line S18-S18 of FIG. 17. Before assembling the developer container 30, the supporting member 32 is divided into the first supporting portion 55 and the second supporting portion 56. The first supporting portion 55 and the second supporting portion 56 sandwich a portion including the coupling member 35 of the developer container main body 31 from the outer side in the radial direction. In this state, the first supporting portion 55 and the second supporting portion 56 are coupled to each other by the screw member 57. Thus, the developer container main body 31 is supported by the supporting member 32 throughout the full circumference from the outer side in the radial direction.

Figure 19:
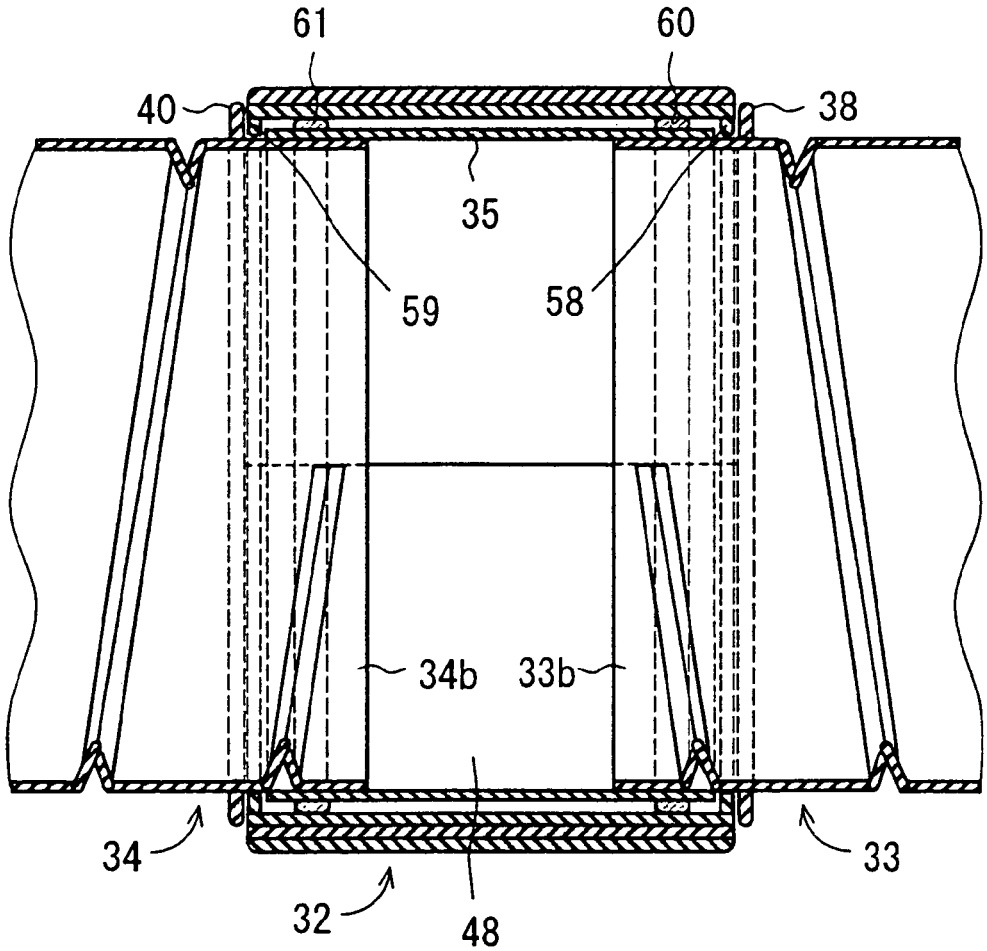
FIG. 19 is a cross-sectional view taken along line S19-S19 of FIG. 3.
Figure 20:
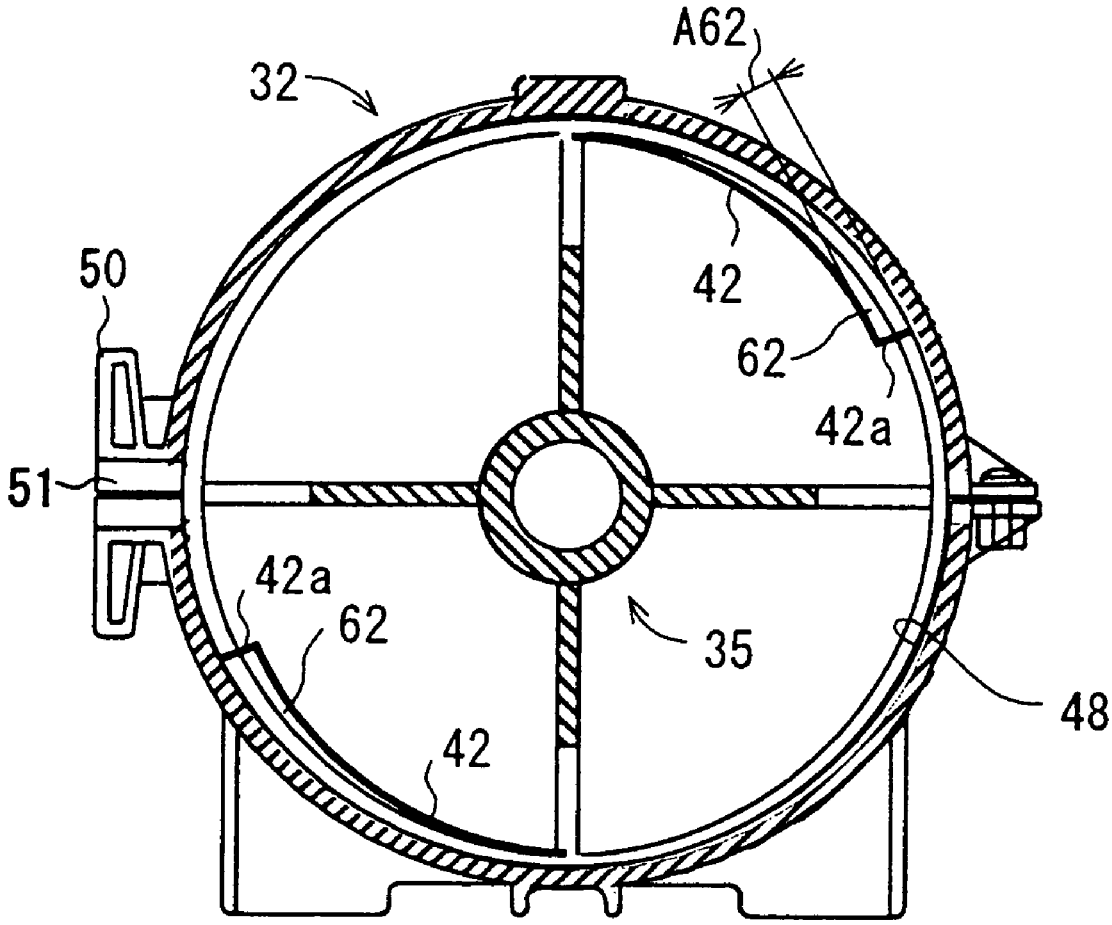
FIG. 20 is a cross-sectional view taken along line S20-S20 of FIG. 2.

FIG. 19 is a cross-sectional view taken along line S19-S19 of FIG. 3. FIG. 20 is a cross-sectional view taken along line S20-S20 of FIG. 2. In the state where the developer container main body 31 is supported by the supporting member 32, the axial line L31 of the developer container main body 31 completely or substantially matches the axial line L32 of the inner circumferential portion 48 of the supporting member 32, and the developer container main body 31 is rotatable around the axial line L31 with respect to the supporting member 32. Hereinafter, the axial line L31 of the developer container main body 31 may be referred to as "rotation axial line L31". When the support stand 49 of the supporting member 32 is provided on the horizontal plane in this state, the first and the second container portion 33 and 34 of the developer container main body 31 are away from the horizontal plane, and the horizontal plane is parallel to the rotation axial line L31.

The supporting member 32 is disposed between the two flange portions 38 and 40 of the developer container main body 31. The gap between the flange portion 38 of the first container portion 33 and the first projecting portion 58 of the supporting member 32 in the axial line L31 direction, and the gap between the flange portion 40 of the second container portion 34 and the second projecting portion 59 of the supporting member 32 in the axial line L31 direction are set to be small sufficient to prevent the developer from passing through. In this case, the developer container main body 31 is prevented from being displaced to one direction and the other direction on the rotation axial line L31 with respect to the supporting member 32.

The first projecting portion 58 of the supporting member 32 is disposed between the flange portion 38 of the first container portion 33 and the end face on the one end side in the axial line direction of the coupling member 35. The inner circumferential surface of the first projecting portion 58 of the supporting member 32 is opposed to the other end 33*b* in the axial line direction of the first container portion 33. The second projecting portion 59 of the supporting member 32 is disposed between the flange portion 40 of the second container portion 34 and the end face on the other end side in the axial line direction of the coupling member 35. The gap between the inner circumferential surface of the first projecting portion 58 and the other end 33*b* in the axial line direction of the first container portion 33 and the gap between the inner circumferential surface of the second projecting portion 59 and the other end 34*b* in the axial line direction of the second container portion 34 are set to be small sufficient to prevent the developer from passing through.

The first seal material 60 is elastically in contact with the outer circumferential portion of the coupling member 35, specifically, the outer circumferential surface of the first cylinder portion 43 of the coupling member 35, around the full circumference in the circumferential direction from the outer side in the radial direction. The second seal material 61 is elastically in contact with the outer circumferential portion of the coupling member 35, specifically, the outer circumferential surface of the second cylinder portion 44 of the coupling member 35, around the full circumference in the circumferential direction from the outer side in the radial direction. In this manner, sealing is achieved between the first seal material 60 and the outer circumferential portion of the coupling member 35 and between the second seal material 61 and the outer circumferential portion of the coupling member 35, and the coupling member 35 is slidable to the first and the second seal material 60 and 61.

The free end 42*a* of each scraping member 42 of the coupling member 35 is elastically in contact with the inner circumferential portion 48 of the supporting member 32 that is between the first seal material 60 and the second seal material 61. In this case, the remaining portion of the scraping member 42 excluding the free end 42*a* of the scraping member 42 is spaced away from the inner circumferential portion 48 of the supporting member 32, and a space 62 is formed between he remaining portion of the scraping member 42 excluding the free end 42*a* of the scraping member 42 and the inner circumferential portion 48 of the supporting member 32. A gap A62 that is the largest of the gaps between he remaining portion of the scraping member 42 excluding the free end 42*a* of the scraping member 42 and the inner circumferential portion 48 of the supporting member 32 is set to, for example, 8 mm. In this manner, sealing is achieved between the free end 42*a* of the scraping member 42 of the coupling member 35 and the inner circumferential portion 48 of the supporting member 32, and the free end 42*a* is slidable to the inner circumferential portion 48.

Figure 21:
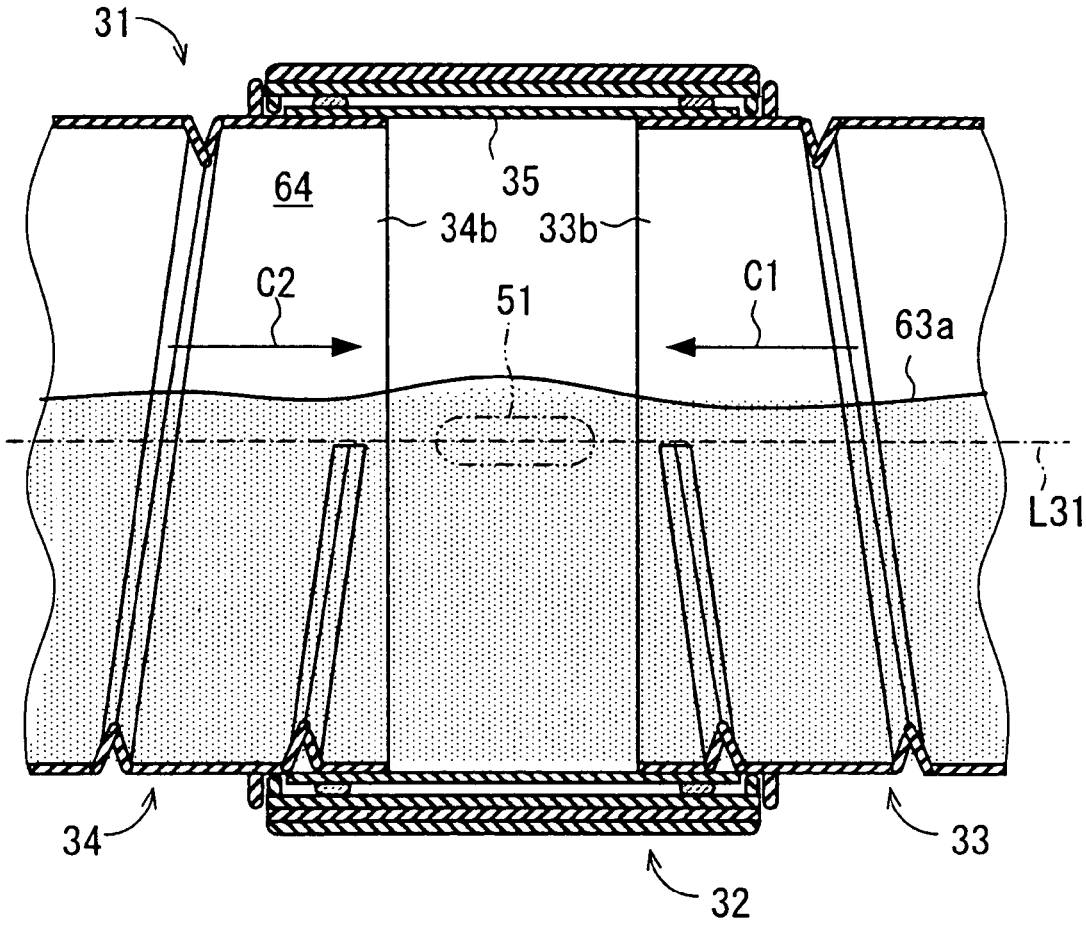
FIG. 21 is a cross-sectional view of the developer container 30 containing a developer, taken along a virtual plane including the rotation axial line L31.

FIG. 21 is a cross-sectional view of the developer container 30 containing a developer, taken a long a virtual plane including the rotation axial line L31. The support stand 49 of the supporting member 32 is installed on the horizontal plane, and in a state in which the developer is contained, a developer layer 63 made up of a developer and a gas layer 64 made up of a gas above the developer layer 63 are formed in the inner space of the developer container main body 31.

The developer container main body 31 is rotated counterclockwise around the rotation axial line L31 when viewed from the first container portion 33 to the second container portion 34. In this case, the developer of the developer layer 63 of the first container portion 33 is conveyed to a first convey direction Cl from the first container portion 33 to the coupling member 35 along the axial line L31 by the first protruding piece 36. The developer of the developer layer 63 of the second container portion 34 is conveyed to a second convey direction C2 from the second container portion 34 to the coupling member 35 along the axial line L31 by the second protruding piece 39. In this manner, in the coupling member 35, the developer flowing in the first convey direction C1 collides with the developer flowing in the second convey direction C2, so that the developer is agitated. The developer conveyed to the coupling member 35 of the developer container main body 31 is supplied to the inner circumferential portion 48 of the supporting member 32 via the coupling member 35.

When the developer is conveyed, a force directed from the inner circumferential portion of the first and the second container portions 33 and 34 including the first and the second protruding pieces 36 and 39 to the coupling member 35 is applied to the developer. When the amount of the developer contained in the developer container main body 31 is large, the developer disposed within the amount A2 and A5 of projection inward in the radial direction from the inner circumferential portion the first and the second container portions 33 and 34 to the first and the second protruding pieces 36 and 39 is agitated principally by the developer container main body 31 being rotated, so that the developer in the developer container main body 31 is well distributed.

Figure 22:
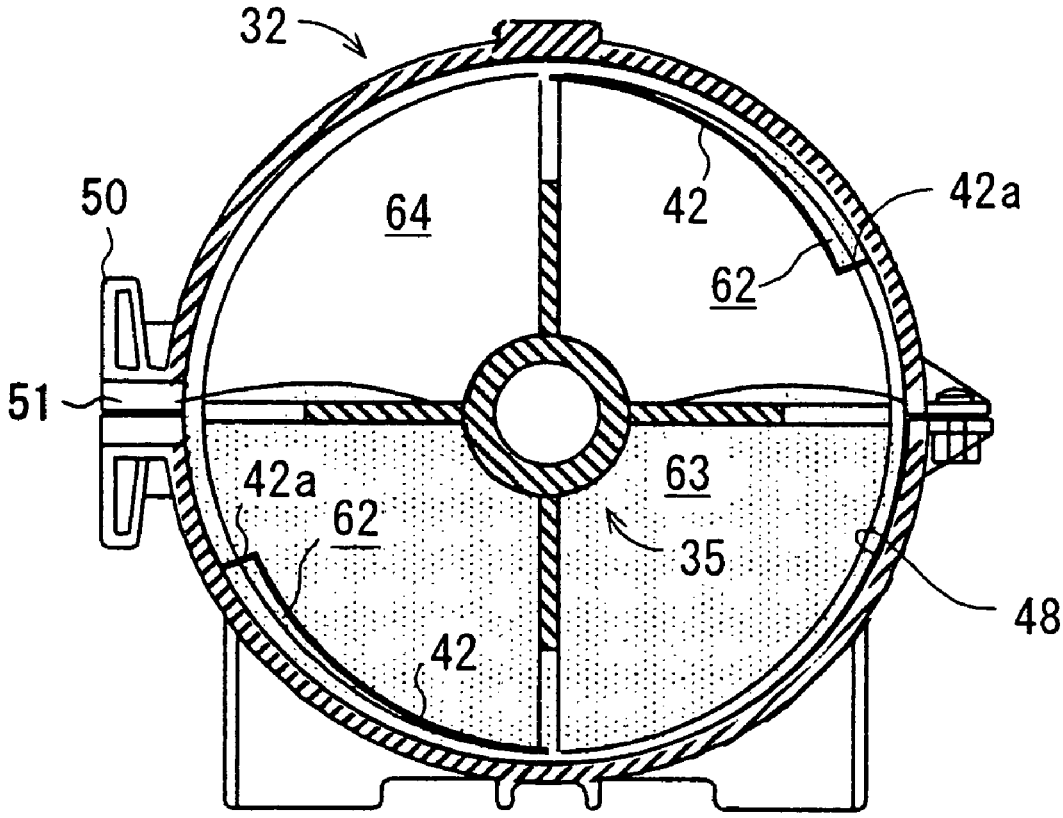
FIG. 22 is a cross-sectional view of the developer container 30 containing a developer, taken along a plane perpendicular to a virtual plane including the rotation axial line L31.

FIG. 22 is a cross-sectional view of the developer container 30 containing a developer, taken along a plane perpendicular to a virtual plane including the rotation axial line L31. The developer that collides with each other in the coupling member 35 by the developer container main body 31 being rotated is agitated together with the gas of the gas layer 64 by the first to fourth agitating plate members 47*a* to 47*d* of the rib 45 of the coupling member 35. As described above, the portions of the first to fourth agitating plate members 47*a* to 47*d* of corresponding to the outer ends in the radial direction and the central portion in the axial line direction of the rib 45 are withdrawn inward in the radial direction from the remaining portions. Thus, a predetermined strength of the rib 45 can be maintained, and the contact area with the developer of the developer layer 63 that collides therewith from the circumferential direction by rotation can be reduced, so that the resistance from the developer of the developer layer 63 can be reduced.

The developer conveyed to the coupling member 35 is supplied to the inner circumferential portion 48 of the supporting member 32 via the coupling member 35, and flows in the space 62, which is formed with cooperation of the remaining portions of the scraping member 42 excluding the free end 42*a* of the scraping member 42 and the inner circumferential portion of the supporting member 32, and serves as a holding portion. The developer that has flown into the space 62 is scraped along the inner circumferential portion 48 of the supporting member 32 by the free end 42*a* of the scraping member 42 with the rotation of the developer container main body 31 while being held by the scraping member 42 and the inner circumferential portion 48 of the supporting member 32. The amount of the developer that is held in the space 62 is, for example, about 6 g. The developer in the space 62 is angularly displaced around the rotation axial line L31 in this state and conveyed to a position facing the through hole 51 of the supporting member 32 and is guided to the outside via the through hole 51 and thus is let out. Since the developer is let out in this manner, even if the amount of the developer in the developer container main body 31 is such an amount that the supper face 63*a* of the developer layer 63 is below the through hole 51, the developer can be let out from the through hole 51 by the scraping member 42. Thus, all the developer contained in the developer container 30 can be let out as much as possible.

As described above, according to the developer container 30 of this embodiment, the developer container main body 31 can rotate around the rotation axial line L31 while being supported stably by the supporting member 32. When a cylindrical container containing a developer as conventionally used is stored while provided such a manner that its axial line is perpendicular to the horizontal plane, the developer that is in a lower portion of the container may aggregate. In order to prevent such aggregation of the developer as much as possible, when the container is provided on the horizontal plane such that the axial line is parallel to the horizontal plane, the container rolls. In the developer container 30 of this embodiment, the support stand 49 of the supporting member 32 is provided on the horizontal plane, so that the container can be disposed stably such that the axial line L31 of the developer container main body 31 is parallel to the horizontal plane. Even if the developer contained in the developer container 30 partially aggregates, the developer can be easily agitated and formed onto a powder form, for example, by a user rotating the developer container main body 31 in a state where the through hole 51 is closed.

Furthermore, the surfaces 33*c* and 34*c* in which the outer circumferential surfaces in the opposite ends 33*a* and 34*a* in the axial line direction of the developer container main body 31 are communicated with the end faces are formed into curved surfaces that incline inward in the radial direction as described above. Therefore, when it is attempted to provide the developer container 30 upright on the horizontal plane with either one of the opposite portions 33*a* and 34*a* in the radial direction of the developer container main body 31 being provided on the horizontal plane and the axial line L31 being perpendicular to the horizontal plane, the developer container easily tumbles. This prevents a user from leaving the developer container 30 upright with the axial line L31 being perpendicular to the horizontal plane, so that factors that cause the contained developer to aggregate can be reduced.

Furthermore, according to the developer container 30 of this embodiment, the supporting member 32 supports the portion including at least coupling member 35 of the developer container main body 31 throughout the full circumference from the outer side in the radial direction. Furthermore, the seal materials 60 and 61 are provided between the developer container main body 31 and the supporting member 32. Therefore, even if the developer container main body 31 is rotated, the developer is prevented from leaking out from between the developer container main body 31 and the supporting member 32.

Figure 23:
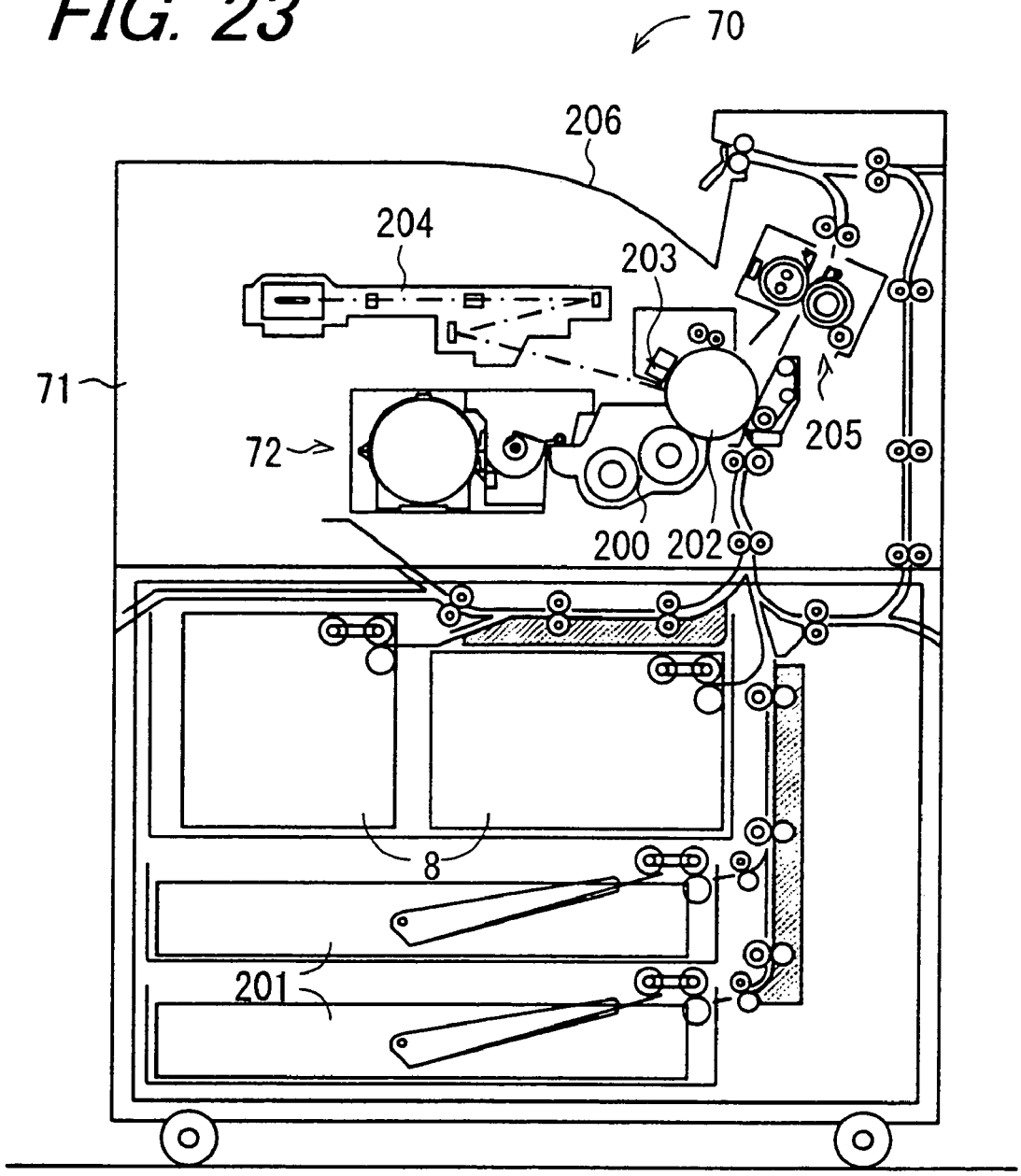
FIG. 23 is a cross-sectional view showing an image forming apparatus of a second example embodiment.
Figure 24:
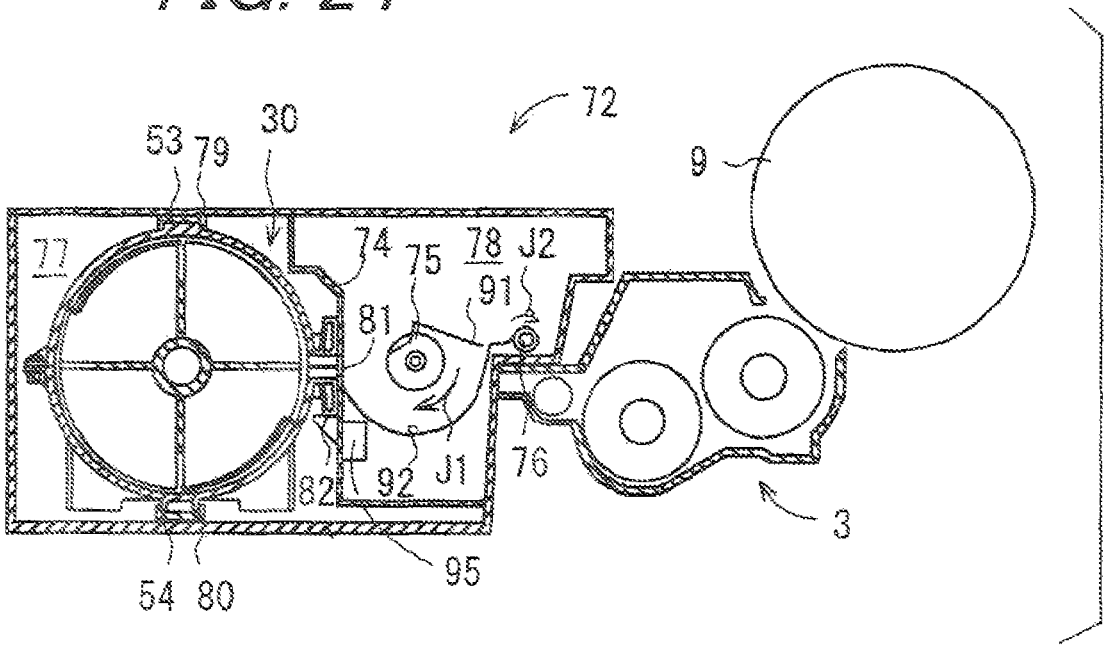
FIG. 24 is a cross-sectional view showing an enlarged portion in the vicinity of a toner hopper 72.
Figure 25:
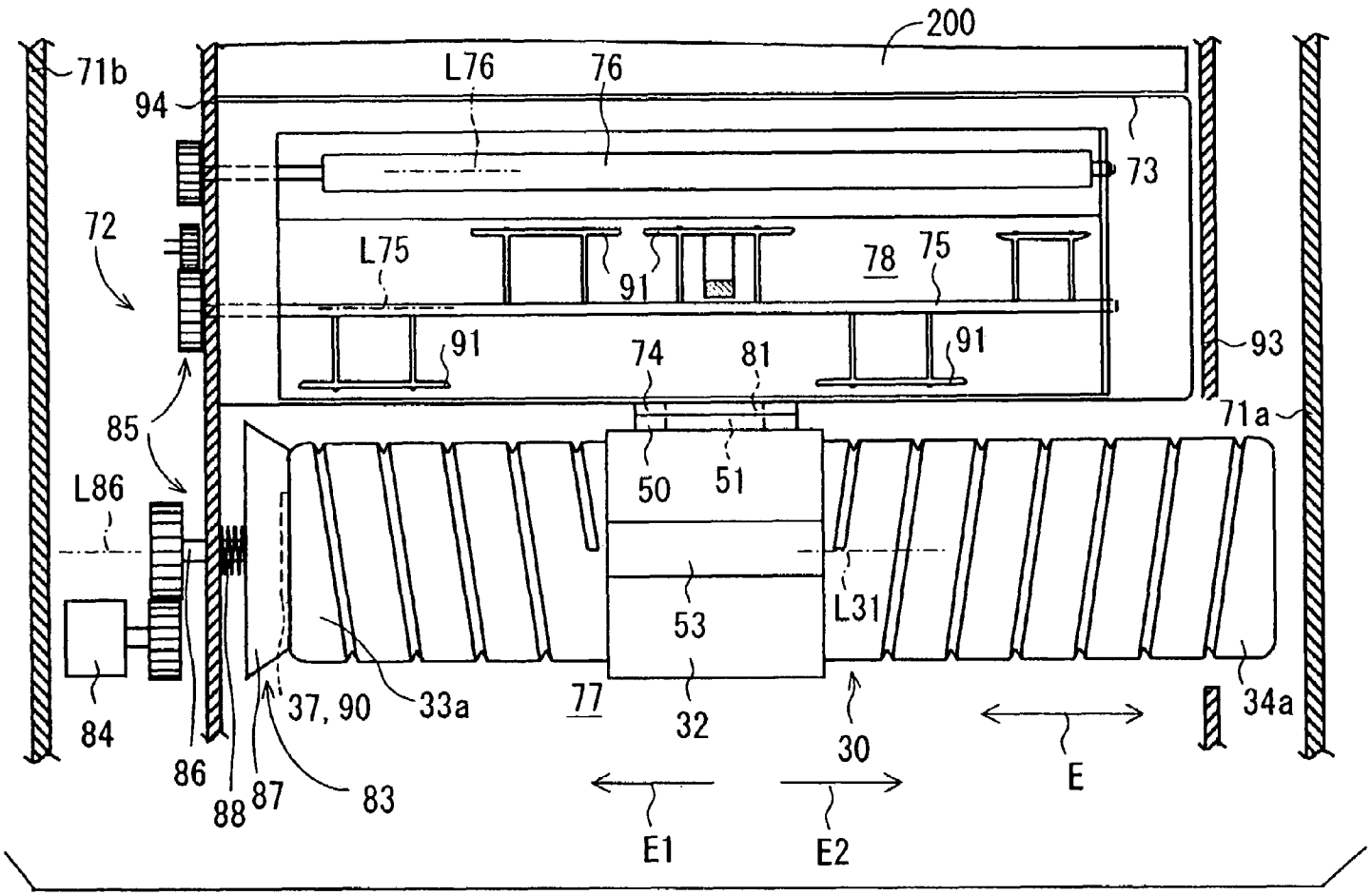
FIG. 25 is a plan view showing an enlarged portion in the vicinity of the toner hopper 72.

FIG. 23 is a cross-sectional view showing an image forming apparatus 70 of a second embodiment of the invention. FIG. 24 is a cross-sectional view showing an enlarged portion in the vicinity of a toner hopper 72. FIG. 25 is a plan view showing an enlarged portion in the vicinity of the toner hopper 72. FIG. 23 is a cross-sectional view of the image forming apparatus 70 viewed from the side of a front jacket portion 71*a*, and for easy understanding, the thickness is not shown. The front jacket portion 71*a* is, in general, a portion that a user faces when the user utilizes the image forming apparatus 70. A back jacket portion 71*b* is a portion that corresponds to the back side with respect to the front jacket portion 71*a* when viewed from the user on the front jacket portion 71*a* side in the image forming apparatus 70. It is assumed that the image forming apparatus 70 is installed on the horizontal plane and the front-back direction E, which is a direction from the front jacket portion 71*a* to the back jacket portion 71*b*, is parallel to the horizontal plane.

The electrophotographic image forming apparatus 70 such as a printer and a copier includes the developer container 30 and the main body of the image forming apparatus (hereinafter, referred to as "apparatus main body") 71. The developer container 30 is attached removably to the toner hopper 72 provided in the apparatus main body 71 via an openable container attach/remove port (not shown) that is provided in the front jacket portion 71*a* of the apparatus main body 71. The image forming apparatus main body 71 is provided with a housing front portion 93 on the back jacket portion 71*b* side from the front jacket portion 71*a*, and an opening that penetrates the apparatus main body in the thickness direction through which the developer container 30 is to be inserted is formed. Furthermore, the image forming apparatus main body 71 is provided with a housing back portion 94 on the front jacket portion 71*a* side from the back jacket portion 71*b*. Various structures of the image forming apparatus main body 71 are held by the housing (not entirely shown) including the housing front portion 93 and the housing back portion 94.

The toner hopper 72 includes a housing 73, a developer supply portion 74, an agitating member 75 and a supply roller 76. The inner space in the housing 73 is divided at least into a container housing space 77 and an agitating space 78 by the developer supply portion 74. The container housing space 77 is open facing the front jacket portion 71*a* of the apparatus main body 71. The agitating space 78 is a substantially closed space. The developer container 30 is disposed in the container housing space 77.

A first guide recess 79 that is recessed upward and extends in the front-back direction E of the apparatus main body 71 is formed on an upper wall portion 73*a* of the housing 73 facing the container housing space 77. The first guide recess 79 can be engaged with the first guide piece 53 of the supporting member 32 of the developer container 30 slidably in the longitudinal direction, that is, an attaching direction E1, which is parallel to the front-back direction E of the apparatus main body 71 and a direction from the front jacket portion 71*a* to the back jacket portion 71*b*, and a removing direction E2, which is opposite to the attaching direction E1. Furthermore, a second guide recess 80 that is recessed downward and extends in the front-back direction E of the apparatus main body 71 is formed on a lower wall portion 73*b*, which is opposed to the upper wall portion 73*a*, of the housing 73 facing the container housing space 77. The second guide recess 80 can be engaged with the second guide piece 54 of the supporting member 32 of the developer container 30 slidably in the longitudinal direction, that is, the attaching direction E1 and the removing direction E2 of the apparatus main body 71.

The developer supply portion 74 is a plate-like member that divides the inner space of the housing 73 into the container housing space 77 and the agitating space 78, and is provided with a communication hole 81 that penetrates the developer supply portion in its thickness direction and communicates between the container housing space 77 and the agitating space 78. A guide member 82 projecting to the container housing space 77 is provided below the communication hole 81 of the developer supply portion 74.

Figure 26:
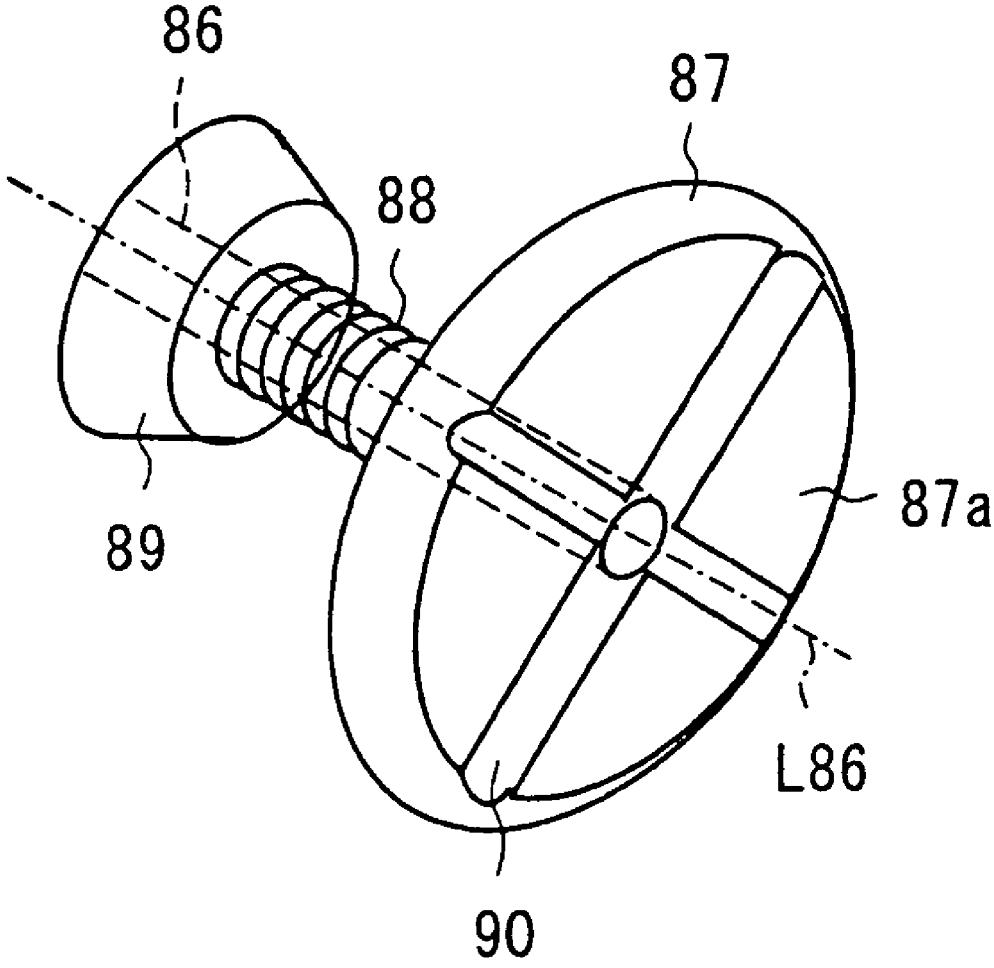
FIG. 26 is a perspective view showing an enlarged portion of the main body side coupling portion 83.

FIG. 26 is a perspective view showing an enlarged portion of the main body side coupling portion 83. The driving force for rotating the developer container main body 31 of the developer container 30 from a driving source 84 such as a motor of the apparatus main body 71 is transmitted to the main body side coupling portion 83 via a speed reducer 85 such as a gear. The main body side coupling portion 83 includes a rotation shaft 86, a coupler receiving portion 87 and a spring member 88. The rotation shaft 86 is inserted rotatably in a shaft receiving portion 89 that is provided penetrating, in the thickness direction, the housing back portion 94, which is the back wall portion of the housing 73 on the back jacket portion 71*b* side of the apparatus main body 71, with its axial line L86 being parallel to the front-back direction E of the apparatus main body 71, and its free end is disposed in the container housing space 77.

The coupler receiving portion 87 is formed into an approximate disk shape, faces the container housing space 77, and is coupled to the free end of the rotation shaft 86 rotatably around the axial line L86 along with the rotation shaft 86. In the coupler receiving portion 87, an engaging recess 90 expending in an approximate cruciform shape whose intersection is positioned on the axial line L86 is formed in a surface portion 87*a* opposite to the surface portion facing the housing back portion 94. The engaging recess 90 can be engaged with the engaging projecting portion 37 of the developer container main body 31. The coupler receiving portion 87 is displaceable in the axial line direction of the rotation shaft 86 without falling off from the free end of the rotation shaft 86. The spring member 88 that is realized by a compression coil spring or the like is disposed between the housing back portion 94 and the coupler receiving portion 87, and biases the coupler receiving portion 87 to a direction that allows the coupler receiving portion 87 to be away from the housing back portion 94 without preventing the rotation of the rotation shaft 86 and the coupler receiving portion 87. A coupling structure is formed by one end 33*a* in the axial line direction including the engaging projecting portion 37 of the developer container main body 31 of the developer container 30 and the coupler receiving portion 87 of the main body side coupling portion 83.

When attaching the developer container 30 to the apparatus main body 71, the developer container 30 is inserted in the container housing space 77 of the toner hopper 72 from the front jacket portion 71*a* of the apparatus main body 71 with the rotation axial line L31 being parallel to the attaching direction E1. In this case, the first guide piece 53 of the supporting member 32 of the developer container 30 is engaged with the first guide recess 79 of the housing 73, and the second guide piece 54 of the supporting member 32 is engaged with the second guide recess 80 of the housing 73, so that a displacement of the supporting member 32 to directions except the attaching direction E1 and the removing direction E2 is prevented. In this state, the developer container 30 is displaced to the attaching direction E1 so as to be positioned at the attaching position, at which the through hole 51 of the outlet portion 50 of the supporting member 32 is in communication with the communication hole 81 of the developer supply portion 74. In this case, the coupler receiving portion 87 of the main body side coupling portion 83 is pressed by the engaging projecting portion 37 of the developer container main body 31 to the attaching direction El and withdrawn, and thus the spring member 88 is compressed.

A regulating member (not shown) for regulating the displacement of the supporting member 32 to the attachment direction E1 and the removing direction E2 and canceling the regulation in a state where the developer container 30 is disposed in the attachment position is provided in the toner hopper 72. A shutter (not shown) for blocking the through hole 51 of the outlet portion 50 when the developer container 30 is removed from the apparatus main body 71 and for canceling the blocking of the through hole 51 of the outlet portion 50 when the developer container 30 is attached to the attached position in the apparatus main body 71 of the developer container 30 so that the through hole 51 is in communication with the communication hole of the developer supply portion 74 of the toner hopper 72 is provided in the outlet portion 50 of the supporting member 32 of the developer container 30. When all the developer contained in the developer container 30 is let out, the user cancels the regulation of the supporting member 32 by the regulating member so that the developer container 30 is displaced to the removing direction E2, and thus the developer container 30 is removed from the apparatus main body 71.

By mounting the outlet portion 50 of the supporting member 32 on the guide member 82 of the toner hopper 72, the through hole 51 of the outlet portion 50 of the supporting member 32 can be aligned to the communication hole 81 of the developer supply portion 74 of the toner hopper 72 in the vertical direction. A sealing material (not shown) for preventing the developer flowing from the through hole 51 to the communication hole 81 from leaking to portions except the agitating space 78 is provided at least either at the periphery of the through hole 51 of the outlet portion 50 of the supporting member 32 of the developer container 30 or the periphery of the communication hole 81 facing the container housing space 77 of the developer supply portion 74 of the toner hopper 72.

As shown in FIG. 25, in the apparatus main body 71, a developing portion 200 is disposed in the central portion in the front-back direction E. This is because that the photoreceptor drum 202 of the apparatus main body 71 is disposed in the central portion in the front-back direction E in the apparatus main body 71. The main body side coupling portion 83 and the driving portion such as the driving source 84 and the speed reducer 85 for rotating the agitating member 75 and the supply roller 76 are disposed between the housing back portion 94 and the back jacket portion 71*b* in the apparatus main body 71. Therefore, when the developer container 30 is disposed in the attachment position, the supporting member 32 of the developer container 30 is disposed in the central portion in the front-back direction E in the apparatus main body 71. In the developer container 30, the length from the supporting member 32 of the developer container main body 31 to the end face of the one end 33*a* in the axial line direction in which the engaging protecting portion 37 is formed is smaller than the length from the supporting member 32 to the end face of the other end 34*a* in the axial line direction, as described above.

Figure 60A:
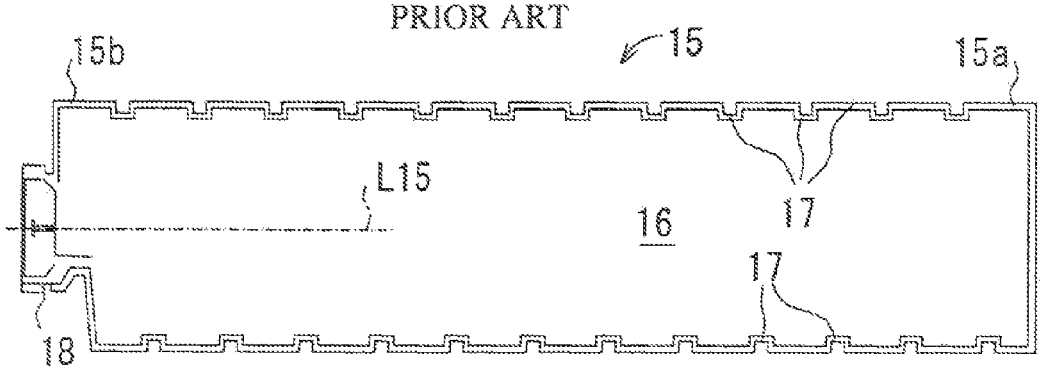
FIG. 60A PRIOR ART
FIG. 60A is a cross-sectional view showing a toner bottle 15, which is a second conventional technique.
Figure 60B:
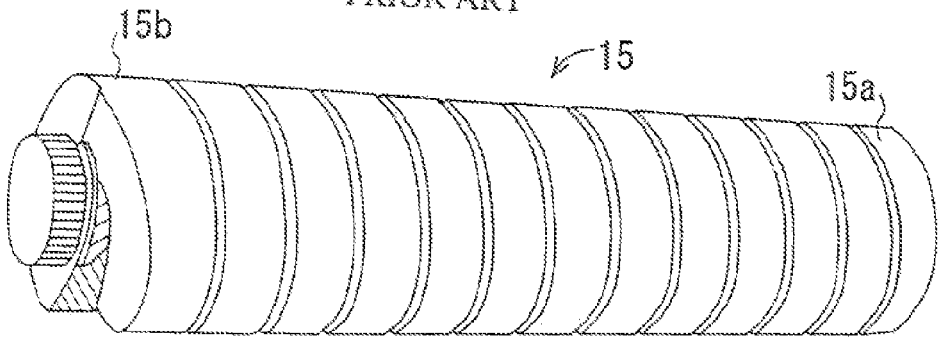
FIG. 60B PRIOR ART
FIG. 60B is a perspective view showing the toner bottle 15.
Figure 61:
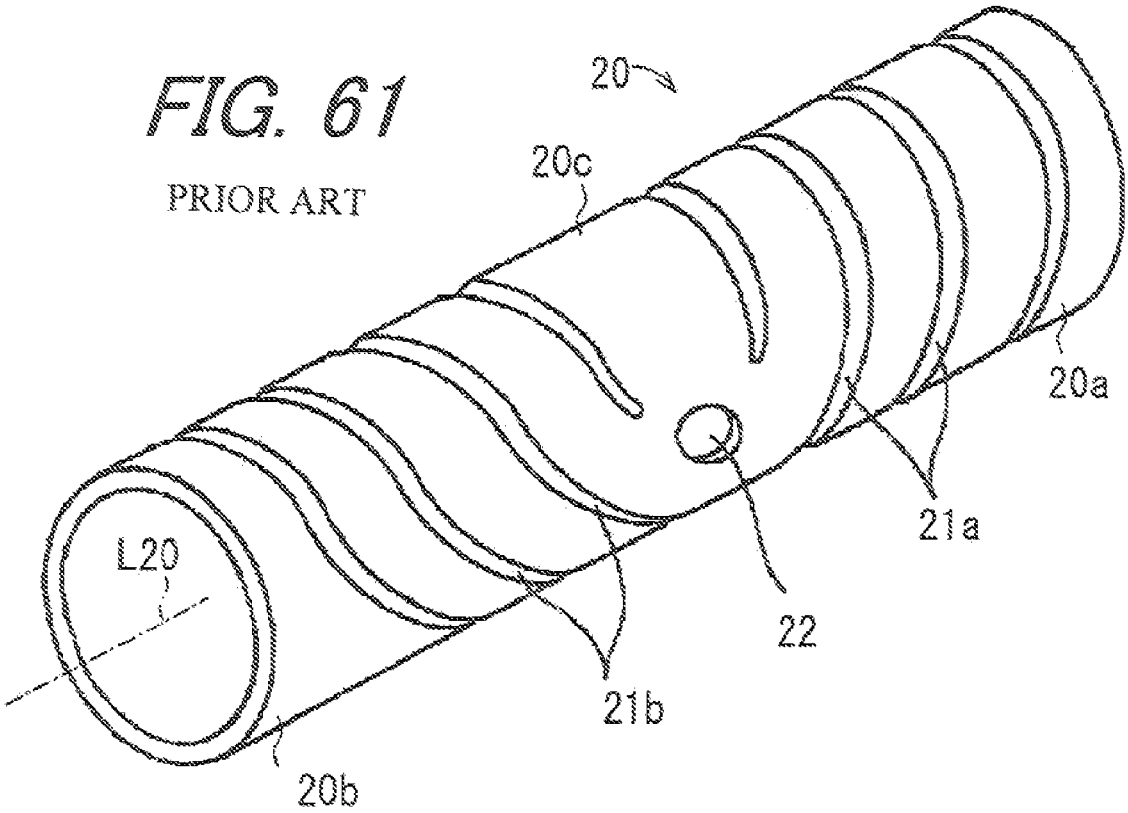
FIG. 61 PRIOR ART
FIG. 61 is a perspective view showing a developer supply container 20, which is a third conventional technique.
Figure 62:
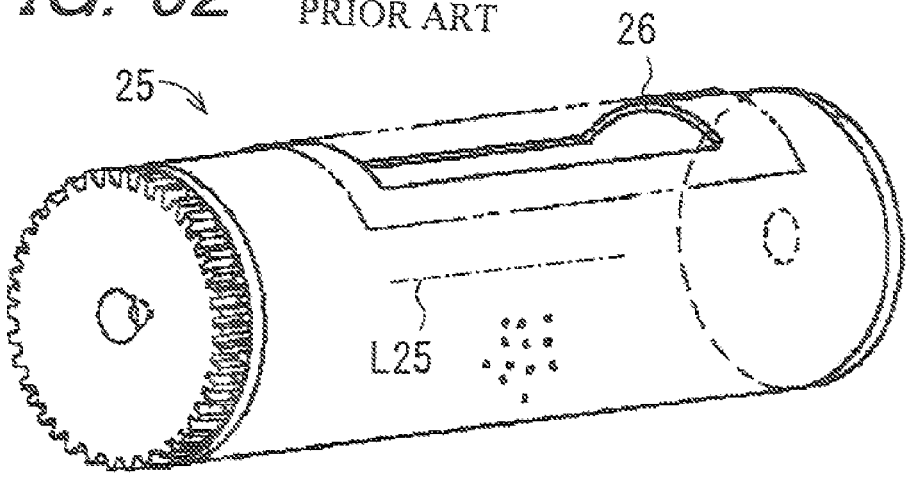
FIG. 62 PRIOR ART
FIG. 62 is perspective view showing the toner cartridge 25, which is a fourth conventional technique.

For example, in the case of the toner bottle 15, as the first conventional technique shown in FIGS. 60A and 60B, that has, in one end 15*a* in the axial line direction, the opening 18 through which the developer is let out and that is coupled to the driving source, the opening 18 is provided near the developer supply portion, that is, in a central portion in the front-back direction in the image forming apparatus main body. In this case, the size of the conventional toner bottle 15 in the axial line direction is set based on the size from the central portion in the front-back direction to the front portion of the image forming apparatus main body, so that it is difficult to increase the capacity of the container.

In the developer container 30 in the image forming apparatus 70 of this embodiment, the supporting member 32 is disposed substantially in the central portion in the axial line direction of the developer container main body 31. Therefore, when the developer container is attached to the attachment position in the image forming apparatus main body 71, the supporting member 32 is disposed in the central portion in the front-back direction E of the apparatus main body 71. Thus, the developer container main body 31 can be extended from the central portion in the front-back direction E to the front portion of the apparatus main body 71 and extended from the central portion in the front-back direction E to the back portion, and thus the capacity can be increased significantly compared with the conventional toner bottle 15. In this embodiment, as shown in FIG. 25, the other end 34*a* in the axial line direction of the developer container 30 is projected to the front jacket portion 71*a* from the housing front portion 93.

When the length from the supporting member 32 of the developer container main body 31 to the end face of the one end 33*a* in the axial line direction is smaller than the length from the supporting member 32 to the end face of the other end 34*a* in the axial line direction, a region in which the driving portion including the driving source 8.4 and the speed reducer 85 that is coupled to the engaging projecting portion 37 of the one end 33*a* in the axial line direction of the developer container main body 31 are provided can be ensured in the back portion of the apparatus main body 71. Thus, the developer container 30 has two incomparable effects of utilizing the space in the apparatus main body 71 efficiently and increasing the containing amount of the developer as much as possible.

Thus, when the developer container 30 is disposed in the attachment position and coupler receiving portion 87 is rotated by driving the driving source 84, in the state where the engaging recess 90 of the coupler receiving portion 87 is engaged with the engaging projecting portion 37 of the developer container 30, the developer container main body 31 is rotated around the rotation axial line L31. In the state where the engaging recess 90 of the coupler receiving portion 87 is not engaged with the engaging projecting portion 37 of the developer container 30, only the coupler receiving portion 87 is angularly displaced for a while until the engaging recess 90 of the coupler receiving portion 87 is engaged with the engaging projecting portion 37 of the developer container 30. When the engaging recess 90 of the coupler receiving portion 87 is engaged with the engaging projecting portion 37 of the developer container 30, the spring force is applied by the spring member 88 so that the engaging recess 90 of the coupler receiving portion 87 and the engaging projecting portion 37 of the developer container 30 are engaged with each other tightly. Thus, the developer container main body 31 is rotated around the rotation axial line L31. When the developer container main body 31 of the developer container 30 is rotated around the rotation axial line L31 in this manner, the developer contained in the developer container 30 is supplied to and contained in the agitating space 78 via the through hole 51 of the outlet portion 50 of the supporting member 32 and the communication hole 81 of the developer supply portion 74 of the toner hopper 72.

The agitating member 75 and the supply roller 76 are spaced away from each other and extend in the front-back direction E of the apparatus main body 71, and are disposed in the agitating space 78. The agitating member 75 is rotatable around the agitation axial line L75 that is parallel to the front-back direction E, and has a flexible scraping-out member 91 extending in the agitation axial line L75. The agitating member 75 is rotated in the clockwise direction J1 around the agitation axial line L75 when viewed from the front of the apparatus main body 71 by the driving force from the driving source 84 provided in the apparatus main body 71. The supply roller 76 is rotatable around the supply axial line L76 that is parallel to the front-back direction E, and its outer circumferential surface is made of, for example, a porous resin, such as a sponge. The supply roller 76 is rotated in the clockwise direction J2 around the agitation axial line L76 when viewed from the front of the apparatus main body 71 by the driving force from the driving source 84 provided in the apparatus main body 71.

An agitation wall portion 92 is provided that faces the agitating space 78 of the toner hopper 72, is in communication with the developer supply portion 74, extends in the front-back direction E of the apparatus main body 71, whose cross section taken along a plane perpendicular to the agitation axial line L75 of the agitating member 75 is approximately U-shaped, and that is formed into a partial cylindrical inner circumferential shape that is open upward. The developer is supplied from a single communication hole 81 to the agitating space 78. However, as described above, the developer let out from the developer container 30 is not only agitated, but also mixed with a gas and becomes fine powder, and therefore has good flowability. Therefore, even if the developer is supplied only from the communication hole 81, the developer can be diffused in the agitation axial line L75 in the agitating space 78. The developer contained in the agitating space 78 is diffused further in the agitation axial line L75 direction in the agitating space 78 by the agitation of the agitating member 75.

When the agitating member 75 is rotated, the developer that is supplied from communication hole 81 and contained in the agitating space 78 is agitated, and the scraping-out member 91 scrapes the developer contained in the agitating space 78 while its free end is in contact with the agitation wall portion 92, and supplies the developer to the supply roller 76. Therefore, a fine powdery developer cane supplied to the supply roller 76 substantially uniformly in its axial line L76. Even if the remaining amount of the developer contained in the agitating space 78 becomes small, the scraping-out member 91 scrapes the developer and supplies the developer to the supply roller 76. Therefore, the developer that remains in the agitating space 78 without being supplied to the supply roller 76 can be reduced as much as possible. The developer supplied to the supply roller 76 is supplied to the developing portion 200 in a good condition by the rotation of the supply roller 76.

The apparatus main body 71 further includes a developing portion 200, a recording paper cassette 201, a photoreceptor drum 202, a charging portion 203, a laser irradiating portion 204 and a fixing portion 205. The developing portion 200 produces a two-component developer by agitating a toner, which is the developer supplied from the toner hopper 72 and a previously prepared carrier, which is constituted by magnetic particles.

The recording paper cassette 201 holds recording paper on which an image is to be formed. The photoreceptor drum 202 is a cylindrical drum whose outer circumferential portion is provided with a photoreceptor and is rotated around its axial line by the driving force of the driving portion. The charging portion 203 charges the photoreceptor of the photoreceptor drum 202 to let the photoreceptor photosensitive. The laser irradiation portion 204 exposes the photoreceptor of the charged photoreceptor drum 202 to laser light to form an electrostatic latent image on the photoreceptor.

The developing portion 200 agitates the two-component developer and supplies the two-component developer to the photoreceptor of the photoreceptor drum 202 on which the electrostatic latent image is formed to develop the image so that a toner image corresponding to the electrostatic latent image can be formed. The photoreceptor drum 202 transfers the toner image on the photoreceptor drum 202 onto recording paper that is fed from the recording paper cassette 201. The fixing portion 205 fixes the toner image that is transferred to the recording paper onto the recording paper. The recording paper on which the image is formed by fixing the toner image is let out to a paper-out tray 206. In order to keep the toner concentration of the two-component developer in the developing portion 200, the supply roller 76 has the outer circumferential portion formed of a sponge, and its rotation is controlled. Thus, the supply roller 76 supplies an appropriate amount of toner in the form of fine powder to the developing portion 200.

Hereinafter, the control of the developer container main body 31 of the developer container 30 and the agitating member 75 and the supply roller 76 of the toner hopper 72 will be briefly described. When a portion 95 for detecting a toner remaining amount that is provided in the agitating wall portion 92 has detected that the developer (hereinafter, also referred to as "toner") contained in the agitating space 78 of the toner hopper 72 is running short, a controller (not shown) controls the driving source 84 so as to rotate the developer container main body 31 of the developer container 30 so that a toner is supplied to the agitating space 78. When it is detected by the toner-remaining amount detecting portion 95 that the toner contained in the agitating space 78 is not yet full after the developer container main body 31 has been rotated for a predetermined period, the controller stops the rotation of the developer container main body 31 and displays a message meaning that the developer container 30 should be replaced on a display portion (not shown) to notify the user. At this point, a considerable amount of developer is contained in the agitating space 78 of the toner hopper 72. The user removes the developer container 30 that is empty from the apparatus main body 71 while the developer is still contained in the agitating space 78 of the toner hopper 72, and attaches a new developer container 30 containing a developer to the apparatus main body 71. Thus, even if the image forming apparatus 70 is in the process of forming an image on recording paper, the developer can be replenished to the apparatus main body 71 without interrupting the image forming work, because the developer in an amount necessary to form the image is contained in the agitating space 78 of the toner hopper 72.

Figure 59:
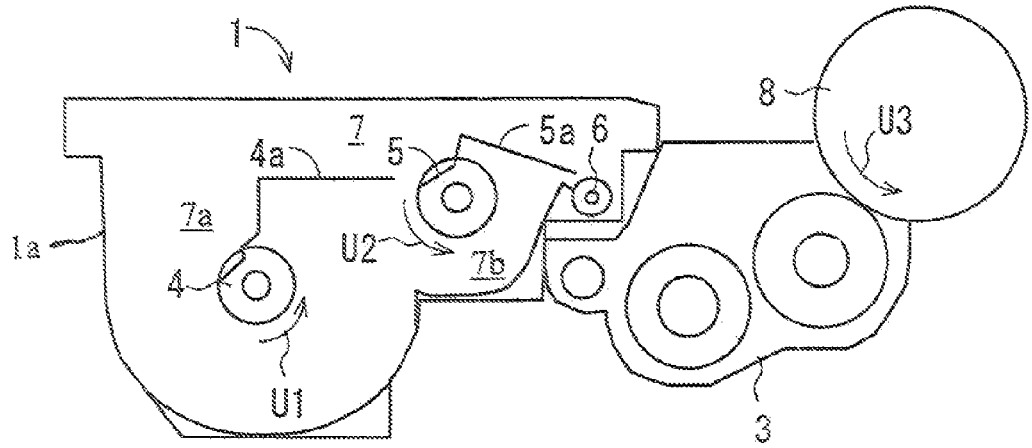
FIG. 59 PRIOR ART
FIG. 59 is a cross-sectional enlarged view showing the vicinity of the toner cartridge 2 and a developing portion 3 of the image forming apparatus 2.

In the first conventional technique shown in FIG. 59, it is necessary to replace the toner cartridge 1 that is not only very large but also heavy. However, in this embodiment, it is sufficient to replace only the developer container 30, and it is sufficient that the user inserts the developer container to the container housing space 77 of the toner hopper 72 from the housing front portion 93 of the apparatus main body 71 to the attaching direction E1, from the first container portion 33 provided with the engaging projecting portion 37 while holding, for example, the supporting member 32 and the second container portion 34 of the developer container 30. This is very simple. When removing the developer container 30 from the apparatus main body 71, it is sufficient that the user pulls out the developer container to the removing direction E2 while holding the second container portion 34 of the developer container 30, which is very simple.

In order to prevent the contained developer from aggregating by agitating the developer, conventionally, the user used to swing the heavy and large toner cartridge 1 vertically and horizontally. However, in the developer container 30 of this embodiment, it is sufficient that the user rotates the developer container main body 31 around the rotation axial line L31, which is easy. In the developer container 30 of this embodiment, the structure for agitating the contained developer is much simpler than that of the conventional toner cartridge 1. The developer container 30 achieves sealing between the developer container main body 31 and the supporting member 32, and when the developer container 30 is attached to the attachment position of the apparatus main body 71, sealing is achieved at least either at the periphery of the through hole 51 of the outlet portion 50 or the periphery of the communication hole 81 of the developer supply portion 74 that are in communication with each other, so that the developer can be prevented from leaking in the container housing space 77 of the toner hopper 72 as much as possible. Therefore, when the user replaces the developer container 30, the hands can be prevented from becoming dirty with the developer as much as possible.

Furthermore, since the developer container 30 is substantially cylindrical, the developer container can be housed in an elongated rectangular solid packing box, and can be transported and stored more easily than the first conventional toner cartridge 1.

Figure 27:
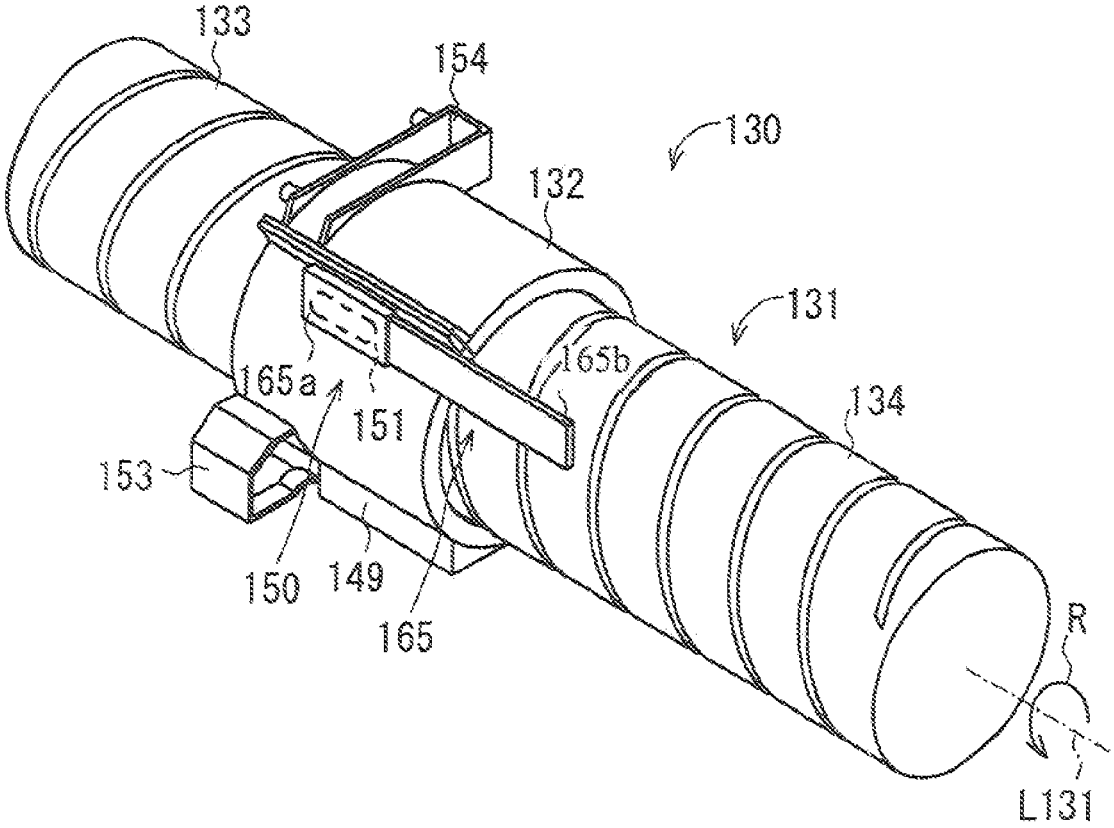
FIG. 27 is a perspective view showing a developer container of a third example embodiment.
Figure 28:
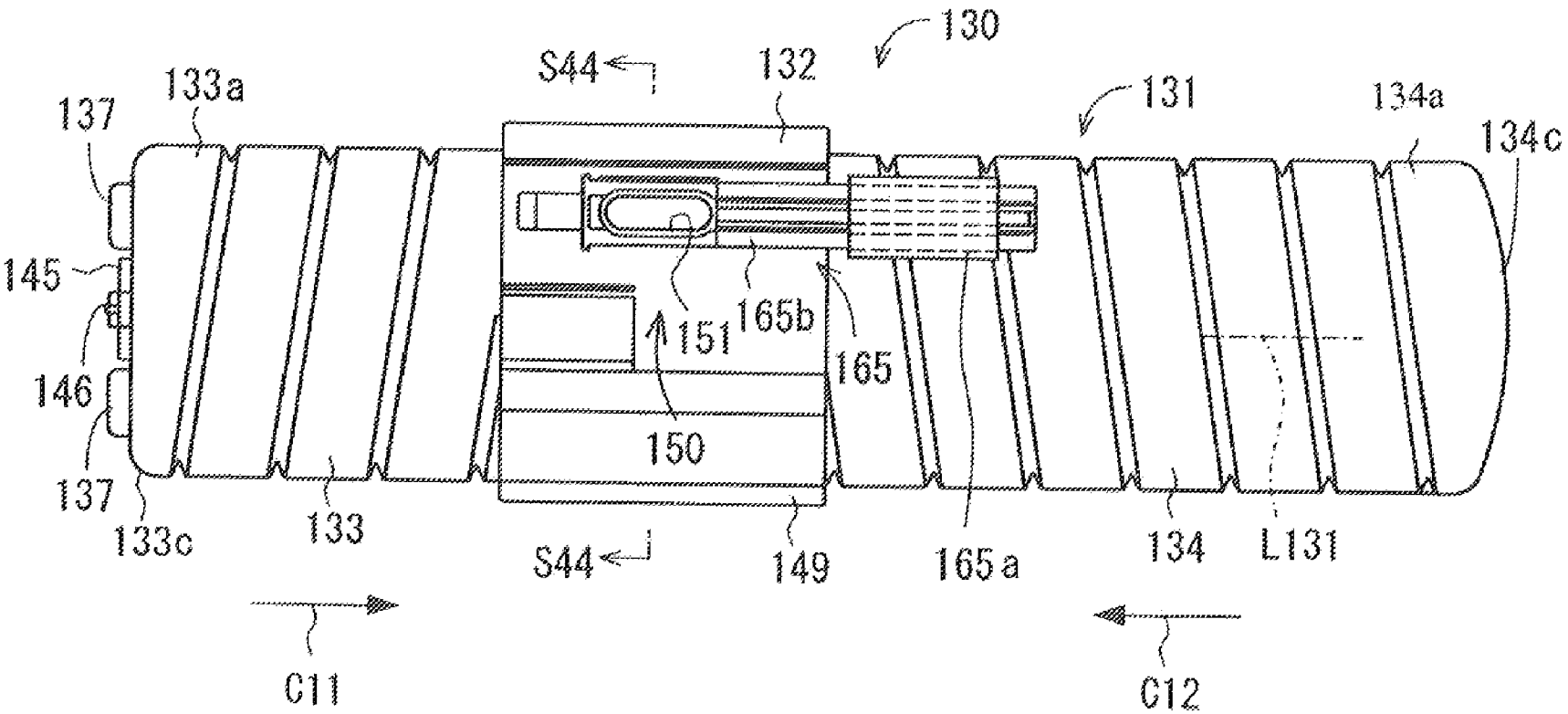
FIG. 28 is a front view showing the developer container 130.
Figure 29:
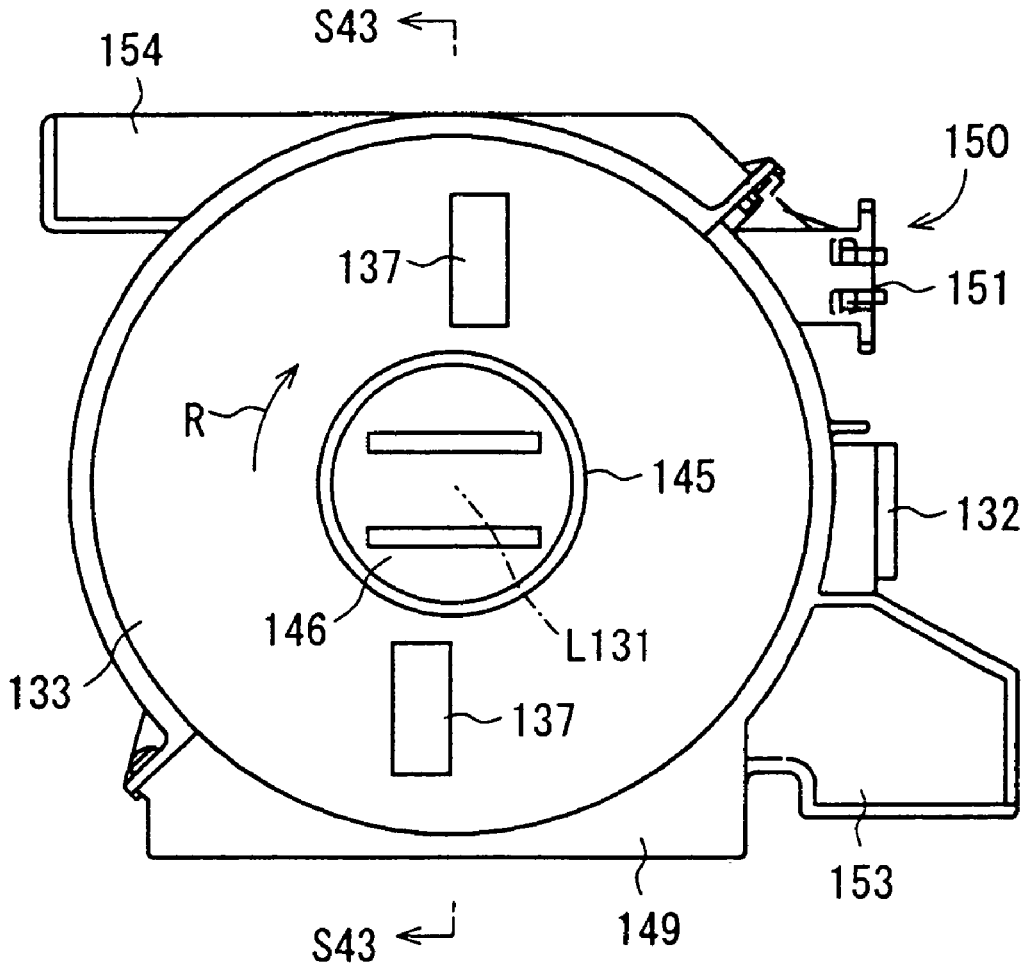
FIG. 29 is a left side view showing the developer container 130.

FIG. 27 is a perspective view showing a developer container 130 of a third embodiment of the technology disclosed herein. FIG. 28 is a front view showing the developer container 130. FIG. 29 is a left side view showing the developer container 130. The developer container 130 includes a developer container main body 131 and a supporting member 132. The developer container main body 131 is formed substantially into a cylindrical shape, and contains a developer such as a toner used for forming electrophotographic images. The supporting member 132 supports the developer container main body 131 rotatably around its axial line L131. The developer container 130 can contain, for example, 1400 g of a developer. Hereinafter, the axial line L131 of the developer container main body 131 may be referred to as "rotation axial line L131".

Figure 30:
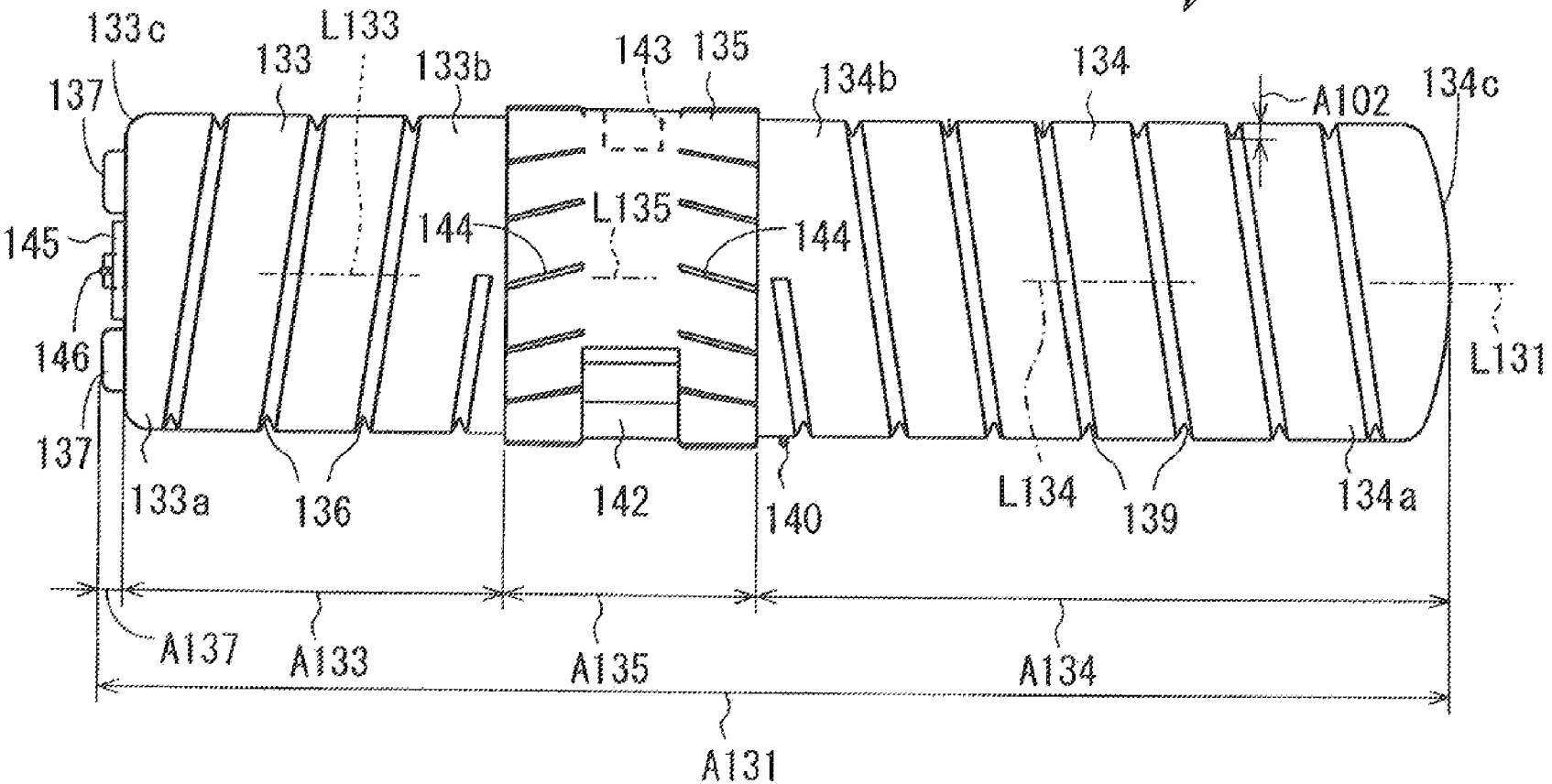
FIG. 30 is a front view showing the developer container main body 131.
Figure 31:
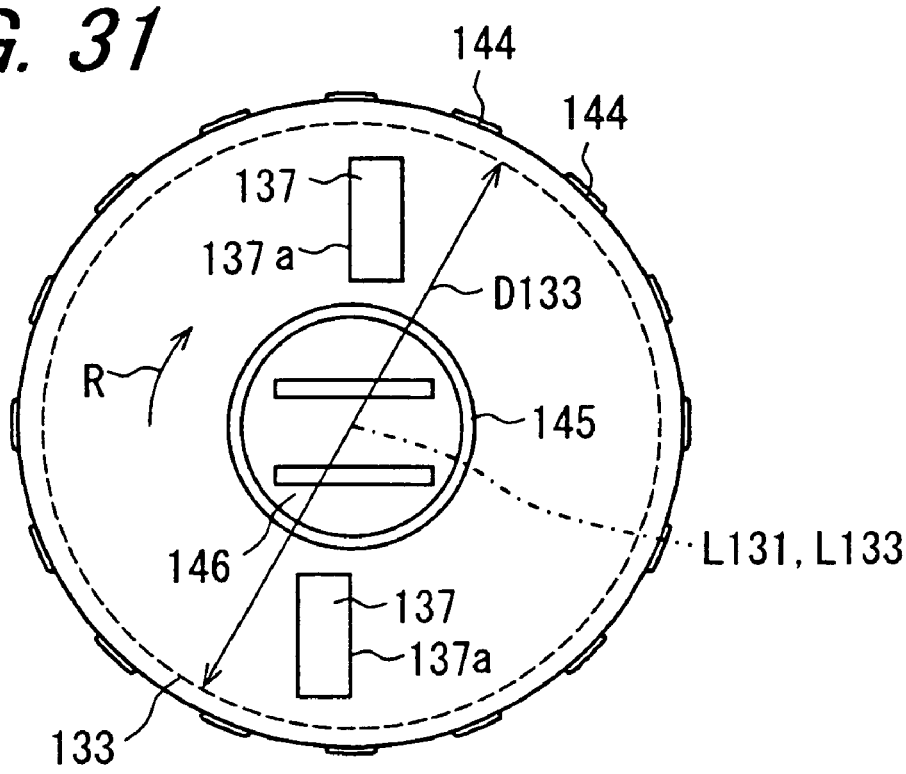
FIG. 31 is a left side view showing the developer container main body 131.
Figure 32:
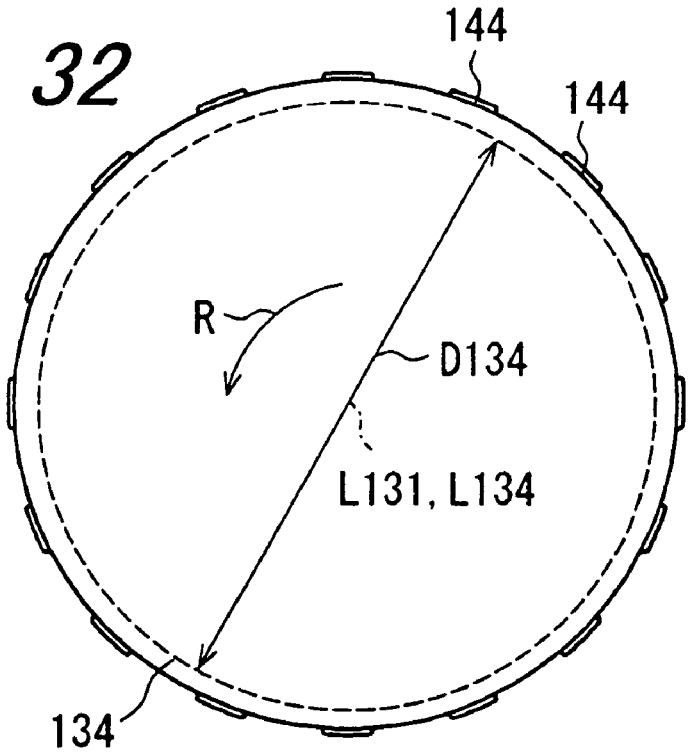
FIG. 32 is a right side view showing the developer container main body 131.

FIG. 30 is a front view showing the developer container main body 131. FIG. 31 is a left side view showing the developer container main body 131. FIG. 32 is a right side view showing the developer container main body 131. The developer container main body 131 includes a first container portion 133, a second container portion 134 and a third container portion 135. The length A131 in the axial line L131 direction of the developer container main body 131 may be, for example, 458 mm.

The first container portion 133 is formed into a cylindrical shape having a bottom. The length A133 in the axial line direction of the first container portion 133 may be, for example, 160 mm. As shown in FIG. 30, the first container portion 133 is provided with a first protruding piece 136 projecting inward in the radial direction and extending spirally from a bottom 133*a*, which is one end in the axial line direction, to an open end 133*b*, which is the other end in the axial line direction, in its inner circumferential portion. More specifically, the first protruding piece 136 is formed, extending spirally so as to rotate counter-clockwise around the axial line L133 of the first container portion 133, from the bottom 133*a* to the open end 133*b*, when viewed from the bottom 133*a* of the first container portion 133. As shown in FIGS. 30 and 31, an engaging projecting portion 137, which is a coupling portion projecting in the direction from the open end 133*b* to the bottom 133*a*, and a replenish port 145 are formed on the bottom 133*a* of the first container portion 133. A plurality of (two in this embodiment) engaging projecting portions 137 are formed. The replenish port 145 is formed in a central portion of the bottom 133*a* of the first container portion 133 so as to penetrate in the rotation axial line L131 direction so that a circular opening having as its axial line the axial line L133 of the first container portion 133. A replenish lid 146 that can be attached to and removed from the replenish port 145 and is formed corresponding to the shape of the replenish port is attached to the replenish port 145 while sealing is achieved between the replenish port 145 and the replenish lid 146 in such a manner that the replenish lid is not removed from the replenish port by the rotation of the developer container main body 131. When the replenish lid 146 is removed from the replenish port 145, the inner space of the developer container main body 131 is communicated with the outer space, and in this state, the developer can be replenished to the developer container main body 131.

Specifically, the engaging projecting portions 137 are disposed in symmetric positions with respect to the axial line L133 of the first container portion 133 in outer portions in the radial direction from the replenish port 145. More specifically, regarding the engaging projecting portions 137, a portion 137*a* on the upstream side in the rotation direction R, which is the clockwise direction around the rotation axial line L131, when viewed from the bottom 133*a* of the first container portion 133 is formed so as to have a flat surface extending perpendicularly to the circumferential direction, as shown in FIG. 31. A portion on the downstream side in the rotation direction R of the engaging projecting portions 137 is formed so as to incline to the other end in the radial direction as approaching to the downstream side in the rotation direction R. The amount A137 of the projection of the engaging projecting portion 137 from the remaining portion of the bottom 133*a* in the axial line direction L133 may be, for example, 8 mm. The engaging projecting portion 137 can be attached to and removed from the main body side coupling portion 183 (see FIG. 53) provided in an image forming apparatus 70A, 70B, which will be described later.

A surface 133*c* in which the outer circumferential surface and the end face in the bottom 133*a* of the first container portion 133 are in communication with each other is formed into a curved face that inclines inward in the radial direction from the open end 133*b* to the bottom 133*a*, as shown in FIG. 30.

The second container portion 134 is formed into a cylindrical shape having a bottom. The length A134 in the axial line direction of the second container portion 134 may be, for example, 210 mm. As shown in FIG. 30, the second container portion 134 is provided with a second protruding piece 139 projecting inward in the radial direction and extending spirally from a bottom 134*a*, which is the other end in the axial line direction, to an open end 134*b*, which is one end in the axial line direction, in its inner circumferential portion. More specifically, the second protruding piece 139 is formed, extending spirally so as to rotate clockwise around the axial line L134 of the second container portion 134, from the bottom 134*a* to the open end 134*b*, when viewed from the bottom 134*a* of the second container portion 134. The second projection piece 139 is formed so as to extend in the direction opposite to the first protruding piece 136. The pitch A11 of the first protruding piece 136 of the first container portion 133 and the second protruding piece 139 of the second container portion 134 may be, for example, 30 mm. The amount A102 of the projection inward in the radial direction from the remaining portion of the inner circumferential portion of the first protruding piece 136 and the second protruding piece 139 may be, for example, 6 mm.

A surface in which at least the outer circumferential surface and the end face in the bottom 134*a* of the second container portion 134 are in communication with each other is formed into a curved face that inclines inward in the radial direction from the open end 134*b* to the bottom 134*a*. More specifically, the end face 134*c* of the bottom 134*a* of the second container portion 134 is formed into a partial spherical face whose center projects in the direction from the open end 134*b* to the bottom 134*a*. A plurality of (two in this embodiment) guide protruding pieces 140 projecting outward in the radial direction are provided spaced away from each other in the circumferential direction in the outer circumferential portion at positions that are spaced away from the end face of the open end 134*b* of the second container portion 134 toward the bottom 134*a*. The size of the guide protruding piece 140 in the radial direction may be, for example, 2.5 mm.

The length A134 in the axial line direction of the second container portion 134 is larger than the length A133 in the axial line direction of the first container portion 133, and is set to be longer by, for example, 30 mm or more. As described above, the length A133 in the axial line direction of the first container portion 133 may be, for example, 150 mm, and the length A134 in the axial line direction of the second container portion 134 may be, for example, 215 mm. The inner diameter D133 of the inner circumferential portion excluding the first protruding piece 136 of the first container portion 133 and the inner diameter D134 of the inner circumferential portion excluding the second protruding piece 139 of the second container portion 133 may be, for example, 105 mm.

Figure 33:
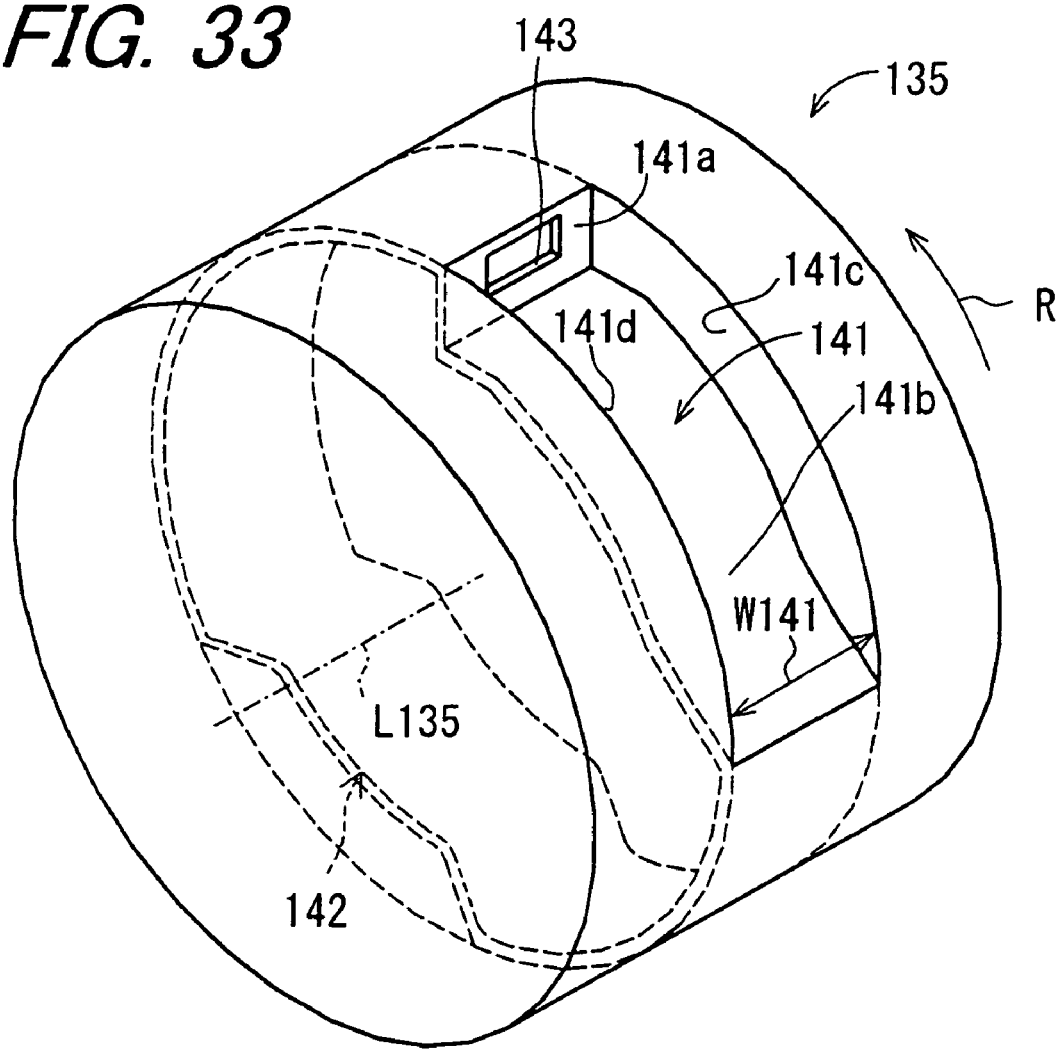
FIG. 33 is a perspective view showing the third container portion 135.
Figure 34:
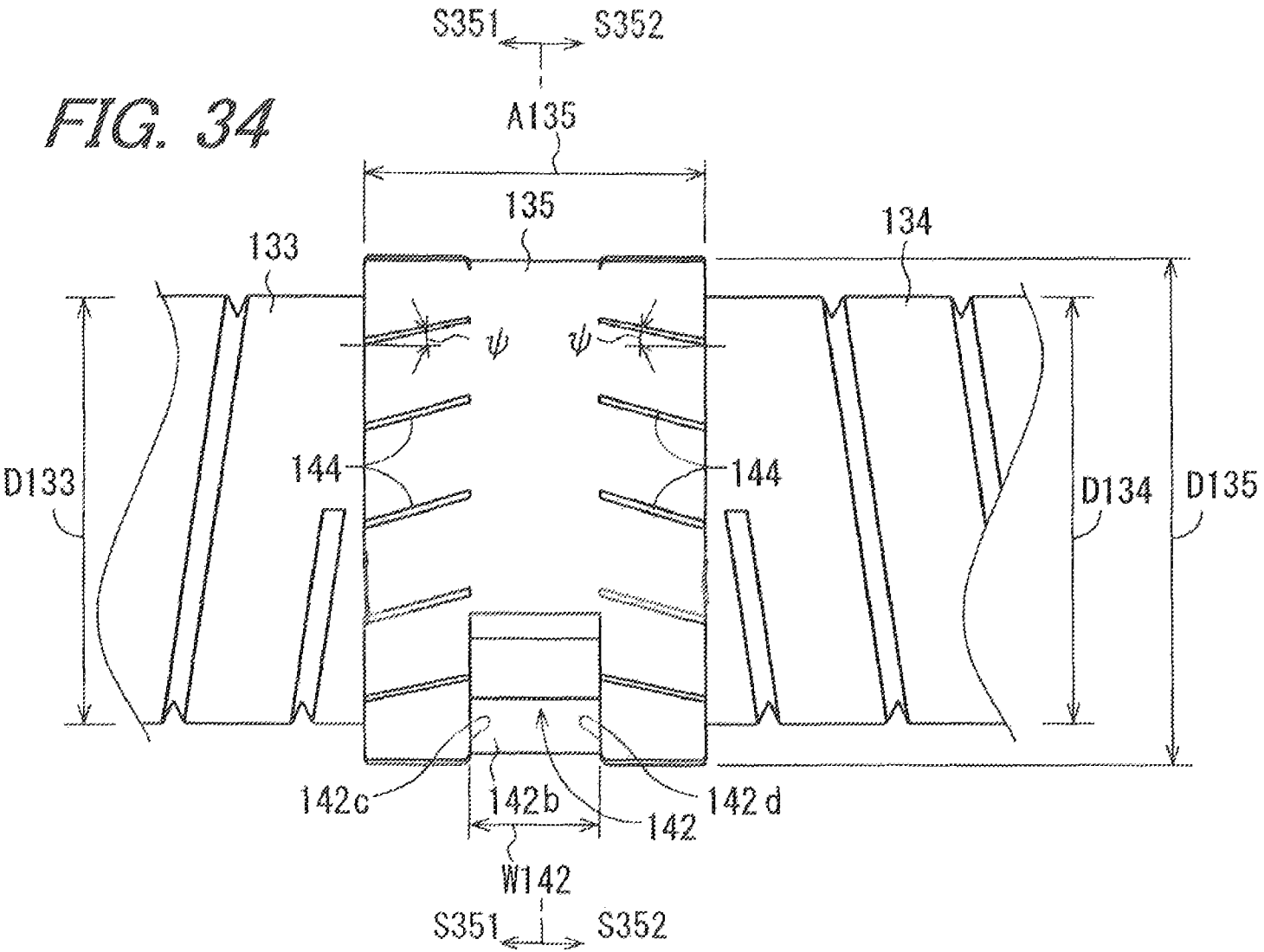
FIG. 34 is a front view showing an enlarged portion near the third container portion 135.
Figure 35A:
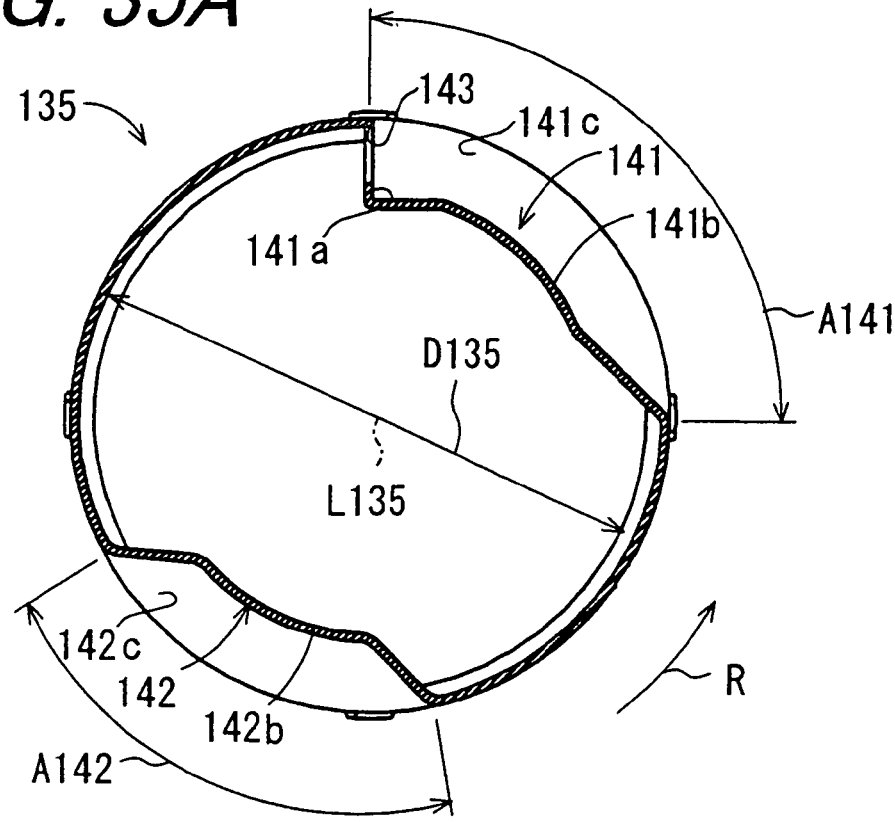
FIG. 35A is a cross-sectional view taken along S351-S351 of FIG. 34.
Figure 35B:
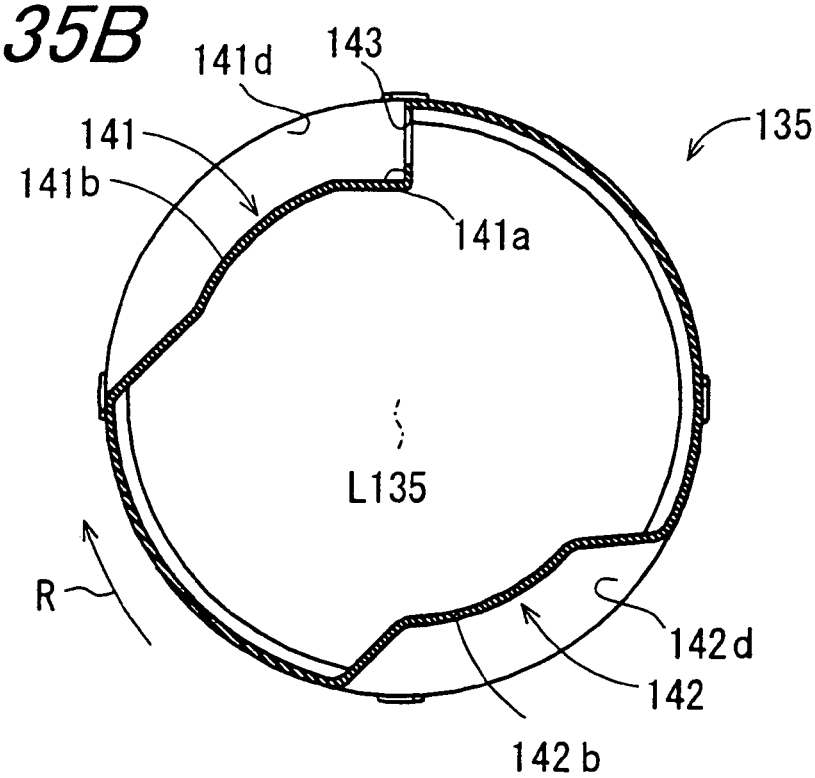
FIG. 35B is a cross-sectional view taken along line S352-S352 of FIG. 34.

FIG. 33 is a perspective view showing the third container portion 135. FIG. 34 is a front view showing an enlarged portion near the third container portion 135. FIG. 35A is a cross-sectional view taken along S351-S351 of FIG. 34. FIG. 35B is a cross-sectional view taken along line S352-S352 of FIG. 34. FIG. 30 is also referred to. The third container portion 135 is formed into a substantially cylindrical shape. More specifically, in the third container portion 135, a first recess portion 141 and a second recess portion 142 that are recessed inward in the radial direction are provided in an intermediate portion in the axial line direction of its outer circumferential portion, and in addition, an exhausting hole 143 for letting the developer out that is formed in the first recess portion 141 is provided. The length A135 in the axial line direction of the third container portion 135 may be, for example, 80 mm. The inner diameter D135 of the third container portion 135 excluding the first recess portion 141 and the second recess portion 142 is larger than the inner diameters D133 and D134 of the first container portion 133 and the second container portion 134, which are remaining portions. The inner diameter D135 of the third container portion 135 excluding the first recess portion 141 and the second recess portion 142 may be, for example, 110 mm.

The first recess portion 141 is formed, extending in the rotation direction R, in such a manner that the size W141 in the axial line direction is smaller than the size A141 in the rotation direction R, and has an end wall portion 141*a* that crosses the rotation direction R in its end on the downstream side in the rotation direction R. The exhausting hole 143 is formed in a portion of the end wall portion 141*a* on the downstream side in the rotation direction of the first recess portion 141. The second recess portion 142 is formed, extending in the rotation direction R, in such a manner that the size W142 in the axial line direction is smaller than the size A142 in the rotation direction R, and spaced away from the first recess portion 141 in the circumferential direction of the third container portion 135. It is desirable that the size A141 in the rotation direction R of the first recess portion 141 is at least ¼ and smaller than ½ of the length of the outer circumference of the third container portion 135 excluding the first recess portion 141 and the second recess portion 142. The size A141 in the rotation direction R of the first recess portion 141 may be, for example, 120 mm, and the size W141 in the axial line direction may be, for example, 30 mm. The size A142 in the rotation direction R of the second recess portion 142 may be, for example, 30 mm, and the size W142 in the axial line direction may be, for example, 120 mm.

The first recess portion 141, more specifically, further includes a bottom wall portion 141*b*, a first side wall portion 141*c* and a second side wall portion 141*d*. The bottom wall portion 141*b* of the first recess portion 141 extends in the rotation direction R. Its end on the downstream side in the rotation direction R is in communication with an inner portion in the radial direction of the end wall portion 141*a*, its end on the upstream side in the rotation direction R is in smooth communication with an outer circumferential portion of the third container portion 135 excluding the first recess portion 141 and the second recess portion 142, between the first recess portion 141 and the second recess portion 142. The central portion in the rotation direction R between the end on the downstream side in the rotation direction R and the end on the upstream side in the rotation direction R of the bottom wall portion 141*b* of the first recess portion 141 is disposed inward in the radial direction from the third container portion 135 excluding the first recess portion 141 and the second recess portion 142 and formed substantially into a partially cylindrical shape having the axial line L135 of the third container portion 135 as its axial line. The radius of curvature of the outer circumferential portion of the central portion in the rotation direction R of the bottom wall portion 141*b* of the first recess portion 141 may be, for example, 49 mm.

The first side wall portion 141*c* of the first recess portion 141 is disposed in the one end side in the axial line direction of the first recess portion 141, and extends in the rotation direction R. Its end on the downstream side in the rotation direction R is in communication with the one end in the radial direction of the end wall portion 141*a*, its inner portion in the radial direction is in communication with the one end of the bottom wall portion 141*b*. Its outer portion in the radial direction is in communication with the outer circumferential portion of the one end in the radial direction of the third container portion 135 excluding the first recess portion 141 and the second recess portion 142. The second side wall portion 141*d* of the first recess portion 141 is disposed in the other end side in the axial line direction of the first recess portion 141, and extends in the rotation direction R. Its end on the downstream side in the rotation direction R is in communication with the other end in the radial direction of the end wall portion 141*a*, its inner portion in the radial direction is in communication with the other end of the bottom wall portion 141*b*. Its outer portion in the radial direction is in communication with the outer circumferential portion of the other end in the radial direction of the third container portion 135 excluding the first recess portion 141 and the second recess portion 142. The first side wall portion 141*c* and the second side wall portion 141*d* of the first recess portion are provided upright from the bottom wall portion 141*b* outwardly in the radial direction, and the bottom wall portion 141*b* is perpendicular to the first side wall portion 141*c*, and the bottom wall portion 141*b* is perpendicular to the second side wall portion 141*d*.

The exhausting hole 143 is formed in an intermediate portion in the axial line direction of the end wall portion 141*a* of the first recess portion 141 that is outward in the radial direction, so as to be a rectangular opening whose axial line direction is the longitudinal direction. Therefore, the exhausting hole 143 is, in the side wall portion 141*a* of the first recess portion 141, outward in the radial direction from the end on the downstream side in the rotation direction R of the bottom wall portion 141*b* of the first recess portion 141, toward the other end in the axial line direction from the end on the downstream side in the rotation direction R of the first side wall portion 141*c*, and toward the one end in the axial line direction from the end on the downstream side in the rotation direction R of the second side wall portion 141*d*. More specifically, the surface on the outer side in the radial direction of the exhausting hole 143 is in smooth communication with the inner circumferential surface of the third container portion 135 excluding the first recess portion 141 and the second recess portion 142 on the downstream side in the rotation direction R of the first recess portion 141.

The second recess portion 142, more specifically, further includes a bottom wall portion 142*b*, a first side wall portion 142*c* and a second side wall portion 142*d*. The bottom wall portion 142*b* of the second recess portion 142 extends in the rotation direction R. Its end on the upstream side in the rotation direction R and its end on the downstream side in the rotation direction R are in smooth communication with an outer circumferential portion of the third container portion 135 excluding the first recess portion 141 and the second recess portion 142, between the first recess portion 141 and the second recess portion 142. The central portion in the rotation direction R between the end on the down stream side in the rotation direction R and the end on the upstream side in the rotation direction R of the bottom wall portion 142*b* of the second recess portion 142 is disposed inward in the radial direction from the third container portion 135 excluding the first recess portion 141 and the second recess portion 142 and formed substantially into a partially cylindrical shape having the axial line L135 of the third container portion 135 as its axial line. The radius of curvature of the outer circumferential portion of the central portion in the rotation direction R of the bottom wall portion 142*b* of the second recess portion 142 may be, for example, 49 mm.

The first side wall portion 142*c* of the second recess portion 142 is disposed in the one end side in the axial line direction of the second recess portion 142, and extends in the rotation direction R. Its inner portion in the radial direction is in communication with the one end of the bottom wall portion 142*b*. Its outer portion in the radial direction is in communication with the outer circumferential portion of the one end in the radial direction of the third container portion 135 excluding the first recess portion 141 and the second recess portion 142. The second side wall portion 142*d* of the second recess portion 142 is disposed in the other end side in the axial line direction of the second recess portion 142. Its inner portion in the radial direction is in communication with the other end of the bottom wall portion 142*b*. Its outer portion in the radial direction is in communication with the outer circumferential portion of the other end in the radial direction of the third container portion 135 excluding the first recess portion 141 and the second recess portion 142. The first side wall portion 142*c* and the second side wall portion 142*d* of the second recess portion 142 are provided upright from the bottom wall portion 142*b* outwardly in the radial direction, and the bottom wall portion 142*b* is perpendicular to the first side wall portion 142*c*, and the bottom wall portion 142*b* is perpendicular to the second side wall portion 142*d*.

A plurality of outlet guide pieces 144 that project outward in the radial direction are provided spaced away from each other in the circumferential direction with equal intervals in the circumferential direction in the outer circumferential portion of the one end in the axial line direction and the other end in the axial line direction excluding the first recess portion 141 and the second recess portion 142 of the third container portion 135, as shown in FIG. 34. The outlet guide pieces 144 provided in the one end in the axial line direction of the third container portion 135, more specifically, incline toward the rotation direction R from the other end in the axial line direction to the one end the axial line direction. The outlet guide pieces 144 provided in the other end in the axial line direction of the third container portion 135, more specifically, incline toward the rotation direction R from the one end in the axial line direction to the other end the axial line direction. The amount of projection outward in the radial direction of the outlet guide pieces 144 from the outer circumferential portion excluding the first recess portion 141 and the second recess portion 142 of the third container portion 135 may be, for example, 1 mm. The size of the outlet guide pieces 144 in the longitudinal direction may be, for example, 24 mm. An angle $\phi$ formed by the longitudinal direction of the outlet guide pieces 144 and the width direction of the third container portion 135 may be, for example, 30 degrees.

The developer container main body 131 is formed into one piece such that the one end in the axial line direction of the third container portion 135 is coupled to the open end 133*b* of the first container portion 133, and that the other end in the axial line direction of the third container portion 135 is coupled to the open end 134*b* of the second container portion 134. Such a developer container main body 131 may be produced by blow molding with a synthetic resin such as polyethylene. Thus, the developer container main body 131 can be produced easily and the number of components of the developer container 130 can be reduced.

The bottom 133*a* of the first container portion 133 becomes the one end 133*a* in the axial line direction of the developer container main body 131, and the bottom 134*a* of the second container portion 134 becomes the other end 134*a* in the axial line direction of the developer container main body 131. The first container portion 133, the second container portion 134 and the third container portion 135 are coupled such that the axes L133, L134, and L135 of the first container portion 133, the second container portion 134 and the third container portion 135 are coaxial, and thus the developer container main body 131 is formed in this manner. In this state, the third container portion 135 is disposed in an intermediate portion in the axial line direction of the developer container main body 131 excluding both the ends 133*a* and 134*a* in the axial line direction. Therefore, the first container recess portion 141, the second container recess portion 142 and the exhausting hole 143 of the third container portion 135 are disposed in an intermediate portion in the axial line direction of the developer container main body 131 excluding both the ends 133*a* and 134*a* in the axial line direction. The axial line L131 of the developer container main body 131 is constituted by the axial line L133 of the first container portion 133, the axial line L134 of the second container portion 134 and the axial line L135 of the third container portion 135.

Figure 36:
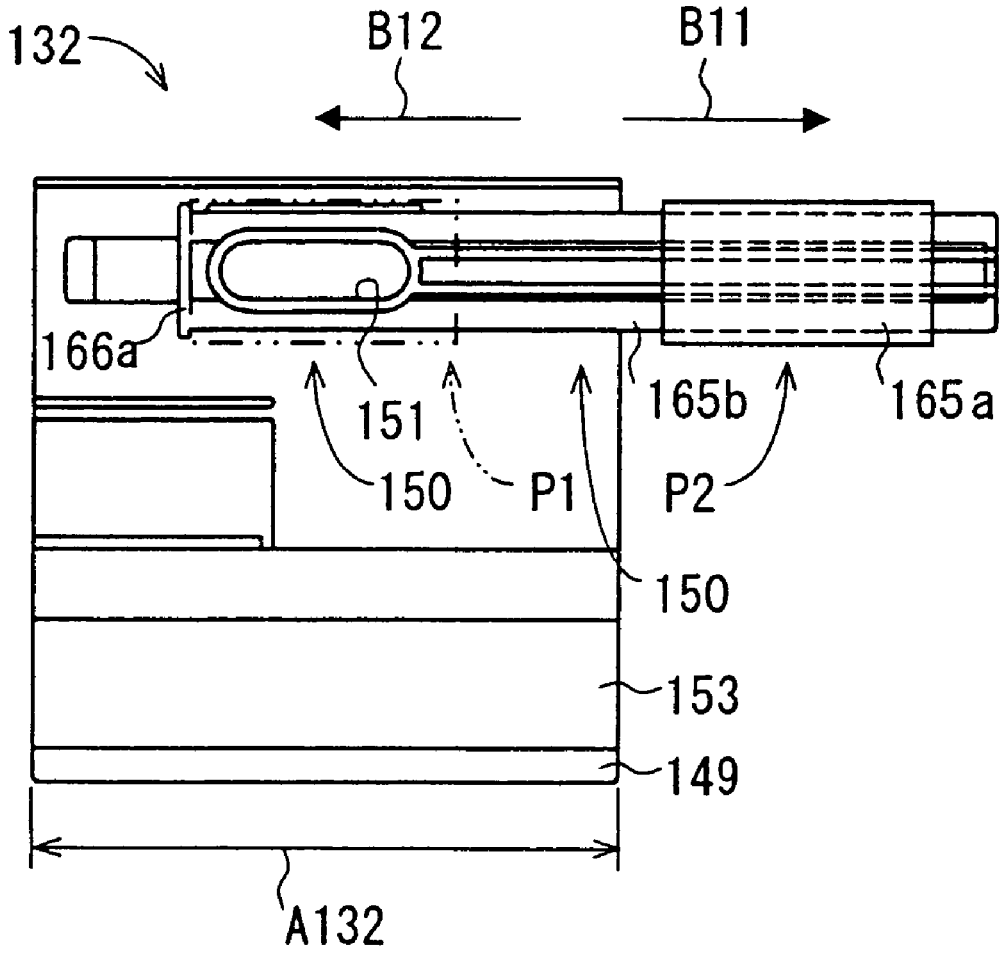
FIG. 36 is a front view showing the supporting member 132.
Figure 37:
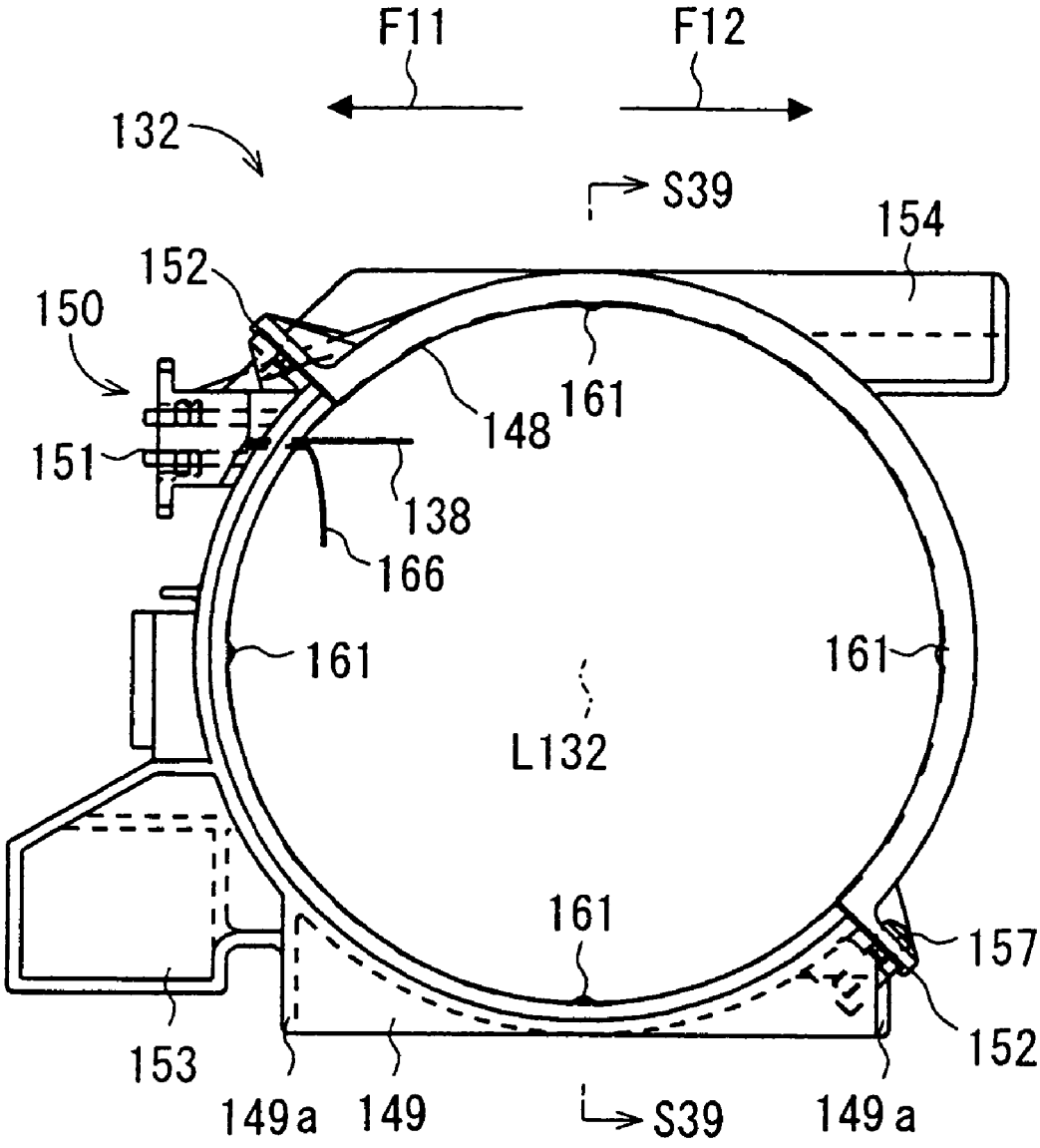
FIG. 37 is a right side view showing the supporting member 132.

FIG. 36 is a front view showing the supporting member 132. FIG. 37 is a right side view showing the supporting member 132. The supporting member 132 is formed substantially into a cylindrical shape, and has an inner circumferential portion 148 that supports portions including at least the third container portion 135 of the developer container main body 131 configured in the above-described manner throughout the full circumference from the outer side in the radial direction. The inner circumferential portion 148 has a cylindrical inner circumferential surface with the axial line L132 as the center. The supporting member 132 includes a support stand 149 having at least 3 contact portions 149*a* on a virtual plane parallel to the axial line L132. The contact portions 149*a* of the support stand 149 may be formed, for example, into two rectangular flat surfaces having a direction parallel to the axial line L132 as its longitudinal direction. By bringing the contact portions 149*a* of the support stand 149 in contact with the horizontal plane, an axial line of the inner circumferential portion 148 of the supporting member 132 can be disposed parallel to the horizontal plane. The length A132 in the axial line direction of the supporting member 132 is set to be larger than the length A135 in the axial line direction of the third container portion 135. The length A132 in the axial line direction of the supporting member 132 may be, for example, 100 mm.

In a state where the support stand 149 is installed on the horizontal surface, in the supporting member 132, an outlet portion 150 projecting to one direction of a first horizontal direction F11, which is one direction of one horizontal direction is formed in its upper portion. In an intermediate portion in the axial line direction of the supporting member 132 in the outlet portion 150, a through hole 151 that penetrates along the one direction of the first horizontal direction F11, and is an elliptic opening extending in a direction parallel to the axial line L132 of the supporting member is formed. The inner diameter in the longitudinal direction of the through hole 151 is set to equal to or larger than the size W141 in the axial line direction of the first recess portion 141 of the developer container main body 131 and the size W142 in the axial line direction of the second recess portion 142 of the developer container main body 131.

A shutter portion 165, which is means for opening and closing a through hole that switches the opening on the downstream side in one direction of the first horizontal direction F11 of the through hole 151 between the open state and the closed state is provided in the outlet portion 150 of the supporting member 132. The shutter portion 165 includes a shutter 165*a* and a shutter guide portion 165*b*. The shutter guide portion 165*b* extends in a second direction, which is a horizontal direction perpendicular to the first horizontal direction, and the through hole 151 is opened in the end on the upstream side in one direction of the second horizontal direction B11. The shutter 165*a* is supported by the shutter guide portion 165*b* slidably in one direction of the second horizontal direction B11 and in the other direction of the second horizontal direction B12, which is a direction opposite to the one direction of the second horizontal direction B11.

The shutter 165*a* can be positioned at a closed position P1 shown by a double-dotted dashed line in FIG. 36 at which the opening on the downstream side in the one direction of the first horizontal direction F11 of the through hole 151 is closed and at an open position P2 at which the opening on the downstream side in the one direction of the first horizontal direction F11 of the through hole 151 is open by sliding along the shutter guide portion 165*b*. The shutter 165*a* is regulated so as not to slide on the downstream side in the other direction of the second horizontal direction B12 from the closed position P1, and regulated so as not to slide from the end on the downstream side in the one direction of the second horizontal direction B11 of the shutter guide portion 165*b* to the one direction of the second horizontal direction B11. That is to say, the open position P2 is on the downstream side in the one direction of the second horizontal direction B11 from the closed position P1 and on the upstream side in the one direction of the second horizontal direction B11 from the end on the downstream side in the one direction of the second horizontal direction B11 of the shutter guide portion 165*b*. Thus, the shutter 165*a* is positioned at the open position P2 by sliding in the one direction of the second horizontal direction B11 when positioned at the closed position P1, and is positioned at the closed position P1 by sliding in the other direction of the second horizontal direction B12 when positioned at the open position P2.

Furthermore, in the supporting member 132, a drawing-out member 138, which is lead-out means, and a sealing sheet 166, which is sealing means, are provided. The drawing-out member 138 is made of polymer resin such as polyethylene terephthalate (abbreviated as PET), is formed into a sheet having flexibility and elasticity, and its fixed end is provided in the inner circumferential portion of the supporting member 132, more specifically, a portion facing the end on the upstream side in the one direction of the first horizontal direction F11 of the through hole 151 of the supporting member 132. The sealing sheet 166 is formed into a sheet having flexibility made of, for example, polyethylene, and its fixed end is provided in a portion facing the end on the upstream side in the one direction of the first horizontal direction F11 of the through hole 151 of the supporting member 132. The fixed end of the drawing-out member 138 is stacked on an upper portion of the fixed end of the sealing sheet 166. The drawing-out member 138 and the sealing sheet 166 will be described in greater detail later.

In the supporting member 132, two coupling protrusion portions 152 that project outward in the radial direction are formed. One of the coupling protrusion portions 152 is provided in an upper portion than the outlet portion 150 when the support stand 149 is installed on the horizontal plane, and the other coupling protrusion portion 152 is provided at a position symmetric to the one coupling protrusion portion 152 with respect to the axial line L132. Furthermore, in the supporting member 132, a first guide piece 153 is formed that is provided in a lower portion than the outlet portion 150 when the support stand 149 is installed on the horizontal plane, projecting in the one direction of the first horizontal direction F11 and extending parallel to the axial line L132. Furthermore, in the supporting member 132, a second guide piece 154 is formed that is provided in an upper portion than the outlet portion 150 when the support stand 149 is installed on the horizontal plane, projecting in the other direction of the first horizontal direction F12, which is a direction opposite to the one direction of the first horizontal direction F11, and extending parallel to the axial line L132.

Figure 38:
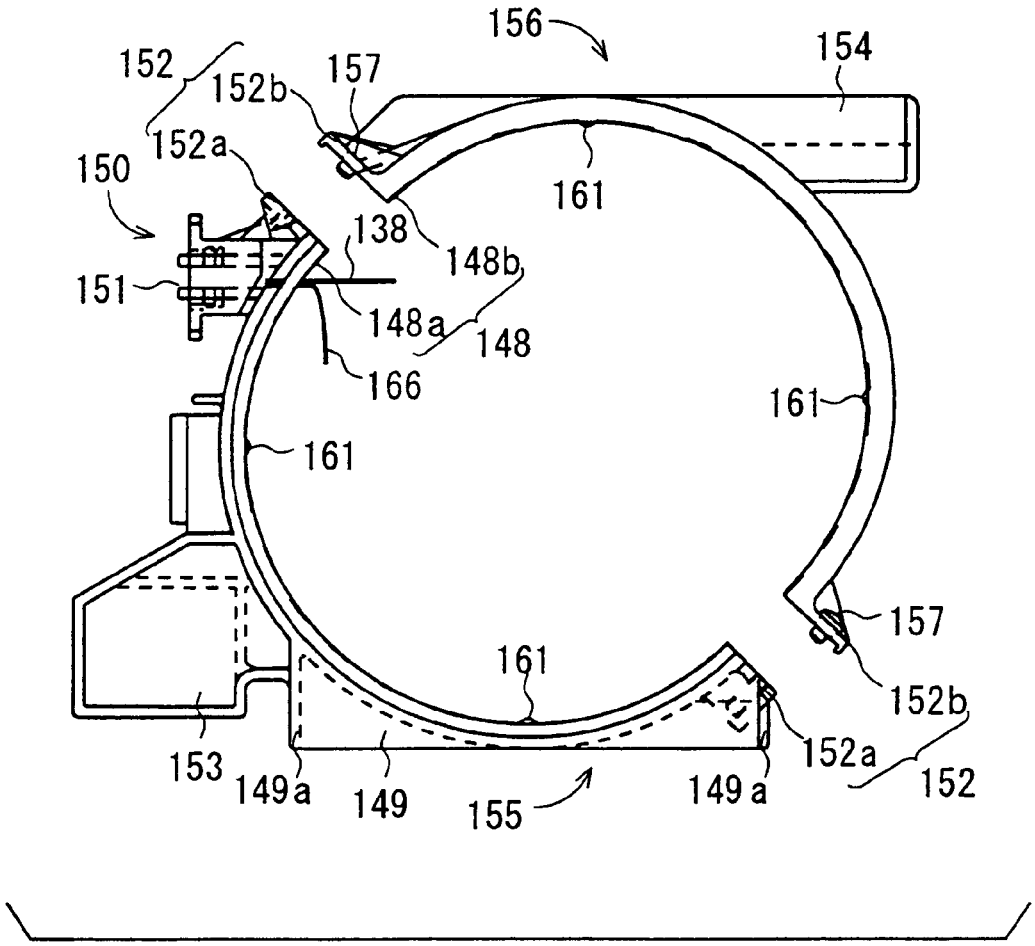
FIG. 38 is an exploded right side view showing the supporting member 132.

FIG. 38 is an exploded right side view showing the supporting member 132. The supporting member 132 can be divided into two by a virtual plane that passes through the axial line L132 and inclines upward as going to the one direction of the first horizontal direction F11 when the container is installed on the horizontal plane, more specifically, divided into a first supporting portion 155 that is below the virtual plane and a second supporting portion 156 that is above the virtual plane. The first supporting portion 155 includes the first guide piece 153, the outlet portion 150, one portion 152*a* of each of the coupling protrusion portions 152, the support stand 149 and a portion 148*a* on the first guide piece 153 side of the inner circumferential portion 148 in the supporting member 132. The second supporting portion 156 includes the second guide piece 154, the other portion 152*b* of each of the coupling protrusion portions 152, and a portion 148*b* on the support stand 149 side of the inner circumferential portion 148 in the supporting member 132.

The first supporting portion 155 and the second supporting portion 156 are coupled removably with a spring member 157. More specifically, the one portion 152*a* of each of the coupling protrusion portions 152 of the first supporting portion 155 is coupled to the other portion 152*b* of each of the coupling protrusion portions 152 of the second supporting portion 156 with the spring member 157. Thus, when supporting the developer container main body 131, the supporting member 132 is previously divided, and the divided supporting member 132 supports the portion including the first and the second recess portions 141 and 142 and the exhausting hole 143 of the developer container main body 131 from the outer side in the radial direction. Thus, the full circumference of the developer container main body 131 can be supported and this assembling work can be performed easily.

Figure 39:
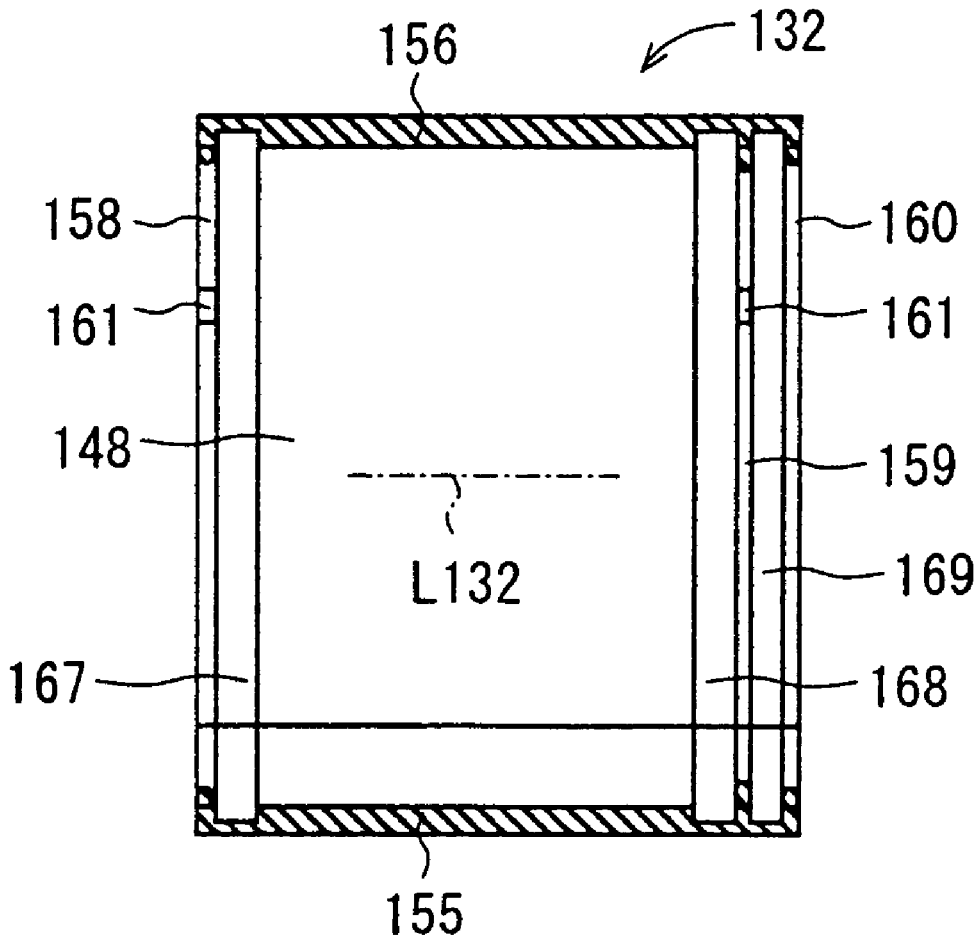
FIG. 39 is a cross-sectional view taken along line S39-S39 of FIG. 37.

FIG. 39 is a cross-sectional view taken along line S39-S39 of FIG. 37. FIG. 37 is also referred to. A first support projecting portion 158 projecting inward in the radial direction and extends throughout the full circumference in the circumferential direction is provided in the one end in the axial line direction of the inner circumferential portion 148 of the supporting member 132. A second support projecting portion 159 projecting inward in the radial direction and extends throughout the full circumference in the circumferential direction is provided in the other end in the axial line direction of the inner circumferential portion 148 of the supporting member 132. A third support projecting portion 160 projecting inward in the radial direction and extending throughout the full circumference in the circumferential direction is provided in the other end in the axial line direction of the inner circumferential portion 148 of the supporting member 132, on the other end side in the axial line direction from the second support projecting portion 159, spaced away from the second support projecting portion 159. The gap between the second support projecting portion 159 and the third support projecting portion 160 is set to be slightly larger than the size in the axial line direction of the guide protruding piece 140 of the second container portion 134 of the developer container main body 131, and may be, for example, 3 mm.

A plurality of (four in this embodiment) support protruding pieces 161 that project inward in the radial direction spaced away in the circumferential direction with equal intervals are formed in the first support projecting portion 158 and the second support projecting portion 159. The top portion on the inner side in the radial direction of the support protruding pieces 161 has a support surface that is curved on the cylindrical outer circumferential face. For each support protruding piece 161 of the first support projecting portion 158 and the second support projecting portion 159, the diameter of a virtual circle passing through the top portion of each guide protruding piece 140 having the axial line L132 as its center is set to be slightly larger than the outer diameter of the outer circumferential portion of the first container portion 133 and the outer diameter of the circumferential portion of the second container portion 134 excluding the guide protruding piece 140, and may be, for example, 107 mm. The inner diameter of the third support projecting portion 160 is set to be slightly larger than the outer diameter of the circumferential portion of the second container portion 134 excluding the guide protruding piece 140, and may be, for example, 107 mm.

A first support recess 167 that is recessed outward in the radial direction and extends throughout the full circumference in the circumferential direction is provided adjacent to the other end in the axial line direction of the first support projecting portion 158 in the one end in the axial line direction of the inner circumferential portion 148 of the supporting member 132. A second support recess 168 that is recessed outward in the radial direction and extends throughout the full circumference in the circumferential direction is provided adjacent to the one end in the axial line direction of the second support projecting portion 159 in the other end in the axial line direction of the inner circumferential portion 148 of the supporting member 132. A third support recess 169 that is recessed outward in the radial direction and extends throughout the full circumference in the circumferential direction is provided between the second projecting portion 159 and the third support projecting portion 160 in the other end in the axial line direction of the inner circumferential portion 148 of the supporting member 132. The sizes in the axial line direction of the first support recess 167 and the second support recess 168 may be, for example, 7 mm. The size in the axial line direction of the third support recess 169 is set to be slightly larger than the size in the axial line direction of the guide protruding piece 140 of the second container portion 134 of the developer container main body 131 and may be, for example, 3 mm.

Figure 40A:
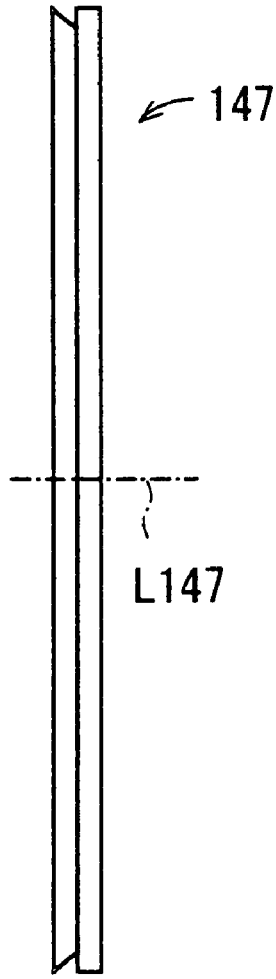
FIG. 40A is a front view showing the sealing material 147.
Figure 40B:
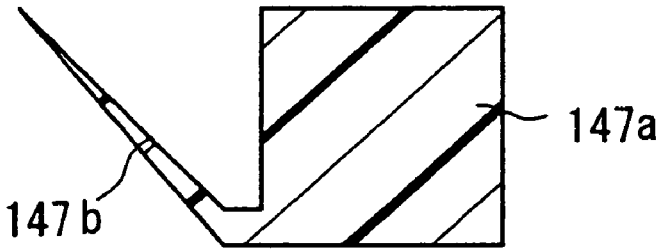
FIG. 40B is a view showing the cross section perpendicular to the circumferential direction of the sealing material 147.

FIG. 40A is a front view showing the sealing material 147, and FIG. 40B is a view showing the cross section perpendicular to the circumferential direction of the sealing material 147. The sealing material 147, which is sealing means, is made of a synthetic resin such as silicon rubber having flexibility and elasticity. The sealing material 147 is formed substantially into a ring shape, as shown in FIG. 40A. The sealing material 147 includes a base portion 147*a* and a contact portion 147*b*, as shown in FIG. 40B. The base portion 147*a* of the sealing material 147 is formed into such a shape that its cross section perpendicular to the circumferential direction having the axial line L147 as its center is rectangular. The contact portion 147*b* of the sealing material 147 projects from an inner portion in the radial direction in the one end in the axial line direction of the base portion 147*a* so as to incline outward in the radial direction as going from the other end in the axial line direction to the one end in the axial line direction.

The diameter of the inner circumferential portion of the base portion 147*a* of the sealing material 147 is set to be smaller than the outer diameter of the outer circumferential portion of the first container portion 133 of the developer container main body 131 and the outer circumferential portion of the second container portion 134 excluding the guide protruding piece 140, and may be, for example, 99 mm. The diameter of the outer circumferential portion of the base portion 147*a* and the contact portion 147*b* of the sealing material 147 is set to be equal to or larger than the diameter of a virtual circle passing through the outer circumferential portion of each outlet guide piece 144 of the third container portion 133 of the developer container main body 131 having the axial line L131 as the center, and maybe, for example, 115 mm. The size in the axial line direction of the sealing material 147 is set to be not greater than the size in the axial line direction of the first and the second support recess 167 and 168 of the supporting member 132, and may be, for example, 6 mm.

Figure 41:
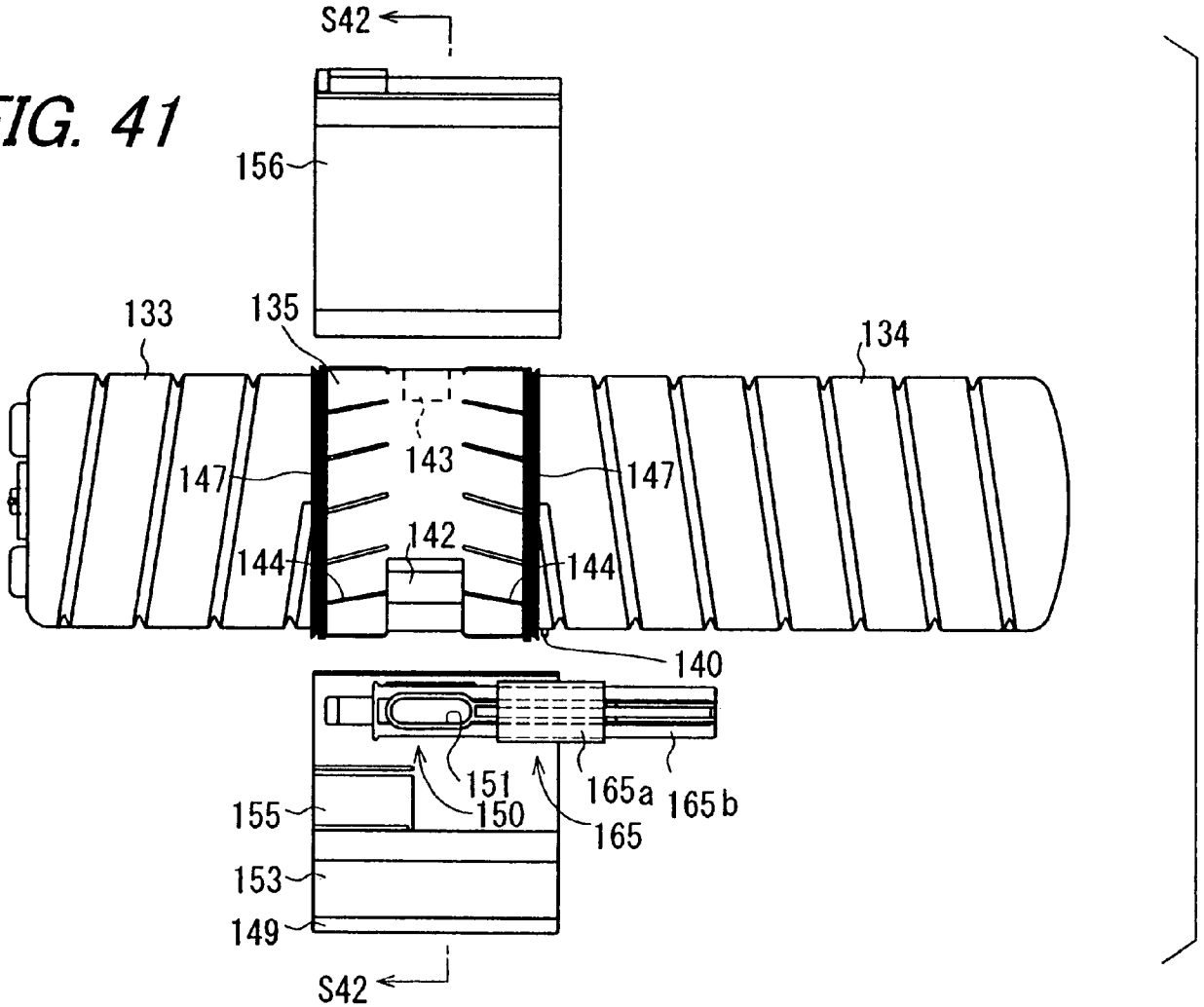
FIG. 41 is a front view showing the manner of assembling the developer container 130.
Figure 42:
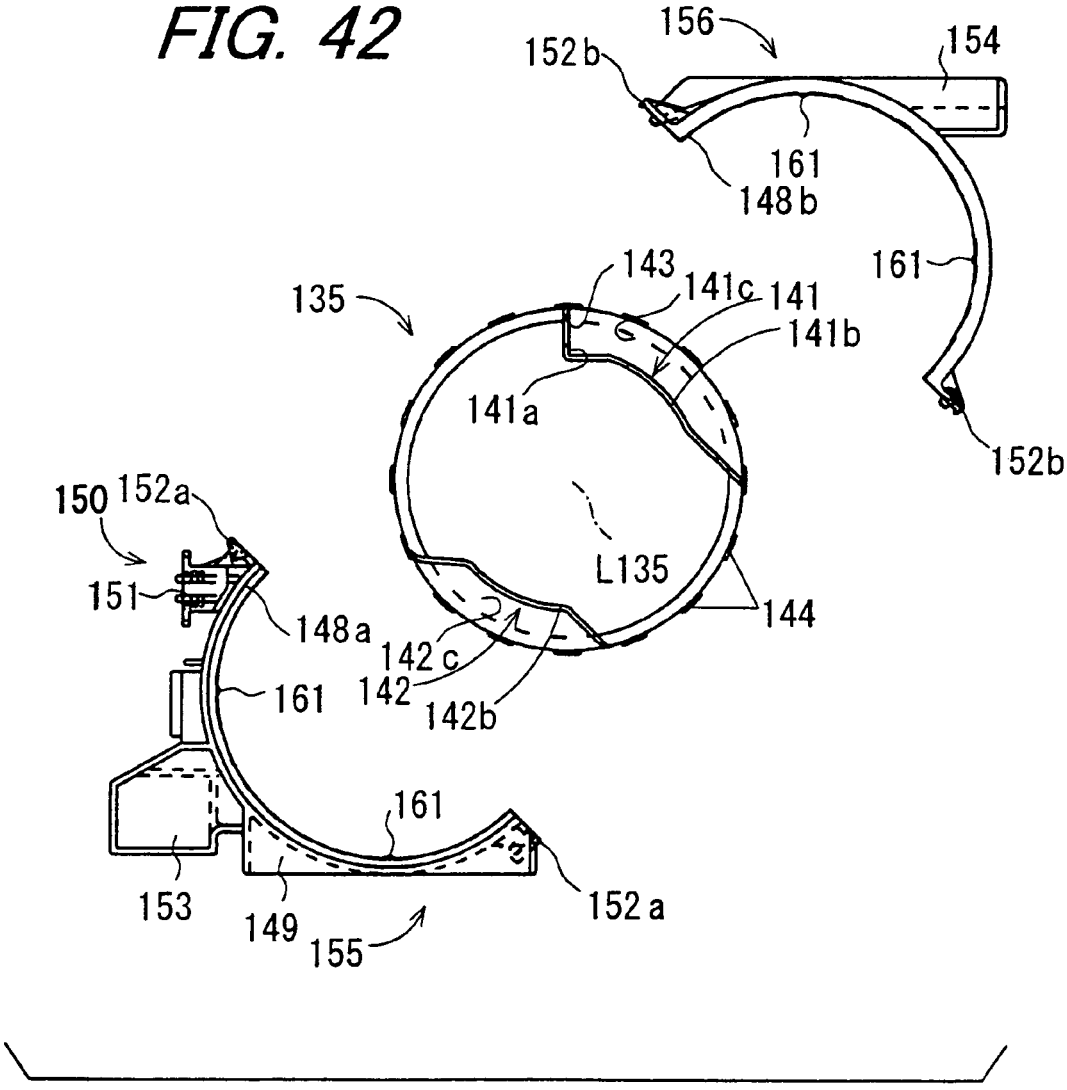
FIG. 42 is a cross-sectional view taken along line S42-S42 of FIG. 41.

FIG. 41 is a front view showing the manner of assembling the developer container 130. FIG. 42 is a cross-sectional view taken along line S42-S42 of FIG. 41. Before assembling the developer container 130, the supporting member 132 is divided into the first supporting portion 155 and the second supporting portion 156. At this time, of the two sealing materials 147, one of the sealing materials 147 is wound tightly around the open end 133*b* of the first container portion 133, and is attached to the first container portion 133 of the developer container main body 131 such that the base portion 147*a* of the sealing material 147 is tightly attached to the end face of the one end in the axial line direction of the third container portion 135. The other sealing material 147 is wound tightly around a portion on the one end side in the axial line direction from the guide protruding piece 140 of the open end 134*b* of the second container portion 134, and is attached to the second container portion 134 of the developer container main body 131 such that the base portion 147*a* of the sealing material 147 is tightly attached to the end face of the other end in the axial line direction of the third container portion 135.

The first supporting portion 155 and the second supporting portion 156 sandwich a portion including the third container portion 135 of the developer container main body 131 from the outer side in the radial direction. In this state, the first supporting portion 155 and the second supporting portion 156 are coupled to each other by the screw member 157.

Figure 43:
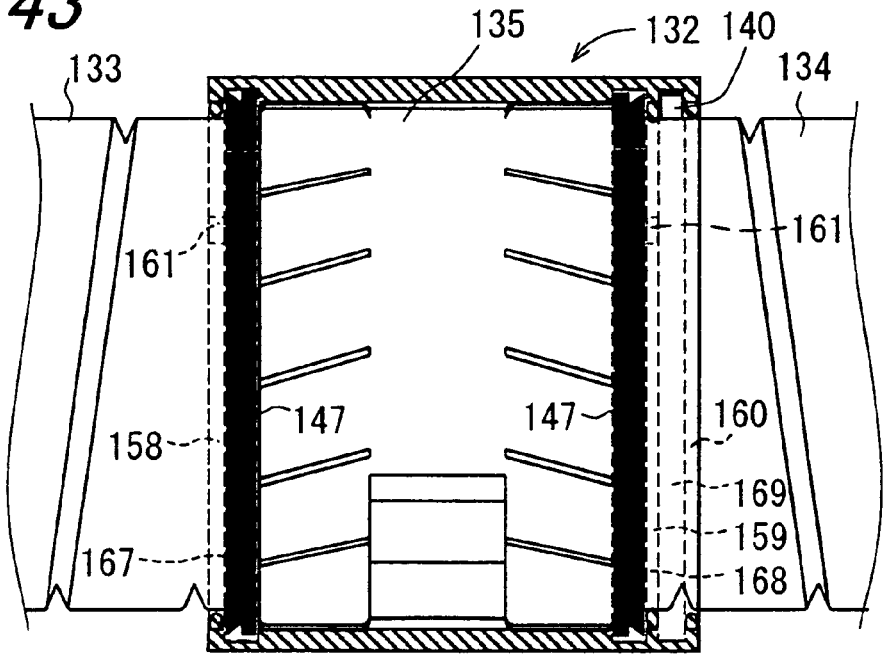
FIG. 43 is a cross-sectional view taken along line S43-S43 of FIG. 29.

FIG. 43 is a cross-sectional view taken along line S43-S43 of FIG. 29. In the state where the developer container main body 131 is supported by the supporting member 132, the axial line L131 of the developer container main body 131 completely or substantially matches the axial line L132 of the inner circumferential portion 148 of the supporting member 132, and the developer container main body 131 is rotatable around the axial line L131 with respect to the supporting member 132. When the support stand 149 of the supporting member 132 is provided on the horizontal plane in this state, the first and the second container portion 133 and 134 of the developer container main body 131 are away from the horizontal plane, and the horizontal plane is parallel to the rotation axial line L131.

In the supporting member 132, more specifically, each support protruding piece 161 of the first support projecting portion 158 is in contact with the outer circumferential portion of the first container portion 133, and each support protruding piece 161 of the second support projecting portion 159 is in contact with the outer circumferential portion of the second container portion 134 excluding the guide protruding piece 140. Thus, the outer circumferential portion of the first container portion 133 is supported substantially at four points with equal intervals in the circumferential direction by the support protruding pieces 161 of the first support projecting portion 158, and is supported substantially at four points with equal intervals in the circumferential direction by the support protruding pieces 161 of the second support projecting portion 159. Thus, the frictional force against the rotation of the developer container main body 131 between the outer circumferential portion of the first container portion 133 and the first support projecting portion 158 and between the outer circumferential portion of the second container portion 134 and the second support projecting portion 159 can be minimized.

The sealing material 147 of the first container portion 133 is engaged in the first support recess 167 of the supporting member 132, and the contact portion 147*b* of the sealing material 147 is elastically contacted throughout the full circumference on the other end surface in the axial line direction of the first support projecting portion 158. The sealing material 147 of the second container portion 134 is engaged in the second support recess 168 of the supporting member 132, and the contact portion 147*b* of the sealing material 147 is elastically contacted throughout the full circumference of the one end surface in the axial line direction of the second support projecting portion 159. Such two sealing materials 147 achieve sealing between the developer container main body 131 and the supporting member 132 on the one end side in axial line direction and on the other end side of the developer container main body 131 from the first and the second recess portions 141 and 142 and the exhausting hole 143 of the developer container main body 131 and the through hole 151 of the supporting member 132 on the throughout the full circumference.

The guide protruding piece 140 of the second container portion 134 of the developer container main body 131 is engaged in the third support recess 169 of the supporting member 132 while the slide displacement in the axial line direction with respect to the supporting member 132 is regulated. Thus, the developer container main body 131 is regulated so as not to slide in the axial line direction with respect to the supporting member 132. The outer circumferential portion of the each outlet guide piece 144 of the third container portion 135 of the developer container main body 131 is in contact with the inner circumferential portion 148 of the supporting member 132. Thus, the supporting member 132 supports a portion including at least the first recess portion 141 of the developer container main body 131 rotatably around the rotation axial line L131 throughout the full circumference from the outer side in the radial direction.

Figure 44:
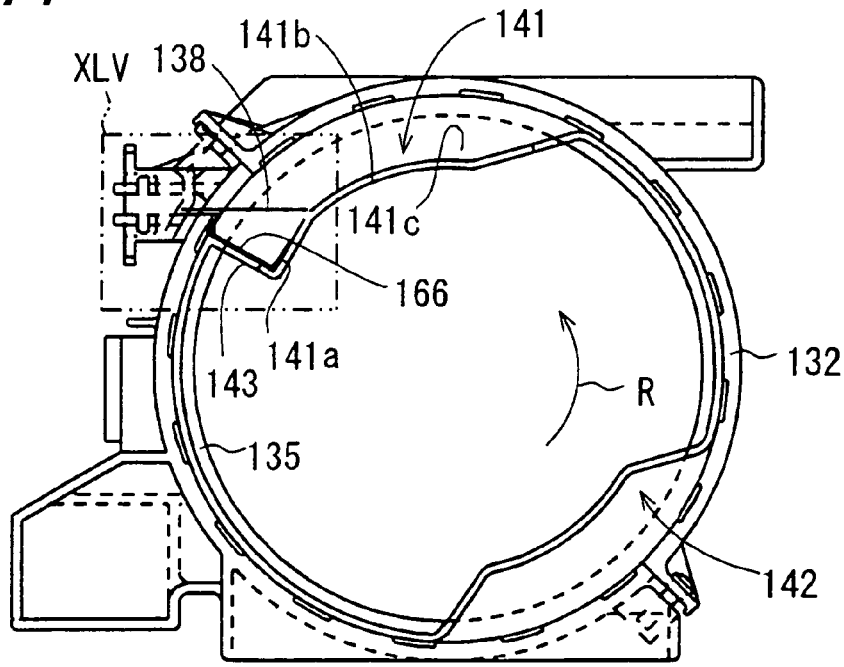
FIG. 44 is a cross-sectional view taken along line S44-S44 of FIG. 28.
Figure 45A:
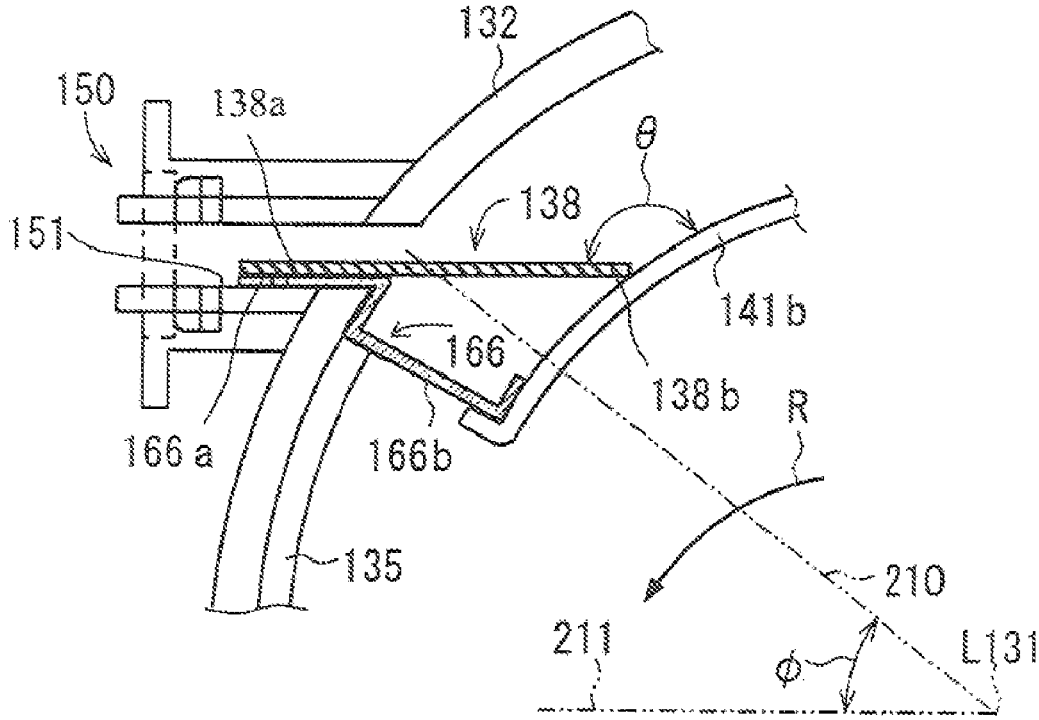
FIGS. 45A and 45B are enlarged views showing a section XLV of FIG. 44.
Figure 45B:
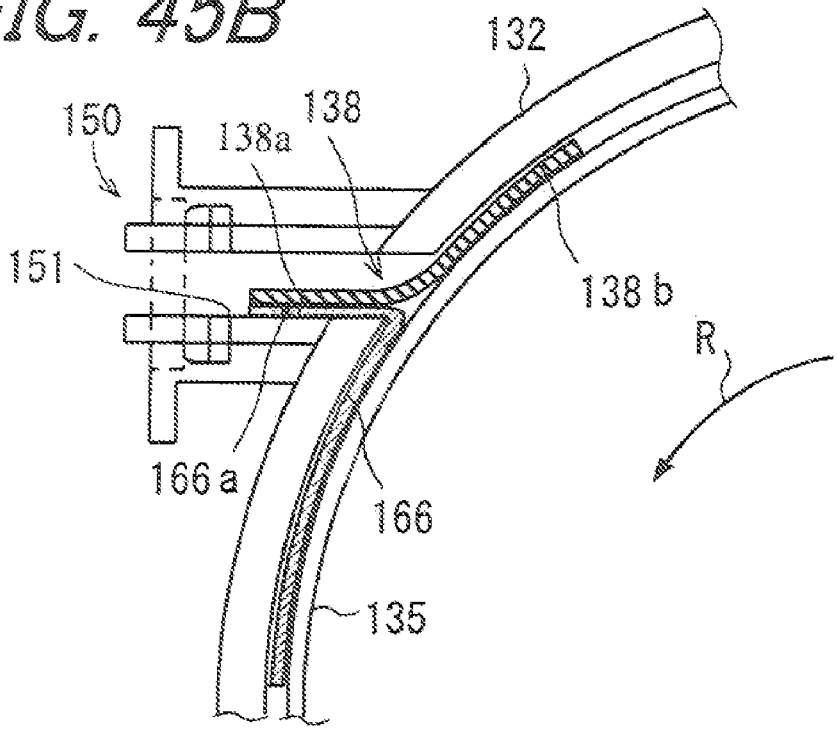

FIG. 44 is a cross-sectional view taken along line S44-S44 of FIG. 28. FIGS. 45A and 45B are enlarge views showing a section XLV of FIG. 44. FIGS. 44 and 45A are views when the developer container main body 131 is in an initial state with respect to the supporting member 132. The through hole 151 of the supporting member 132 is provided above the axial line L131 of the developer container main body 131 when the container is mounted in an image forming apparatus 70A, 70B, which will be described later. In the through hole 151, more specifically, as shown in FIG. 45A, an angle $\phi$ formed by a virtual straight line 210 connecting the axial line L131 of the developer container main body 131 and the center of the through hole 151 with respect to a horizontal plane 211 is from 30 degrees to 70 degrees when the container is mounted in an image forming apparatus 70A, 70B. In this embodiment, the angle ϕ may be, for example, 45 degrees.

The drawing-out member 138 extends on the upstream side in the rotation direction R with its fixed end 138*a* provided in a portion facing an end on the upstream in one direction of the first horizontal direction F11 of the through hole 151 of the supporting member 132, and with its free end 138*b* capable of being elastically contacted with the outer circumferential portions of at least the bottom wall portion 141*b* of the first recess portion 141 and the bottom wall portion 142*b* of the second recess portion 142 of the third container portion 135 of the developer container main body 131. The free end 138*b* of the drawing-out member 138 is contacted with the outer circumferential portions of at least the bottom wall portion 141*b* of the first recess portion 141 and the bottom wall portion 142*b* of the second recess portion 142 of the third container portion 135 of the developer container main body 131 with an angle θ of more than 90 degrees. More specifically, the angle θ is an angle formed by the surface facing above of the free end 138*b* of the drawing-out member 138 and the outer circumferential portions of the bottom wall portions 141*b* and 142*b* of the respective recess portions 141 and 142.

The fixed end 166*a* of the sealing sheet 166 is provided in a portion facing an end on the upstream in one direction of the first horizontal direction F11 of the through hole 151 of the supporting member 132. A portion 166*b* of the sealing sheet 166 excluding the fixed end 166*a* is provided removably by, for example, heat welding in such a manner that at least the end wall portion 141*a* of the first recess portion 141 is covered when the developer container main body 131 is in an initial state with respect to the supporting member 132. In the initial state, the exhausting hole 143 is closed by the portion 166*b* of the sealing sheet 166 excluding the fixed end 166*a* in this manner. Thus, in the initial state, even if the user places the container with the shutter 165 of the shutter portion 165 being at the open position P2 by mistake, the developer contained in the developer container main body 131 can be prevented from letting out undesirably from the through hole 151.

When the developer container main body 131 is rotated in the rotation direction R around the rotation axial line L131 from the initial state, the portion 166*b* of the sealing sheet 166 excluding the fixed end 166*a* is detached from the end wall portion 141*a* of the first recess portion 141 so that the exhausting hole 143 is opened. The portion 166*b* of the sealing sheet 166 excluding the fixed end 166*a* that has been detached from the end wall portion 141*a* of the first recess portion 141 is disposed between the third container portion 135 of the developer container main body 131 and the inner circumferential portion 148 of the supporting member 132 on the downstream side in the rotation direction R of the through hole 151 of the supporting member 132, as shown in FIG. 45B. In this manner, the user can open the exhausting hole 143 easily by rotating the developer container main body 131 without removing directly the sealing sheet 166.

In a state the developer is contained with the support stand 149 of the supporting member 132 is installed on the horizontal plane, two layers, that is, a developer layer made up of the developer and a gas layer made up of a gas that is above the developer layer are formed in the inner space of the developer container main body 131. The developer container main body 131 is rotated clockwise around the rotation axial line L131 when viewed from the first container portion 133 to the second container portion 134. In this case, the developer of the developer layer of the first container portion 133 is conveyed to a first convey direction C11 (see FIG. 28) from the first container portion 133 to the third container portion 135 along the rotation axial line L131 by the first protruding piece 136. The developer of the developer layer of the second container portion 134 is conveyed to a second convey direction C12 (see FIG. 28) from the second container portion 134 to the third container portion 135 along the rotation axial line L131 by the second protruding piece 139. By rotating the developer container main body 131 around the rotation axial line L131 in this manner, the contained developer can be conveyed to the exhausting hole 143. Furthermore, in the third container portion 135, the developer flowing in the first convey direction C11 collides with the developer flowing in the second convey direction C12, so that the developer can be agitated.

When the developer is conveyed, a force directed from the inner circumferential portion of the first and the second container portions 133 and 134 including the first and the second protruding pieces 136 and 139 to the third container portion 135 is applied to the developer. When the amount of the developer contained in the developer container main body 131 is large, the developer disposed within the amount A102 of projection inward in the radial direction from the inner circumferential portion the first and the second container portions 133 and 134 to the first and the second protruding pieces 136 and 139 is agitated principally by the developer container main body 131 being rotated, so that the developer in the developer container main body 131 is well distributed.

FIGS. 46A and 46B and FIGS. 47A and 47B are views for illustrating the behavior in which the developer in the third container portion 135 of the developer container main body 131 is led to the through hole 151 of the supporting member 132 when the developer container main body 131 is rotated in the rotation direction R around the rotation axial line L131. FIGS. 33, 35A, 35B and 43 are also referred to. In a state where the developer container main body 131 is supported by the supporting member 132 rotatably around the rotation axial line L131, a first holding space 162*a* is formed, facing the first recess portion 141 of the third container portion 131 and the inner circumferential portion 148 of the supporting member 132. The first holding space 162*a* is a space that is substantially closed except the exhausting hole 143, and is disposed on the upstream side in the rotation direction R of the exhausting hole 143, and is in communication with the space in the developer container main body 131 via the exhausting hole 143. A second holding space 162*b* is formed, facing the second recess portion 141 of the third container portion 131 and the inner circumferential portion 148 of the supporting member 132. The second holding space 162*b* is a space that is substantially closed.

Figure 46A:
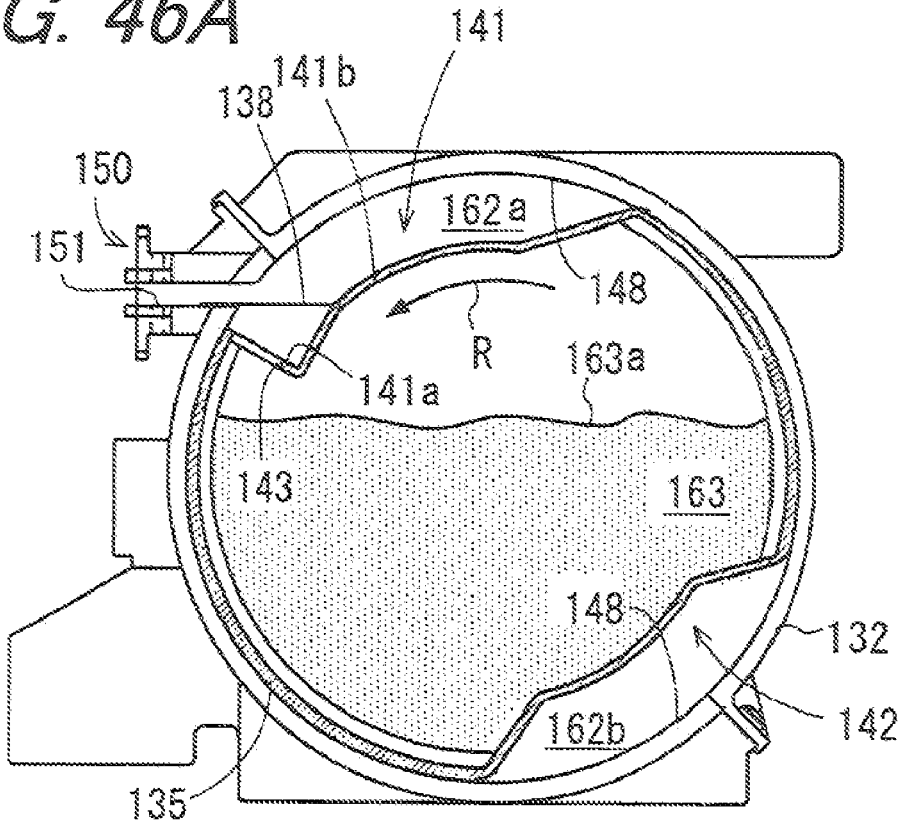
FIGS. 46A and 46B are views for illustrating the behavior in which the developer in the third container portion 135 of the developer container main body 131 is led to the through hole 151 of the supporting member 132 when the developer container main body 131 is rotated in the rotation direction R around the rotation axial line L131.
Figure 46B:
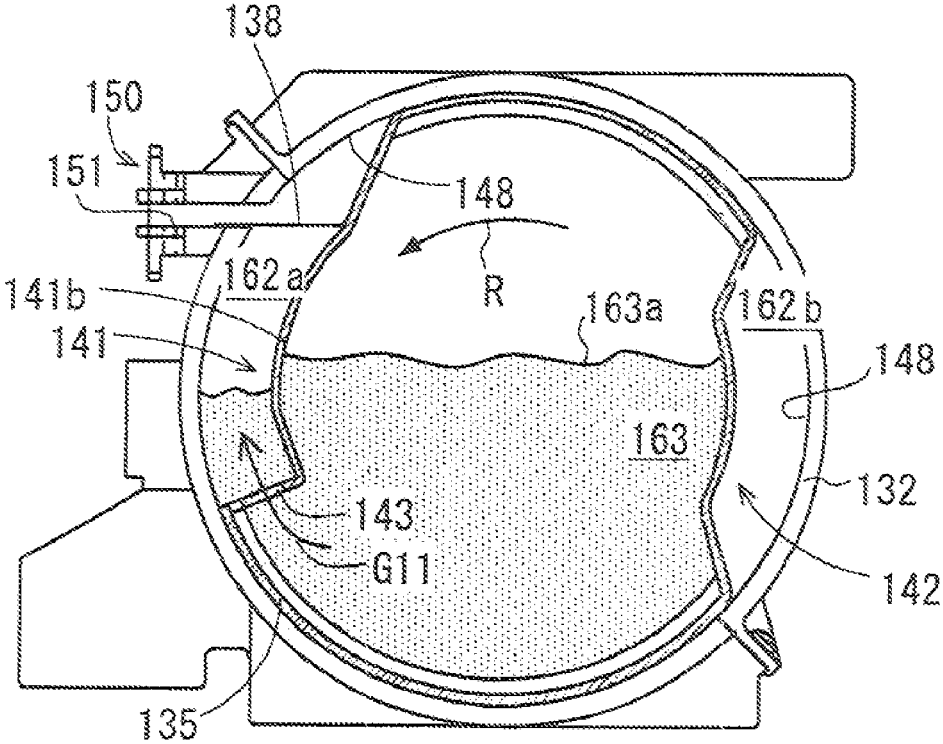

From the state, shown in FIG. 46A, where the exhausting hole 143 and the first holding space 162*a* are positioned above an upper surface 163*a* of the developer layer 163 in the developer container main body 131, the developer container main body 131 is rotated in the rotation direction R until the state shown in FIG. 46B is attained where the exhausting hole 143 and a downstream portion in the rotation direction R of the first holding space 162*a* are positioned below the upper surface 163*a* of the developer layer 163 in the developer container main body 131. Then, the developer of the developer layer 163 in the developer container main body 131 flows into the downstream portion in the rotation direction R of the first holding space 162*a* via the exhausting hole 143, as shown by an arrow G11.

As described above, the exhausting hole 143 is formed in an intermediate portion in the axial line direction of the end wall portion 141*a* of the first recess portion 141 that is outward in the radial direction, so as to be a rectangular opening whose longitudinal direction is the axial line direction. Therefore, the exhausting hole 143 is, in the side wall portion 141*a* of the first recess portion 141, outward in the radial direction from the end on the downstream side in the rotation direction R of the bottom wall portion 141*b* of the first recess portion 141, toward the other end in the axial line direction from the end on the downstream side in the rotation direction R of the first side wall portion 141*c*, and toward the one end in the axial line direction from the end on the downstream side in the rotation direction R of the second side wall portion 141*d*.

For example, when the exhausting hole 143 is opened entirely in the end wall portion 141*a*, the developer is let out from the exhausting hole 143 to the first holding space 162*a* while being forced out densely along the first recess portion 141 of the developer container main body 131 and the inner circumferential portion 148 of the supporting member 132 by the developer container main body 131 being rotated in the rotation direction R. In such a state, by the developer container main body 131 being further rotated in the rotation direction R, the developer held in the first holding space 162*a* may be aggregated by being pressed by the first recess portion 141 of the developer container main body 131 and the inner circumferential portion 148 of the supporting member 132. In this embodiment, as described above, the exhausting hole 143 is formed in a portion of the end wall portion 141*a* of the first recess portion 141. In other words, the exhausting hole 143 can be formed such that the opening area thereof is smaller than the area of the end wall portion 141*a*, so that the developer is let out to the first holding space 162*a* while being diffused near the exhausting hole 143 in the first holding space 162*a*. Thus, the developer that is let out to the second holding space 162*a* can be in powder form, and aggregation of the developer due to the rotation of the developer container main body 131 as described above can be prevented.

Furthermore, the surface on the outer side in the radial direction of the exhausting hole 143 is in smooth communication with the inner circumferential portion 148 of the third container portion 135 excluding the first recess portion 141 and the second recess portion 142 on the downstream side in the rotation direction R of the first recess portion 141. Thus, even if the amount of the developer contained in the developer container main body 131 is small, the developer can flow easily into the downstream portion in the rotation direction R of the first holding space 162*a* via the exhausting hole 143.

Figure 47A:
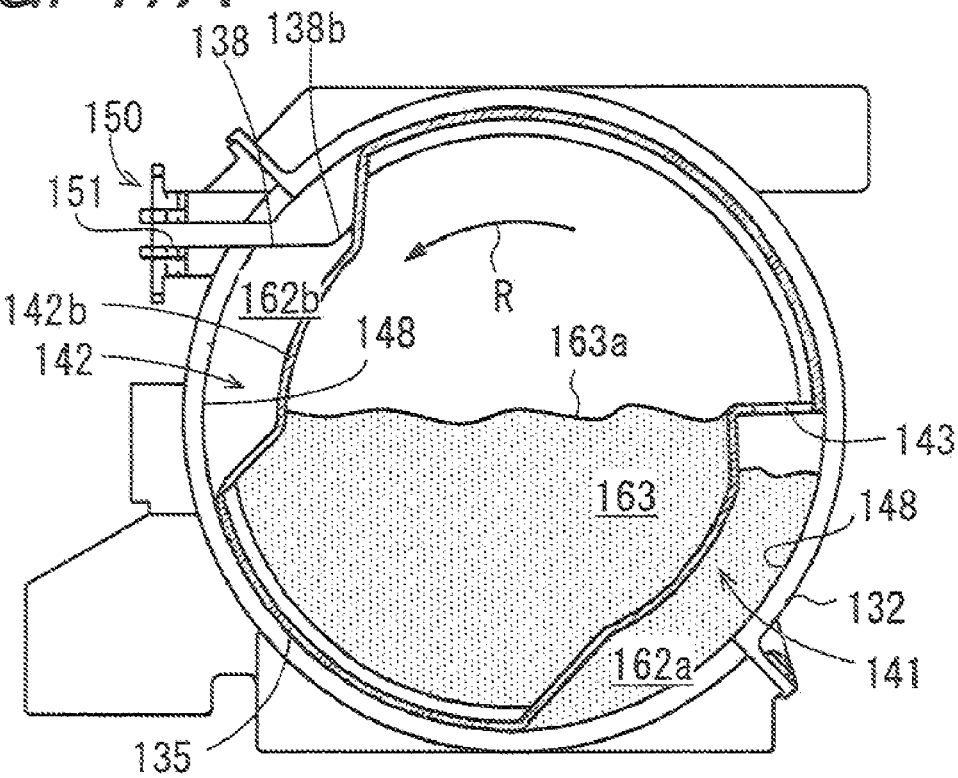
FIGS. 47A and 47B are views for illustrating the behavior in which the developer in the third container portion 135 of the developer container main body 131 is led to the through hole 151 of the supporting member 132 when the developer container main body 131 is rotated in the rotation direction R around the rotation axial line L131.

When the developer container main body 131 further rotates in the rotation direction R from the state shown in FIG. 46B, while the developer of the developer layer 163 in the developer container main body 131 flows in the downstream portion in the rotation direction R of the first holding space 162*a* via the exhausting hole 143, a state as shown in FIG. 47A is achieved in which the exhausting hole 143 is positioned above the upper surface 163*a* of the developer layer 163 in the developer container main body 131, and the first holding space 162*a* is positioned below the upper surface 163*a* of the developer layer 163 in the developer container main body 131. In the state shown in FIG. 47A, the predetermined amount of the developer is held in the first holding space 162*a*. The amount of the developer held in the first holding space 162*a* in this manner may be, for example, 6 g.

Figure 47B:
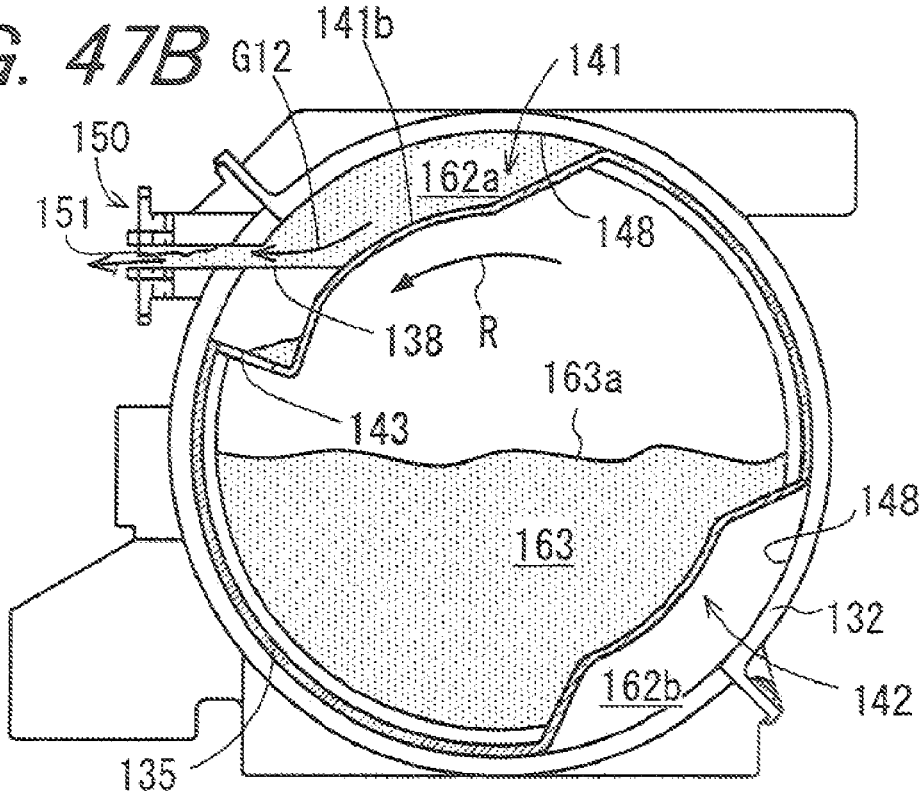

When the developer container main body 131 further rotates in the rotation direction R from the state shown in FIG. 47A, a state as shown FIG. 47B is achieved in which the free end 138*b* of the drawing-out member 138 of the supporting member 132 enters the first holding space 162*a*, extends on the upstream side on the rotation direction R, and slides on the outer circumferential portion of the bottom wall portion 141*b* of the first recess portion 141 while being in contact elastically with the outer circumferential portion with an angle θ of more than 90 degrees. The developer held in the first holding space 162*a* on the upstream side in the rotation direction R from the drawing-out member 138 flows toward the supporting member 132 by the developer container main body 131 being rotated in the rotation direction R.

The drawing-out member 138 guides the developer that has flown therein in this manner, in other words, the developer that has been let out from the exhausting hole 143 of the developer container main body 131, along the upper surface of the drawing-out member 138 out to the through hole 151, as shown by an arrow G12. The drawing-out member 138 slides on the outer circumferential portion of the bottom wall portion 141*b* of the first recess portion 141 while scraping the developer from the outer circumferential portion. Therefore, all the developer held in the first holding space 162*a* can be led out to the through hole 151. Thus, the developer led to the through hole 151 is guided outside the developer container 130 and is let out. In this manner, the predetermined amount of the developer is let out for every rotation of the developer container main body 131 in the rotation direction R around the rotation axial line L131.

The portion of the third container portion 131 excluding the first and the second recess portions 141 and 142 is not entirely contact with the inner circumferential portion 148 of the supporting member 132 throughout the full circumference in the circumferential direction, as described above, in order to reduce a frictional force that prevents the rotation of the developer container main body 131 around the rotation axial line L131. Therefore, as described above, there is not always no risk that the developer held in the first holding space 162*a* may leak from the first holding space 162*a*. As described above, the outlet guide pieces 144 are provided in the outer circumferential portion of the one end in the axial line direction and the other end in the axial line direction excluding the first recess portion 141 and the second recess portion 142 of the third container portion 135. The outlet guide pieces 144 provided in the one end in the axial line direction of the third container portion 135 incline toward the rotation direction R from the other end in the axial line direction to the one end the axial line direction. The outlet guide pieces 144 provided in the other end in the axial line direction of the third container portion 135 incline toward the rotation direction R from the one end in the axial line direction to the other end the axial line direction. Therefore, in an event that the developer held in the first holding space 162*a* leaks to one side and the other side in the rotation axial line L132, when the developer container main body 131 is rotating in the rotation direction R, the developer can be gathered to an intermediate portion in the axial line direction of the third container portion 135 and the supporting member 132 by the outlet guide pieces 144.

Since the second holding space 162*b* is formed as described above, in an event that the developer held in the first holding space 162*a* leaks from the upstream in the rotation direction R of the first holding space 162*a*, the developer that has leaked out in this manner and the developer that was gathered to an intermediate portion in the axial line direction by the outlet guide pieces 144 are held in the second holding space 162*b*. When the developer container main body 131 is rotated in the rotation direction R, a state as shown FIG. 47A is achieved in which the free end 138*b* of the drawing-out member 138 of the supporting member 132 enters the second holding space 162*b*, extends on the upstream side on the rotation direction R, and slides on the outer circumferential portion of the bottom wall portion 142*b* of the second recess portion 142 while being in contact elastically with the outer circumferential portion thereof with an angle θ of more than 90 degrees. The developer held in the second holding space

162*b* on the upstream side in the rotation direction R from the drawing-out member 138 flows toward the supporting member 132 by the developer container main body 131 being rotated in the rotation direction R, is guided to the through hole 151 and let outside the developer container 130. Thus, even if the developer leaks out from the first holding space 162*a*, the leaked developer is held by the second holding space 162*b*, and therefore the predetermined amount of the developer can be let out as reliably as possible for every rotation of the developer container main body 131 in the rotation direction R around the rotation axial line L131.

As described above, in a state where the support stand 149 is installed on the horizontal plane, in the supporting member 132, an outlet portion 150 projecting to one direction of a first horizontal direction F11, which is one direction of one horizontal direction is formed in its upper portion. In an intermediate portion in the axial line direction of the supporting member 132 in the outlet portion 150, a through hole 151 that penetrates along the one direction of the first horizontal direction F11, and is an elliptic opening extending in a direction parallel to the axial line L132 of the supporting member is formed. Thus, even if the developer container main body 131 is filled with the developer, the upper surface 163*a* of the developer layer 163 is disposed in the same height as the through hole 151, or below the through hole 151, so that it is ensured that the developer is prevented from undesirably flowing out from the developer container main body 131 to the through hole 151.

Figure 48:
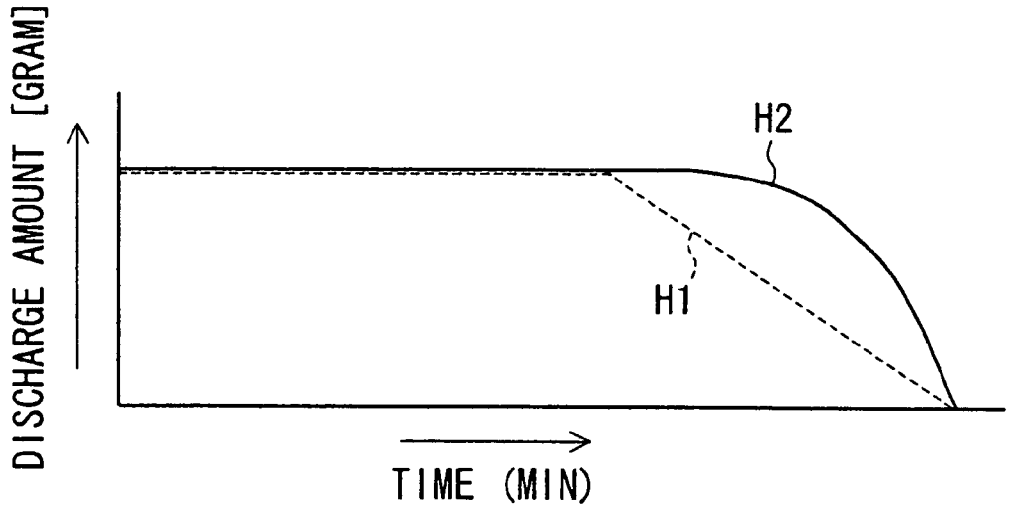
FIG. 48 is a graph showing the relationship between the amount of the developer that is let out from the developer container 130 and the time.

FIG. 48 is a graph showing the relationship between the amount of the developer that is let out from the developer container 130 and the time. In FIG. 48, a curve H1 shows the relationship between the amount of the developer that is let out from the developer container 130 and the time when the inner diameter D135 of the third container portion 135 of the developer container main body 131 is formed so as to be equal to or smaller than the inner diameters D133 and D134 of the first and the second container portions 133 and 134. A curve H2 shows the relationship between the amount of the developer that is let out from the developer container 130 and the time when the inner diameter D135 of the third container portion 135 of the developer container main body 131 is formed so as to be larger than the inner diameters D133 and D134 of the first and the second container portions 133 and 134.

The powdered developer has a property that even if the developer is mounted on a horizontal surface in a sharp hill shape, the hill shape immediately becomes moderate. For example, in the case where the inner diameter D135 of the third container portion 135 of the developer container main body 131 is formed so as to be equal to or smaller than the inner diameters D133 and D134 of the first and the second container portions 133 and 134, the developer conveyed toward the exhausting hole 143 by the rotation of the developer container main body 131 becomes away from the exhausting hole 143 when the rotation of the developer container main body 131 stops. In this case, when the amount of the developer contained in the developer container main body 131 becomes very small, it is difficult to convey a sufficient amount of the developer toward the exhausting hole 143 immediately after the rotation of the developer container main body 131 is started again.

In this embodiment, as shown in FIG. 34, the inner diameter of the third container portion 134 of the developer container main body 131 is formed so as to be larger than the inner diameters D133 and D134 of the first and the second container portions 133 and 134, which are remaining portions. Therefore, it is prevented as much as possible that when the amount of the developer contained in the developer container main body 131 becomes very small, the developer conveyed to the third container portion 135 becomes away from the third container portion 135. Thus, even if the amount of the developer contained in the developer container main body 131 becomes very small, a sufficient amount of the developer can be conveyed toward the exhausting hole 143 as much as possible, immediately after the rotation of the developer container main body 131 is started again. Furthermore, all the developer contained in the developer container main body 131 can be let out as much as possible.

In the case where, as shown in the curve H1, the inner diameter D135 of the third container portion 135 of the developer container main body 131 is formed so as to be equal to or smaller than the inner diameters D133 and D134 of the first and the second container portions 133 and 134, when the amount of the developer contained in the developer container main body 131 is reduced, the amount of the developer that is let out is accordingly reduced sharply. On the other hand, in the case where, as shown in the curve H2, the inner diameter D135 of the third container portion 135 of the developer container main body 131 is formed so as to be larger than the inner diameters D133 and D134 of the first and the second container portions 133 and 134, even if the amount of the developer contained in the developer container main body 131 is reduced, the amount of the developer that is let out is kept substantially constant until the amount of the developer has approached zero, as opposed to the curve H1. Therefore, the developer container 130 of this embodiment makes it possible to let out the developer stably for a long time.

Figure 49:
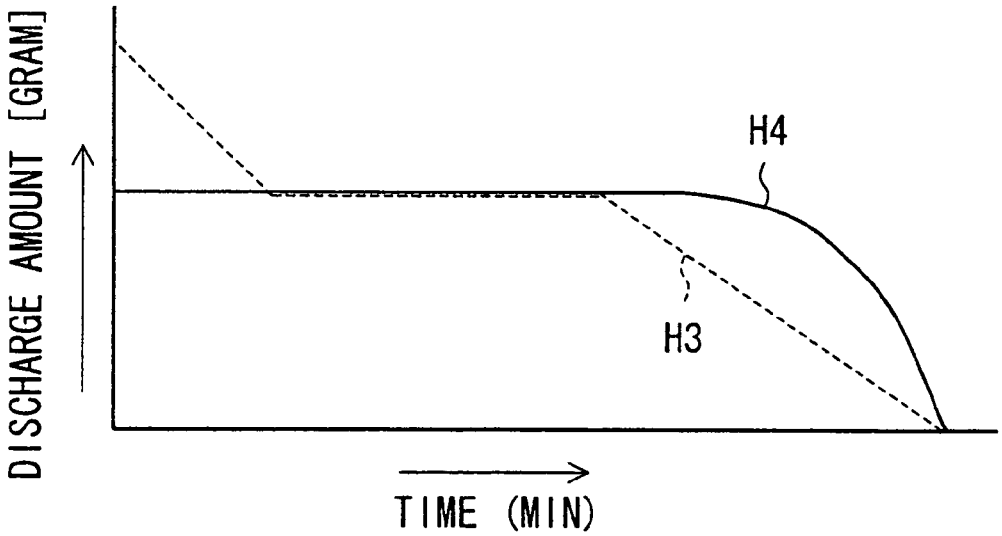
FIG. 49 is another graph showing the relationship between the amount of the developer that is let out from the developer container 130 and the time.

FIG. 49 is another graph showing the relationship between the amount of the developer that is let out from the developer container 130 and the time. In FIG. 49, a curve H3 shows the relationship between the amount of the developer that is let out from the developer container 130 and the time when the through hole 151 is positioned below the axial line L131 of the developer container main body 131 in a state where the container is mounted in an image forming apparatus 70A, 70B, which will be described later. A curve H4 shows the relationship between the amount of the developer that is let out from the developer container 130 and the time when the through hole 151 is positioned above the axial line L131 of the developer container main body 131 in a state where the container is mounted in an image forming apparatus 70A, 70B.

In the case where, as shown in the curve H3, the through hole 151 is positioned below the axial line L131 of the developer container main body 131 in a state where the container is mounted in an image forming apparatus 70A, 70B, when the amount of the developer contained in the developer container main body 131 is large, the amount of the developer that is let out is also large. When the amount of the developer contained in the developer container main body 131 is reduced, the amount of the developer that is let out is accordingly reduced sharply. On the other hand, in the case where, as shown in the curve H4, the through hole 151 is positioned above the axial line L131 of the developer container main body 131 in a state where the container is mounted in an image forming apparatus 70A, 70B, even if the amount of the developer contained in the developer container main body 131 is reduced, the amount of the developer that is let out is kept substantially constant until the amount of the developer has approached zero, as opposed to the curve H3. Therefore, the developer container 130 of this embodiment makes it possible to let out the developer stably for a long time.

Furthermore, in the developer container 130, when the developer is full in a state where the container is mounted in an image forming apparatus 70A, 70B, the vertical position of the upper surface 163*a* of the developer layer 163 is at substantially the same position as the through hole 151 or below the through hole 151. Therefore, as shown in the curve H4 of FIG. 49, the amount of the developer that is let out with a good flowability can be suppressed. The experiments by the inventors revealed the following. In the case where an angle ϕ of a virtual straight line 210 connecting the axial line L131 of the developer container main body 131 and the center of the through hole 151 with respect to a horizontal plane 211 is less than 30 degrees in a state where the container is mounted in an image forming apparatus 70A, 70B, when a large amount of the developer is contained in the developer container 130, the amount of the development that is let out tends to be large. In the case where the angle ϕ exceeds 70 degrees, when the amount of the developer contained in the developer container 130 is reduced, the amount of the development that is let out tends to be small.

According to the developer container 130 of this embodiment, the developer container main body 131 can be rotated around the rotation axial line L131 while being supported stably by the supporting member 132. When a cylindrical container as a conventional technique in which a developer is contained is left upright such that its axial line is vertical to the horizontal plane, there is a risk that the developer in a lower portion of the container may aggregate. When the container is installed on the horizontal plane such that its axial line is parallel to the horizontal plan in order to prevent such aggregation of the developer as much as possible, the container rolls over. In the developer container 130 of this embodiment, the support stand 149 of the supporting member 132 is installed on the horizontal plane, so that the container can be placed stably such that the axial line L131 of the developer container main body 131 is parallel to the horizontal plane. Even if the developer contained in the developer container 130 partially aggregate, for example, by the user rotating the developer container main body 131 with the shutter 165*a* of the shutter portion 165 being at the closed position P1, the developer can be easily agitated to become a powdered form.

Furthermore, the surfaces 133*c* and 134*c* where the outer circumferential surfaces of both the ends 133*a* and 134*a* in the axial line direction of the developer container main body 131 are in communication with the end faces thereof are formed into curved surfaces that incline inward in the radial direction, as described above. Therefore, even if it is attempted to install either one of the opposite ends 133*a* and 134*a* in the axial line direction of the developer container main body 131 and to put the developer container 130 upright on the horizontal plane such that the axial line L131 is perpendicular to the horizontal plane, the container easily falls down. Thus, the user is prevented from putting the developer container 130 upright such that the axial line L131 is perpendicular to the horizontal plane and leaving the container as it is, so that factors that cause the contained developer to aggregate can be reduced.

According to the developer container 130 of this embodiment, the supporting member 132 supports at least a portion including the third container portion 135 of the developer container main body 131 throughout the full circumference from the outer side in the radial direction. Furthermore, two sealing materials 147 are provided between the developer container main body 131 and the supporting member 132, and thus sealing is achieved as described above. Therefore, even if the developer container main body 131 is rotated, the developer is prevented from leaking out from between the developer container main body 131 and the supporting member 132.

According to the developer container 130 of this embodiment, the amount of the developer that is let out depends on the volume of the first holding space 162*a* and the rotation speed of the developer container main body 131. In the developer container 130 of this embodiment, for recess portions, two recess portions, that is, the first and the second recess portions 141 and 142 are provided, and the exhausting hole 143 is provided only in the first recess portion 141. However, there is no limitation thereto. For example, it is desired to increase the amount of the developer that is to be let out per one rotation of the developer container main body 131, the second recess portion 142 may be configured to have the same shape as the first recess portion 141 and is provided with the exhausting hole 143. The number of the recesses and the number of the exhausting holes may be increased.

Figure 50:
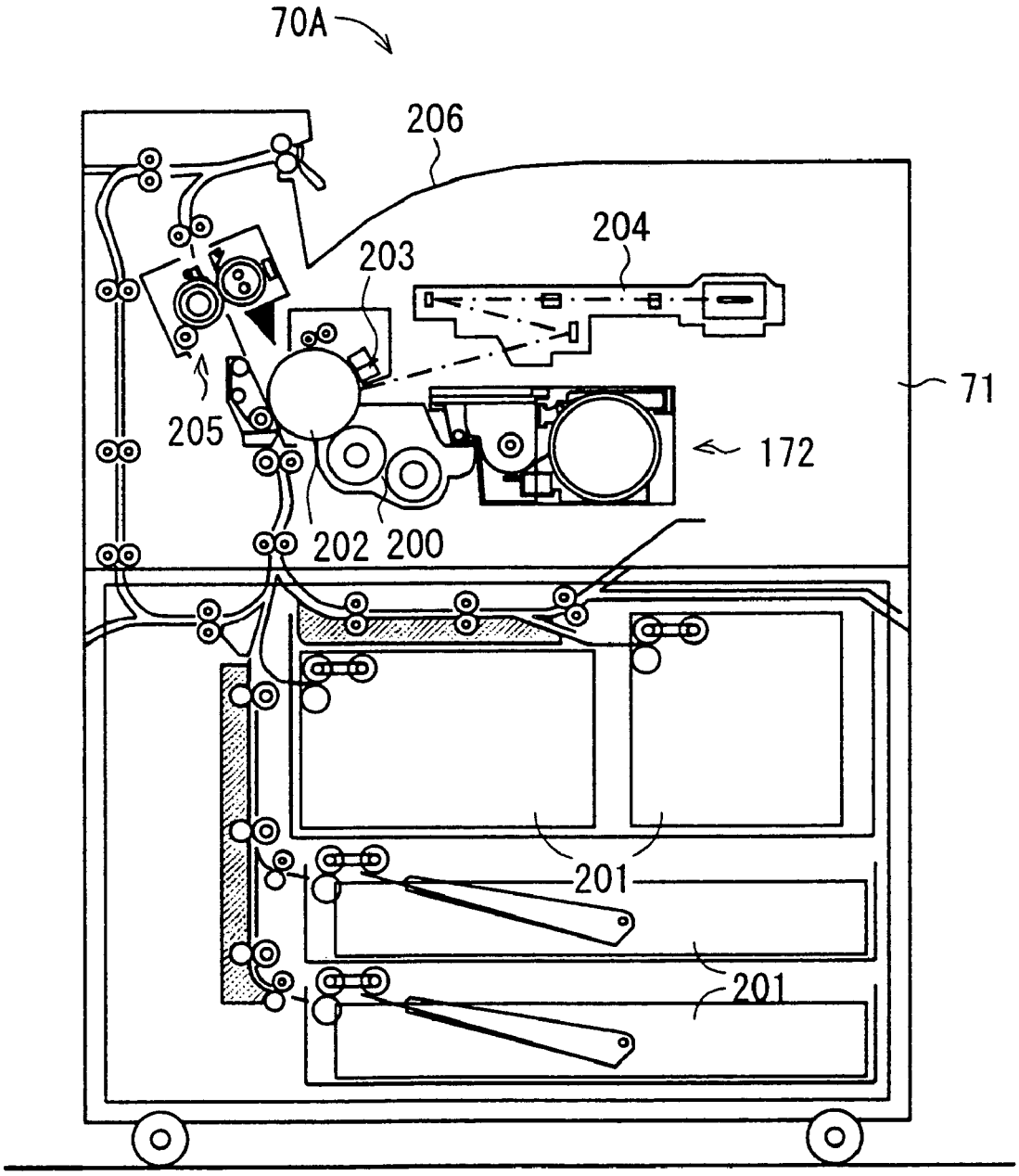
FIG. 50 is a cross-sectional view showing an image forming apparatus of a fourth example embodiment.
Figure 51:
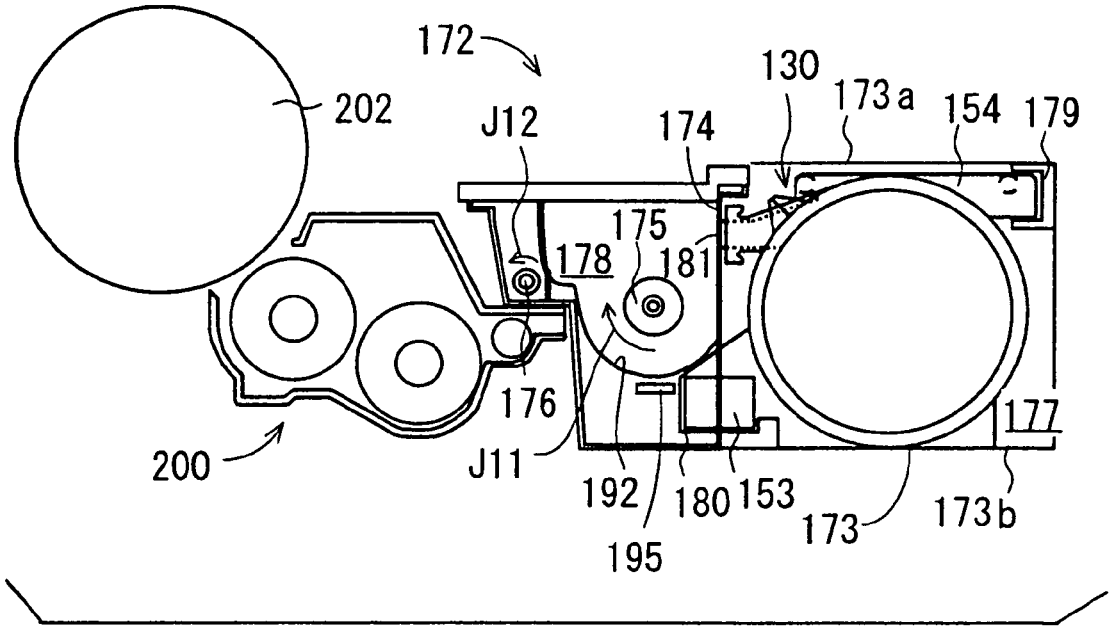
FIG. 51 is a cross-sectional view showing an enlarged portion in the vicinity of a toner hopper 172.
Figure 52:
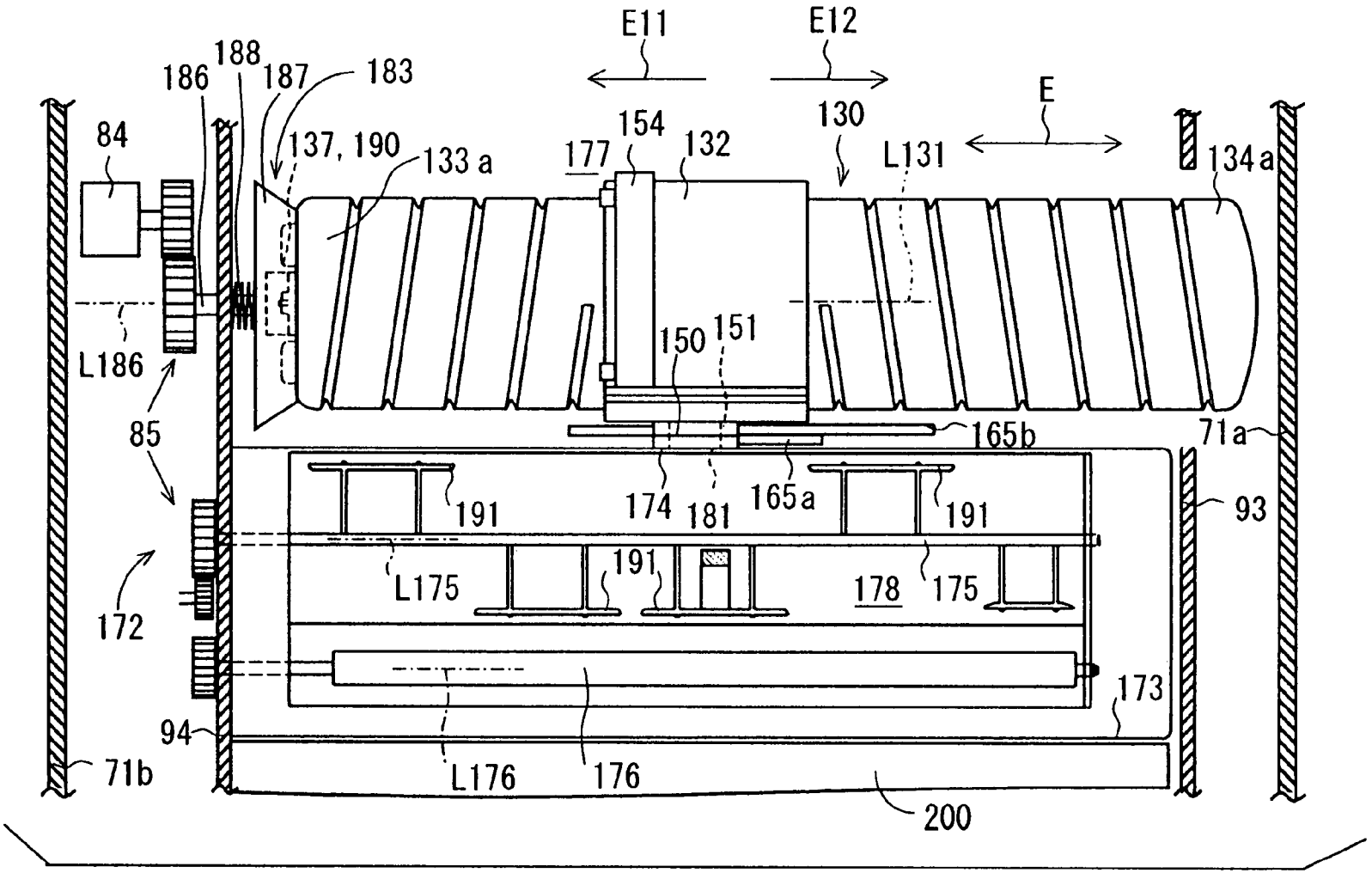
FIG. 52 is a plan view showing an enlarged portion in the vicinity of the toner hopper 172.

FIG. 50 is a cross-sectional view showing an image forming apparatus 70A of a fourth example embodiment of the technology disclosed herein. FIG. 51 is a cross-sectional view showing an enlarged portion in the vicinity of a toner hopper 172. FIG. 52 is a plan view showing an enlarged portion in the vicinity of the toner hopper 172. FIG. 50 is a cross-sectional view of the image forming apparatus 70A viewed from the side of a front jacket portion 71*a*, and for easy understanding, the thickness is not shown. It is assumed that the image forming apparatus 70A is installed on the horizontal plane and the front-back direction E, which is a direction from the front jacket portion 71*a* to the back jacket portion 71*b*, is parallel to the horizontal plane. In this embodiment, the portions corresponding to those in the above-described embodiment bear the same reference and the description thereof is omitted.

The electrophotographic image forming apparatus 70A such as a printer and a copier includes the developer container 130 and the main body of the image forming apparatus (hereinafter, referred to as "apparatus main body") 71. The developer container 130 is attached removably to the toner hopper 172 provided in the apparatus main body 71 via an openable container attach/remove port (not shown) that is provided in the front jacket portion 71*a* of the apparatus main body 71. The image forming apparatus main body 71 is provided with a housing front portion 93 on the back jacket portion 71*b* side from the front jacket portion 71*a*, and an opening that penetrates the apparatus main body in the thickness direction through which the developer container 130 is to be inserted is formed. Furthermore, the image forming apparatus main body 71 is provided with a housing back portion 94 on the front jacket portion 71*a* side from the back jacket portion 71*b*. Various structures of the image forming apparatus main body 71 are held by the housing (not entirely shown) including the housing front portion 93 and the housing back portion 94.

The toner hopper 172 includes a housing 173, a developer supply portion 174, an agitating member 175 and a supply roller 176. The inner space in the housing 173 is divided at least into a container housing space 177 and an agitating space 178 by the developer supply portion 174. The container housing space 177 is open facing the front jacket portion 71*a* of the apparatus main body 71. The agitating space 178 is a substantially closed space. The developer container 130 is disposed in the container housing space 177.

A first guide recess 179 extending in the front-back direction E of the apparatus main body 71 and with which the second guide piece 154 of the supporting member 132 of the developer container 130 can be engaged is formed on an upper wall portion 173*a* of the housing 173 facing the container housing space 177. The guide recess 179 can be engaged with the second guide piece 154 of the supporting member 132 of the developer container 130 slidably in the longitudinal direction, that is, an attaching direction E11, which is parallel to the front-back direction E of the apparatus main body 71 and a direction from the front jacket portion 71*a* to the back jacket portion 71*b*, and a removing direction E12, which is opposite to the attaching direction E11. Furthermore, a second guide recess 180 extending in the front-back direction E of the apparatus main body 71 and with which the first guide piece 153 of the supporting member 132 of the developer container 130 can be engaged is formed on a lower wall portion 173*b*, which is opposed to the upper wall portion 173*a*, of the housing 173 facing the container housing space 177. The guide recess 180 can be engaged with the first guide piece 153 of the supporting member 132 of the developer container 130 slidably in the longitudinal direction, that is, the attaching direction E11 and the removing direction E12 of the apparatus main body 71.

The developer supply portion 174 is a plate-like member that divides the inner space of the housing 173 into the container housing space 177 and the agitating space 178, and is provided with a communication hole 181 that penetrates the developer supply portion in its thickness direction and communicates between the container housing space 177 and the agitating space 178.

Figure 53:
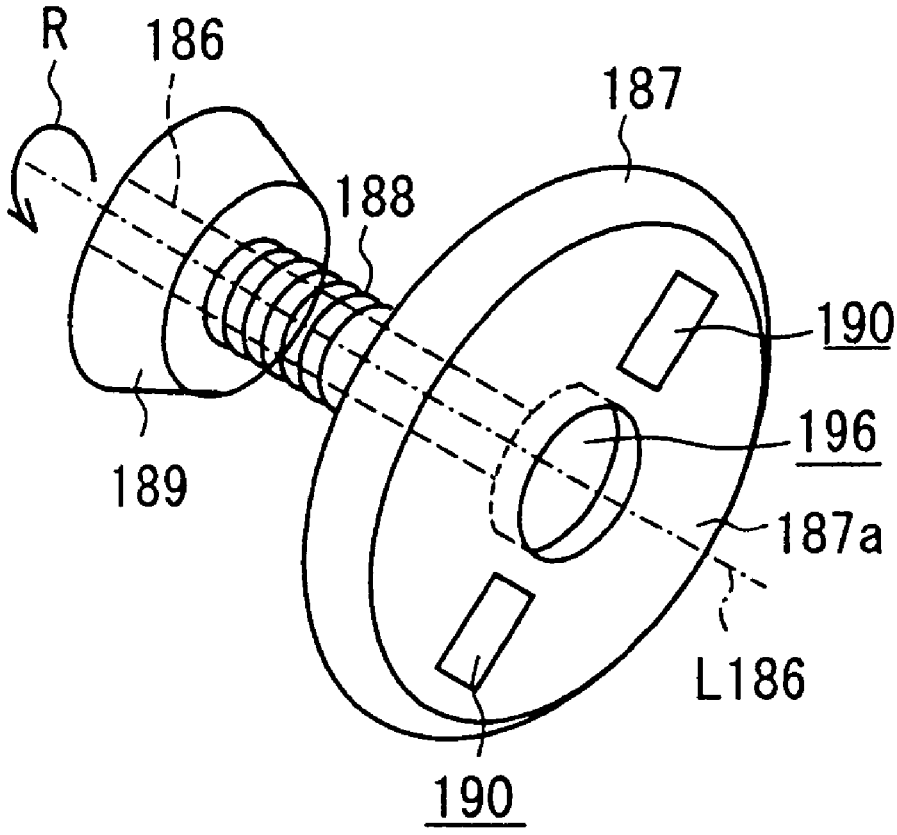
FIG. 53 is a perspective view showing an enlarged portion of the main body side coupling portion 183.

FIG. 53 is a perspective view showing an enlarged portion of the main body side coupling portion 183. The driving force for rotating the developer container main body 131 of the developer container 130 from a driving source 84 such as a motor of the apparatus main body 71 is transmitted to the main body side coupling portion 183 via a speed reducer 85 such as a gear. The main body side coupling portion 183 includes a rotation shaft 186, a coupler receiving portion 187 and a spring member 188. The rotation shaft 186 is inserted rotatably in a shaft receiving portion 189 that is provided penetrating, in the thickness direction, the housing back portion 94, which is the back wall portion of the housing 173 on the back jacket portion 71*b* side of the apparatus main body 71, with its axial line L186 being parallel to the front-back direction E of the apparatus main body 71, and its free end is disposed in the container housing space 177.

The coupler receiving portion 187 is formed into an approximate disk shape, faces the container housing space 177, and is coupled to the free end of the rotation shaft 186 rotatably around the axial line L186 along with the rotation shaft 186. In a central portion of a surface portion 187*a* opposite to the surface portion facing the housing back portion 94 of the coupler receiving portion 187, an auxiliary recess 196 that is recessed on the housing back portion 94 side having the axial line L186 of the rotation shaft 186 as its axial line and with which a replenish port 145 having the replenish lid 146 of the developer container 130 attached can be engaged is provided. Furthermore, a plurality of (two in this embodiment) engaging recesses 190 that are recessed on the housing back portion 94 side and disposed in symmetrical positions with respect to the axial line L186 of the rotation axial line L186 are formed in an outer portion in the radial direction than the auxiliary recess 196 in the surface portion 187*a* of the coupler receiving portion 187. These engaging recesses 190 have a shape each corresponding to the engaging projecting portion 137 of the developer container main body 131, and the engaging projecting portions 137 are engaged with the engaging recesses 190 by inserting each of the engaging projecting portions 137 of the developer container main body 131 into the engaging recess 190.

The coupler receiving portion 187 is displaceable in the axial line direction of the rotation shaft 186 without falling off from the free end of the rotation shaft 186. The spring member 188 that is realized by a compression coil spring or the like is disposed between the housing back portion 94 and the coupler receiving portion 187, and biases the coupler receiving portion 187 to a direction that allows the coupler receiving portion 187 to be away from the housing back portion 94 without preventing the rotation of the rotation shaft 186 and the coupler receiving portion 187. A coupling structure is formed by one end 133*a* in the axial line direction including the engaging projecting portion 137 of the developer container main body 131 of the developer container 130 and the coupler receiving portion 187 of the main body side coupling portion 183. Therefore, the engaging projecting portions 137 of the developer container main body 131 can be coupled removably to the coupler receiving portion 187 of the main body coupling portion 183.

When attaching the developer container 130 to the apparatus main body 71, the developer container 130 is inserted in the container housing space 177 of the toner hopper 172 from the front jacket portion 71*a* of the apparatus main body 71 with the rotation axial line L131 being parallel to the attaching direction E11. In this case, the first guide piece 153 of the supporting member 132 of the developer container 130 is engaged with the first guide recess 179 of the housing 173, and the second guide piece 154 of the supporting member 132 is engaged with the second guide recess 180 of the housing 173, so that a displacement of the supporting member 132 to directions except the attaching direction E11 and the removing direction E12 is prevented. In this sate, the developer container 130 is displaced to the attaching direction E11 so as to be positioned at the attaching position, at which the through hole 151 of the outlet portion 150 of the supporting member 132 is in communication with the communication hole 181 of the developer supply portion 174. In this case, the coupler receiving portion 187 of the main body side coupling portion 183 is pressed by the engaging projecting portion 137 of the developer container main body 131 to the attaching direction E11 and withdrawn, and thus the spring member 188 is compressed.

A regulating member (not shown) for regulating the displacement of the supporting member 132 to the attachment direction E11 and the removing direction E12 and canceling the regulation in a state where the developer container 130 is disposed in the attachment position is provided in the toner hopper 172. When all the developer contained in the developer container 130 has been let out, the user cancels the regulation of the supporting member 132 by the regulating member so that the developer container 130 is displaced to the removing direction E12, and thus the developer container 130 is removed from the apparatus main body 71.

Shutter displacing means (not shown) for sliding the shutter 165*a* of the shutter portion 165 of the developer container 130 is provided in the periphery of the communication hole 181 facing the container housing space 177 of the developer supply portion 174 of the toner hopper 172. In inserting the developer container 130 into the container housing space 177 of the toner hopper 172 from the front jacket portion 71*a* of the apparatus main body 71 with the rotation axial line L131 being parallel to the attaching direction E11, when the shutter displacing means lets the shutter 165*a* positioned at the closed position P1 slide to the one direction of the second horizontal direction B11 so that the developer container 130 is positioned at the attachment position, then the shutter 165*a* is positioned at the open position P2. When the developer container 130 positioned at the attachment position that is attached to the apparatus main body 71 is displaced to the removing direction E12 so that the developer container 130 is removed from the apparatus main body 71, the shutter displacing means lets the shutter 165*a* positioned at the open position P2 slide to the other direction of the second horizontal direction B12 so that the shutter is positioned at the closed position P1.

A sealing material (not shown) for preventing the developer flowing from the through hole 151 to the communication hole 181 from leaking to portions except the agitating space 178 is provided at least either at the periphery of the through hole 151 of the outlet portion 150 of the supporting member 132 of the developer container 130 or the periphery of the communication hole 181 facing the container housing space 177 of the developer supply portion 174 of the toner hopper 172.

As shown in FIG. 52, the main body side coupling portion 183 and the driving portion such as the driving source 84 and the speed reducer 85 for rotating the agitating member 175 and the supply roller 176 are disposed between the housing back portion 94 and the back jacket portion 71*b* in the apparatus main body 71. Therefore, when the developer container 130 is disposed in the attachment position, the supporting member 132 of the developer container 130 is disposed in the central portion in the front-back direction E in the apparatus main body 71. In the developer container 130, the length from the supporting member 132 of the developer container main body 131 to the end face of the one end 133*a* in the axial line direction in which the engaging projecting portion 137 is formed is smaller than the length from the supporting member 132 to the end face of the other end 134*a* in the axial line direction, as described above.

For example, in the case of the toner bottle 15, as the first conventional technique shown in FIGS. 60A and 60B, that has, in one end 15*a* in the axial line direction, the opening 18 through which the developer is let out and that is coupled to the driving source, the opening 18 is provided near the developer supply portion, that is, in an intermediate portion in the front-back direction in the image forming apparatus main body. In this case, the size of the conventional toner bottle 15 in the axial line direction is set based on the size from the intermediate portion in the front-back direction to the front portion of the image forming apparatus main body, so that it is difficult to increase the capacity of the container.

In the developer container 130 in the image forming apparatus 70A of this embodiment, the supporting member 132 is disposed substantially in the intermediate portion in the axial line direction of the developer container main body 131. Therefore, when the developer container is attached to the attachment position in the image forming apparatus main body 71, the supporting member 132 is disposed in an intermediate portion in the front-back direction E of the apparatus main body 71. Thus, the developer container main body 131 can be extended from an intermediate portion in the front-back direction E to the front portion of the apparatus main body 71 and extended from the intermediate portion in the front-back direction E to the back portion, and thus the capacity can be increased significantly compared with the conventional toner bottle 15. In this embodiment, as shown in FIG. 51, the other end 134*a* in the axial line direction of the developer container 130 is projected to the front jacket portion 71*a* from the housing front portion 93.

When the length from the supporting member 132 of the developer container main body 131 to the end face of the one end 133*a* in the axial line direction is smaller than the length from the supporting member 132 to the end face of the other end 134*a* in the axial line direction, a region in which the driving portion including the driving source 84 and the speed reducer 85 that is coupled to the engaging projecting portion 137 of the one end 133*a* in the axial line direction of the developer container main body 131 are provided can be ensured in the back portion of the apparatus main body 71. Thus, the developer container 130 has two incomparable effects of utilizing the space in the apparatus main body 71 efficiently and increasing the housing amount of the developer as much as possible.

Thus, when the developer container 130 is disposed in the attachment position and coupler receiving portion 187 is rotated by driving the driving source 84, in the state where the engaging recess 190 of the coupler receiving portion 187 is engaged with the engaging projecting portion 137 of the developer container 130, the developer container main body 131 is rotated around the rotation axial line L131. In the state where the engaging recess 190 of the coupler receiving portion 187 is not engaged with the engaging projecting portion 137 of the developer container 130, only the coupler receiving portion 187 is angularly displaced for awhile until the engaging recess 190 of the coupler receiving portion 187 is engaged with the engaging projecting portion 137 of the developer container 130. When the engaging recess 190 of the coupler receiving portion 187 is engaged with the engaging projecting portion 137 of the developer container 130, the spring force is applied by the spring member 188 so that the engaging recess 190 of the coupler receiving portion 187 and the engaging projecting portion 137 of the developer container 130 are engaged with each other tightly. Thus, the developer container main body 131 is rotated around the rotation axial line L131. When the developer container main body 131 of the developer container 130 is rotated around the rotation axial line L131 in this manner, the developer contained in the developer container 130 is supplied to and contained in the agitating space 178 via the through hole 151 of the outlet portion 150 of the supporting member 132 and the communication hole 181 of the developer supply portion 174 of the toner hopper 172.

The agitating member 175 and the supply roller 176 are spaced away from each other and extend in the front-back direction E of the apparatus main body 71, and are disposed in the agitating space 178. The agitating member 175 is rotatable around the agitation axial line L175 that is parallel to the front-back direction E, and has a flexible scraping-out member 191 extending in the agitation axial line L175. The agitating member 175 is rotated in the clockwise direction J11 around the agitation axial line L175 when viewed from the front of the apparatus main body 71 by the driving force from the driving source 84 provided in the apparatus main body 71. The supply roller 176 is rotatable around the supply axial line L176 that is parallel to the front-back direction E, and its outer circumferential surface is made of, for example, a porous resin, such as a sponge. The supply roller 176 is rotated in the clockwise direction J12 around the agitation axial line L176 when viewed from the front of the apparatus main body 71 by the driving force from the driving source 84 provided in the apparatus main body 71.

An agitation wall portion 192 is provided that faces the agitating space 178 of the toner hopper 172, is in communication with the developer supply portion 174, extends in the front-back direction E of the apparatus main body 71, whose cross section taken along a plane perpendicular to the agitation axial line L175 of the agitating member 175 is approximately U-shaped, and that is formed into a partial cylindrical inner circumferential shape that is open upward. The developer is supplied from a single communication hole 181 to the agitating space 178. However, as described above, the developer let out from the developer container 130 is not only agitated, but also mixed with a gas and becomes fine powder, and therefore has good flowability. Therefore, even if the developer is supplied only from the communication hole 181, the developer can be diffused in the agitation axial line L175 in the agitating space 178. The developer contained in the agitating space 178 is diffused further in the agitation axial line L175 direction in the agitating space 178 by the agitation of the agitating member 175.

When the agitating member 175 is rotated, the developer that is supplied from communication hole 181 and contained in the agitating space 178 is agitated, and the scraping-out member 191 scrapes the developer contained in the agitating space 178 while its free end is in contact with the agitation wall portion 192, and supplies the developer to the supply roller 176. Therefore, a fine powdery developer can be supplied to the supply roller 176 substantially uniformly in its axial line L176. Even if the remaining amount of the developer contained in the agitating space 178 becomes small, the scraping-out member 191 scrapes the developer and supplies the developer to the supply roller 176. Therefore, the developer that remains in the agitating space 178 without being supplied to the supply roller 176 can be reduced as much as possible. The developer supplied to the supply roller 176 is supplied to the developing portion 200 in a good condition by the rotation of the supply roller 176.

In order to keep the toner concentration of the two-component developer in the developing portion 200, the supply roller 176 has the outer circumferential portion formed of a sponge, and its rotation is controlled. Thus, the supply roller 176 supplies a toner in an appropriate amount in the form of fine powder to the developing portion 200.

Hereinafter, the control of the developer container main body 131 of the developer container 130 and the agitating member 175 and the supply roller 176 of the toner hopper 172 will be briefly described. When a portion 195 for detecting a toner remaining amount that is provided in the agitating wall portion 192 has detected that the developer (hereinafter, also referred to as "toner") contained in the agitating space 178 of the toner hopper 172 is running short, a controller (not shown) controls the driving source 84 so as to rotate the developer container main body 131 of the developer container 130 so that a toner is supplied to the agitating space 178. When it is detected by the toner-remaining amount detecting portion 195 that the toner contained in the agitating space 178 is not yet full after the developer container main body 131 has been rotated for a predetermined period, the controller stops the rotation of the developer container main body 131 and displays a message meaning that the developer container 130 should be replaced on a display portion (not shown) to notify the user. At this point, a considerable amount of developer is contained in the agitating space 178 of the toner hopper 172. The user removes the developer container 130 that is empty from the apparatus main body 71 while the developer is still contained in the agitating space 178 of the toner hopper 172, and attaches a new developer container 130 containing a developer to the apparatus main body 71. Thus, even if the image forming apparatus 70A is in the process of forming an image on recording paper, the developer can be replenished to the apparatus main body 71 without interrupting the image forming work, because the developer in an amount necessary to form the image is contained in the agitating space 178 of the toner hopper 172.

In the first conventional technique shown in FIG. 59, it is necessary to replace the toner cartridge 1 that is not only very large but also heavy. However, in this embodiment, it is sufficient to replace only the developer container 130, and it is sufficient that the user inserts the developer container to the container housing space 177 of the toner hopper 172 from the housing front portion 93 of the apparatus main body 71 to the attaching direction E11, from the first container portion 133 provided with the engaging projecting portion 137 while holding, for example, the supporting member 132 and the second container portion 134 of the developer container 130. This is very simple. When removing the developer container 130 from the apparatus main body 71, it is sufficient that the user pulls out the developer container to the removing direction E12 while holding the second container portion 134 of the developer container 130, which is very simple.

In order to prevent the contained developer from aggregating by agitating the developer, conventionally, the user used to swing the heavy and large toner cartridge 1 vertically and horizontally. However, in the developer container 130 of this embodiment, it is sufficient that the user rotates the developer container main body 131 around the rotation axial line L131, which is easy. In the developer container 130 of this embodiment, the structure for agitating the contained developer is much simpler than that of the conventional toner cartridge 1. The developer container 130 achieves sealing between the container body 131 and the supporting member 132, and when the developer container 130 is attached to the attachment position of the apparatus main body 71, sealing is achieved at least either at the periphery of the through hole 151 of the outlet portion 150 or the periphery of the communication hole 181 of the developer supply portion 174 that are in communication with each other, so that the developer can be prevented from leaking in the container housing space 177 of the toner hopper 172 as much as possible. Therefore, when the user replaces the developer container 130, the hands can be prevented from becoming dirty with the developer as much as possible.

Furthermore, since the developer container 130 is substantially cylindrical, the developer container can be housed in an elongated rectangular solid packing box, and can be transported and stored more easily than the first conventional toner cartridge 1.

In the developer container 130, the amount of the developer that is let out per one rotation of the developer container main body 131 is as constant as possible without increasing very much the rotational force to rotate the developer container main body 131, as described above. Thus, it is possible to supply the developer to the agitating space 178 of the toner hopper 172 even at a low speed without the necessity of increasing the rotational speed of the developer container main body 131. It is possible to supply the developer to the agitating space 178 with the amount of the developer that is let out per one rotation of the developer container main body 131 being as constant as possible. The torque of the driving source 84 can be reduced, and a small motor can be used as the driving source 84.

Figure 54:
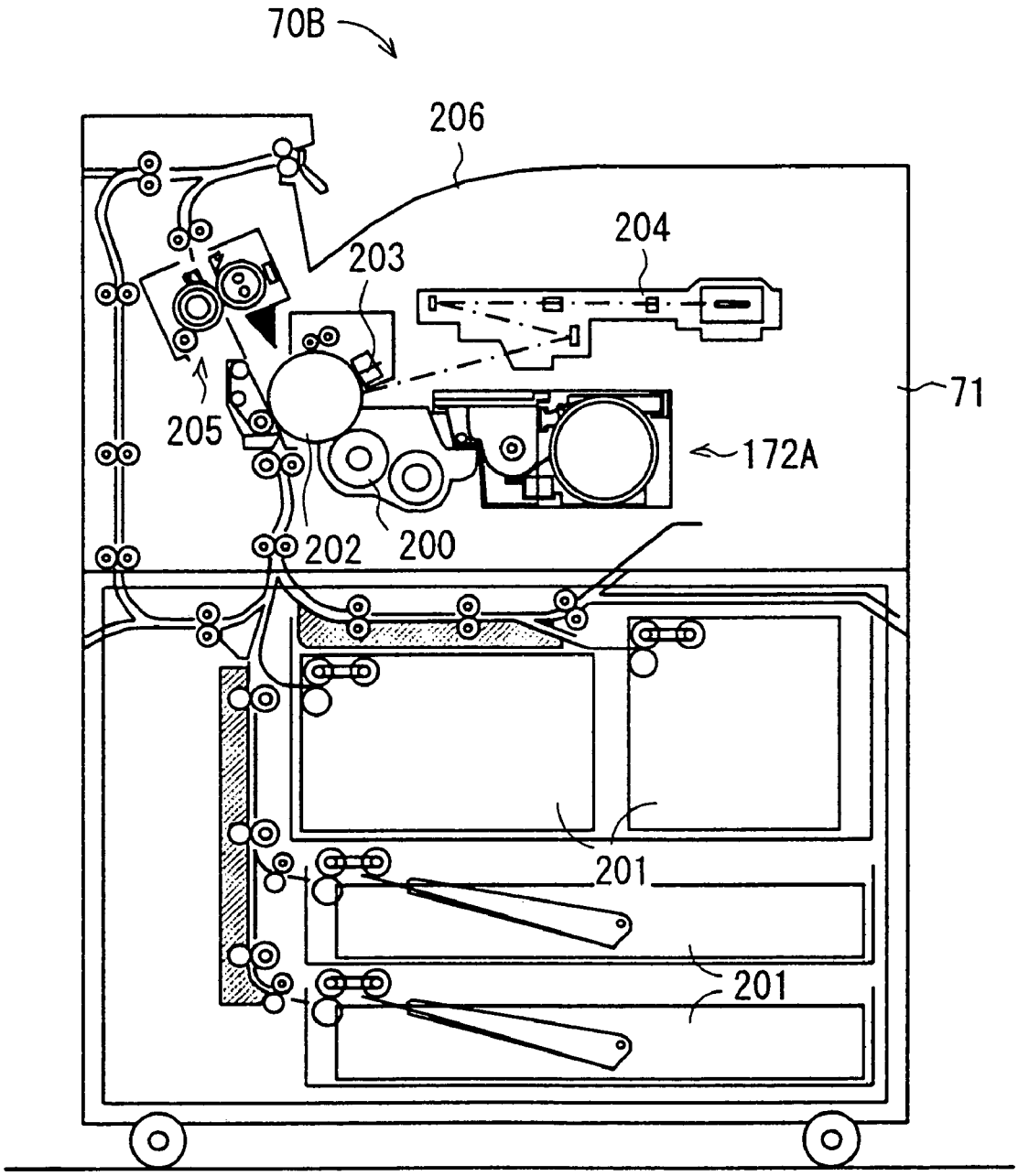
FIG. 54 is a cross-sectional view showing an image forming apparatus of a fifth example embodiment.
Figure 55:
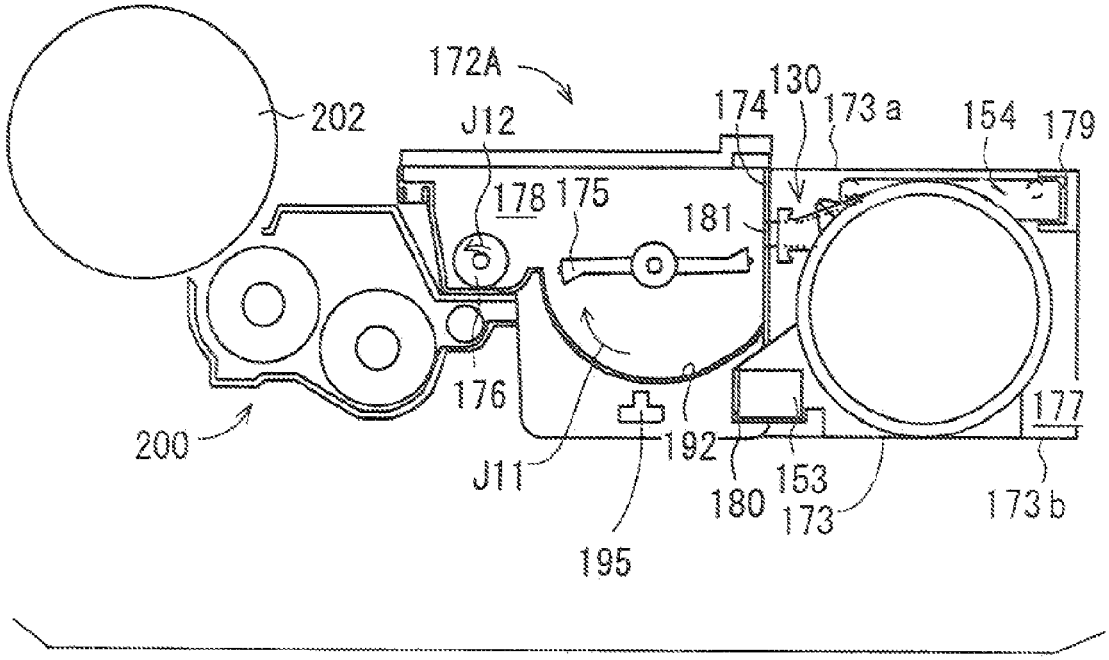
FIG. 55 is a cross-sectional view showing an enlarged portion in the vicinity of a toner hopper 172A.
Figure 56:
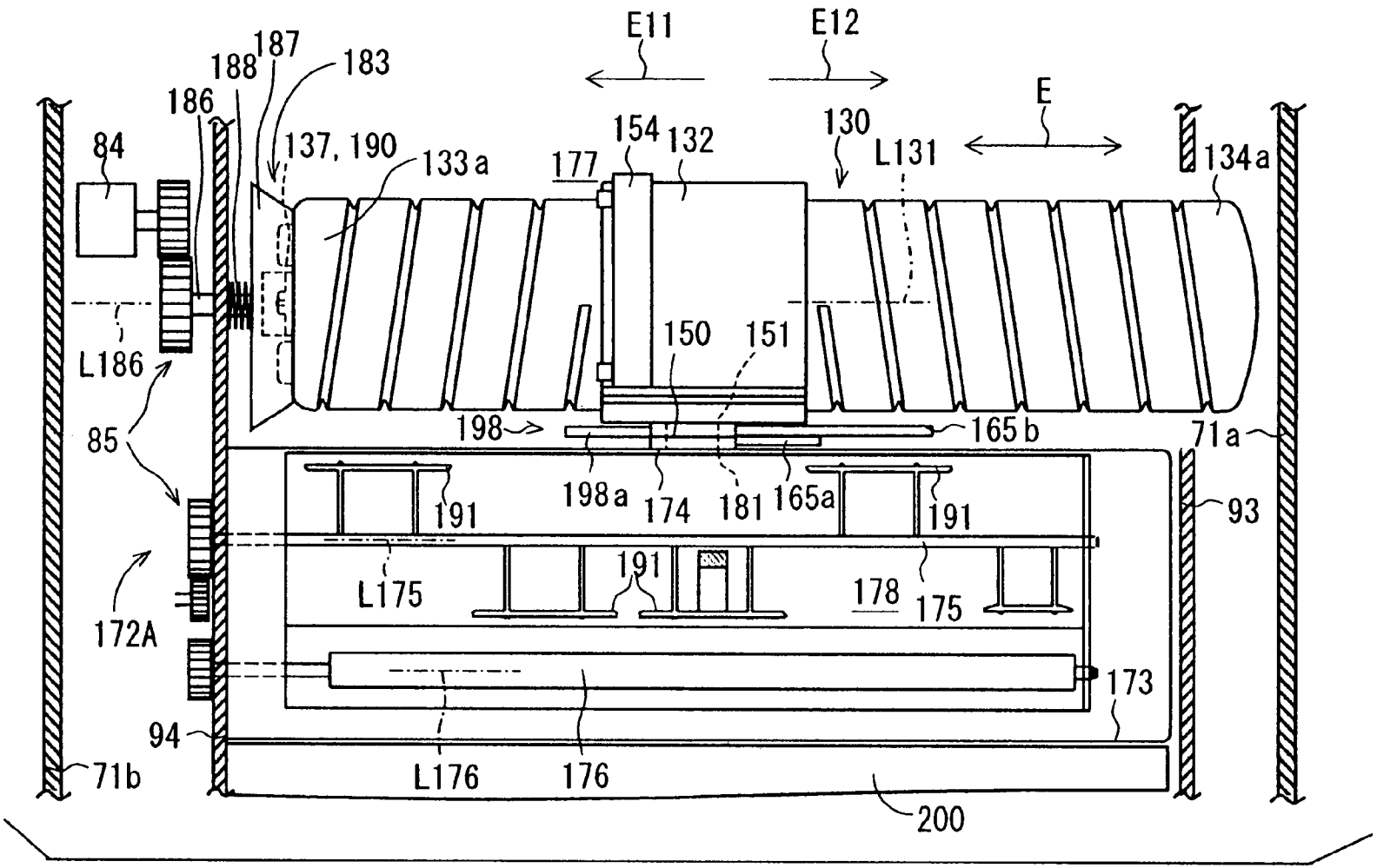
FIG. 56 is a plan view showing an enlarged portion in the vicinity of the toner hopper 172A.

FIG. 54 is a cross-sectional view showing an image forming apparatus 70B of a fifth example embodiment of the technology disclosed herein. FIG. 55 is a cross-sectional view showing an enlarged portion in the vicinity of a toner hopper 172A. FIG. 56 is a plan view showing an enlarged portion in the vicinity of the toner hopper 172A. FIG. 54 is a cross-sectional view of the image forming apparatus 70B viewed from the side of a front jacket portion 71*a*, and for easy understanding, the thickness is not shown. It is assumed that the image forming apparatus 70B is installed on the horizontal plane and the front-back direction E, which is a direction from the front jacket portion 71*a* to the back jacket portion 71*b*, is parallel to the horizontal plane. In this embodiment, the portions corresponding to those in the above-described embodiment bear the same reference and the description thereof is omitted.

The electrophotographic image forming apparatus 70B such as a printer and a copier includes the developer container 130 and the main body of the image forming apparatus (hereinafter, referred to as "apparatus main body") 71. The developer container 130 is attached removably to the toner hopper 172A provided in the apparatus main body 71 via an openable container attach/remove port (not shown) that is provided in the front jacket portion 71*a* of the apparatus main body 71. The image forming apparatus main body 71 is provided with a housing front portion 93 on the back jacket portion 71*b* side from the front jacket portion 71*a*, and an opening that penetrates the apparatus main body in the thickness direction through which the developer container 130 is to be inserted is formed. Furthermore, the image forming apparatus main body 71 is provided with a housing back portion 94 on the front jacket portion 71*a* side from the back jacket portion 1*b*. Various structures of the image forming apparatus main body 71 are held by the housing (not entirely shown) including the housing front portion 93 and the housing back portion 94.

The toner hopper 172A includes a housing 173, a developer supply portion 174, an agitating member 175 and a supply roller 176. The structure of the toner hopper 172A is similar to that of the toner hopper 172 of the above embodiment, so that detailed description is omitted.

Figure 57A:
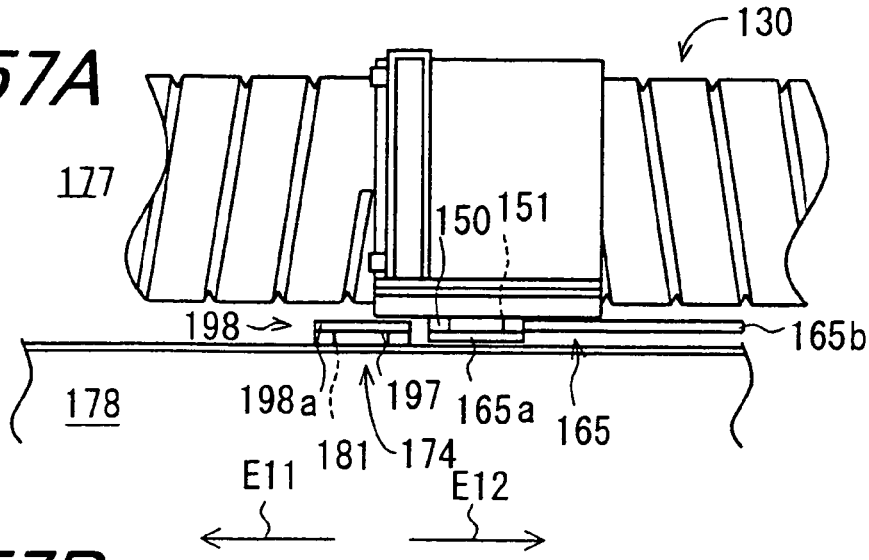
FIGS. 57A to 57C are plan views schematically showing the switching operation of the shutter portion 165 and main body shutter portion 198 when the developer container 130 is mounted in the image forming apparatus main body 71.
Figure 57B:
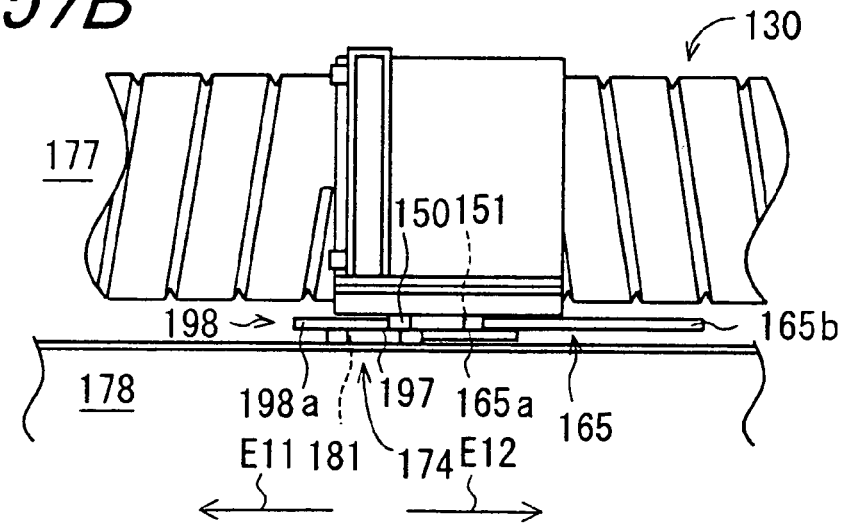
Figure 57C:
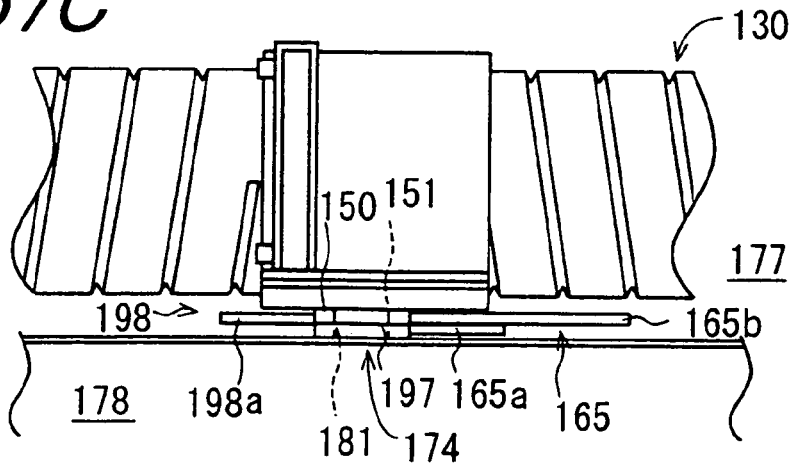
Figure 58:
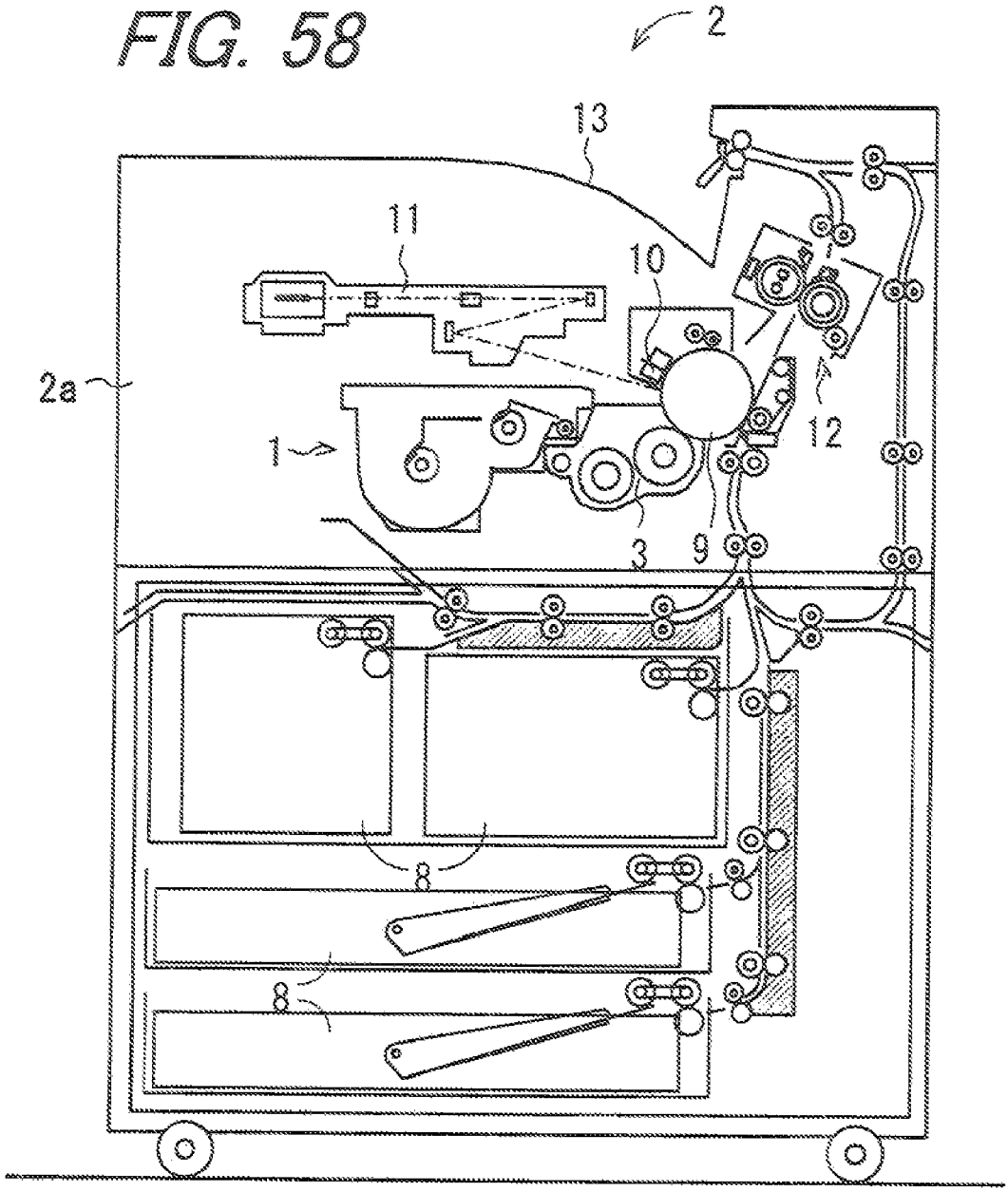
FIG. 58 is a cross-sectional view showing an image forming apparatus 2 to which a toner cartridge 1, which is a first conventional technique, is attached.

FIGS. 57A to 57C are plan views schematically showing the switching operation of the shutter portion 165 and main body shutter portion 198 when the developer container 130 is mounted in the image forming apparatus main body 71. In apparatus main body 71, a main body shutter portion 198, which is means for opening and closing the supply port, for switching a developer supply port 197 that is connected thereto via the communication hole 181 for guiding the developer to the developing portion 200 between the open state and the closed state is provided. The main body shutter portion 198 has a shutter 198*a* that can be displaced slidably in the attaching direction E11 and the removing direction E12 and is supported by the developer supply portion 174.

The developer container 130 is mounted in the apparatus main body 71 with the through hole 151 facing the developer supply port 197, and at this time, the developer container 130 is disposed in the attachment position. At this time, more specifically, the developer container 130 is amounted in the apparatus main body 71 with the through hole 151 facing the developer supply port 197 of the apparatus main body 71 and with the peripheral portion facing the through hole 151 of the developer container 130 and the peripheral portion facing the developer supply port 197 of the apparatus main body 71 sealed with each other. When the developer container 130 is mounted in the apparatus main body 71, the shutter portion 165 of the developer container 130 switches the through hole 181 to the open state in connection with the operation of the main body shutter portion 198 of the apparatus main body 71 switching the developer supply port 197 to the open state.

More specifically, as shown in FIG. 57A, the developer container 130 is housed in the container housing space 177 of the apparatus main body 71 in a state where the through hole 151 is in the closed state achieved by the shutter portion 165 of the developer container 130 and the developer supply port 197 is in the closed state achieved by the main body shutter portion 198 of the apparatus main body 71. Then, the second guide piece 154 of the developer container 130 is engaged with the guide recess 179 of the apparatus main body 71, and the first guide piece 153 of the developer container 130 is engaged with the guide recess 180 of the apparatus main body 71, and the developer container 130 slides in the attaching direction E11. Then, as shown in FIG. 57B, when the developer container 130 further slides in the attaching direction E11, the shutter 165*a* of the shutter portion 165 of the developer container 130 slides in the removing direction E12 while being in contact with the developer supply portion 174 of the apparatus main body 71. At this time, the shutter 198*a* of the main body shutter portion 198 of the apparatus main body 71 slides in the attaching direction E11 while being in contact with the outlet portion 150 of the developer container 130.

Then, as shown in FIG. 57C, when the developer container 130 slides in the attaching direction E11, and is disposed in the attaching position, the shutter 165*a* of the shutter portion 165 of the developer container 130 slides further in the removing direction E12 to let the through hole 151 open. At this time, the shutter 198*a* of the main body shutter portion 198 of the apparatus main body 71 slides further in the attaching direction E11 to let the developer supply port 197 open. At this time, the through hole 151 faces the developer supply port 197 of the apparatus main body 71, and the peripheral portion facing the through hole 151 of the developer container 130 and the peripheral portion facing the developer supply port 197 of the apparatus main body 71 are sealed with each other.

Thus, the apparatus main body 71 is provided with the main body shutter portion 198 that switches the developer supply port 197 via the communication hole 181 guiding the developer to the developing portion 200. Therefore, by letting the developer supply port 197 open, the developer can be supplied to the developing portion 200. Even if the developer flows back to the developer supply port 197 via the communication hole 181 from the developing portion 200, it is ensured to prevent the developer that has flown back from the developer supply port 197 from leaking out by keeping the developer supply port 197 closed. Furthermore, the outlet portion 150 of the supporting member 132 of the developer container 130 is provided with the shutter portion 165 for switching the through hole 151 between the open state and the closed state. Therefore, the developer contained in the developer container 130 can be led out through the through hole 151 by rotating the developer container main body 131 around the axial line L131 with the through hole 151 open. Furthermore, by letting the through hole 151 be in the closed state, even if the developer container main body 131 is rotated around the axial line L131 by mistake, it is ensured to prevent the developer contained in the developer container 130 from being led out through the through hole 151. Moreover, the developer container 130 is mounted in the apparatus main body 71 with the through hole 151 facing the developer supply port 197. Therefore, the developer contained in the developer container 130 can be supplied to the developing portion 200 of the apparatus main body 71 through the through hole 151 and the communication hole 181 by mounting the developer container 130 on the apparatus main body 71 and rotating the developer container main body 131 around the axial line L131 with the developer supply port 197 and the through hole 151 open.

Furthermore, when the developer container 130 is mounted in the apparatus main body 71, the shutter portion 165 of the developer container 130 switches the through hole 151 to the open state in connection with the operation of the main body shutter portion 198 of the apparatus main body 71 switching the developer supply port 197 to the open state. Therefore, it is not necessary to let the developer supply port 197 and the through hole 151 open in advance, before mounting the developer container 130 on the apparatus main body 71. Thus, for example, it is ensured to prevent the developer contained in the developer container 130 from being let out through the through hole 151 undesirably by rotating the developer container main body 131 of the developer container 130 around the axial line L131 by mistake with the through hole 151 being opened before mounting the developer container 130 on the apparatus main body 71. Furthermore, the developer container 130 is mounted in the apparatus main body 71 with the through hole 151 facing the developer supply port 197 of the apparatus main body 71 and with the peripheral portion facing the through hole 151 of the developer container 130 and the peripheral portion facing the developer supply port 197 of the apparatus main body 71 sealed with each other. Thus, it is ensured to prevent the developer from leaking to an undesired portion when supplying the developer contained in the developer container 130 to the developing portion 200 of the apparatus main body 71 through the through hole 151 and the communication hole 181 by rotating the developer container main body 131 around the axial line L131 with the developer container 130 mounted in the apparatus main body 71.

With the structure shown in FIGS. 54 to 56, the same advantages and the effects as the fourth embodiment can be obtained.

Although the developer containers 30 and 130 and the image forming apparatus 70, 70A and 70B in the above embodiments have been described, taking two-component development for example, the technology disclosed herein can be applied to a development system of only toner.

The technology disclosed herein may be embodied in other specific forms without departing from the spirit or essential characteristics thereof. The present embodiments are therefore to be considered in all respects as illustrative and not restrictive, the scope of the technology disclosed herein being indicated by the appended claims rather than by the foregoing description and all changes which come within the meaning and the range of equivalency of the claims are therefore intended to be embraced therein.

INDUSTRIAL APPLICATION

According to an embodiment of the technology disclosed herein, when a developer container main body that is supported rotatably around the axial line by a supporting member is rotated around the axial line, the contained developer is conveyed to an exhausting hole provided in the developer container main body. Thus, since the supporting member supports the developer container main body in an intermediate portion in the axial line direction of the developer container main body, even if a driving force for rotating the developer container main body is applied to the developer container main body, the developer container main body rotating around the axial line can be supported stably. The supporting member is also provided with a through hole for guiding the developer let out from the exhausting hole of the developer container main body to the outside. Thus, the developer that is conveyed toward the exhausting hole by rotating the developer container main body and is let out from the exhausting hole can be guided out through the through hole. For example, in the case of a conventional structure in which only an exhausting hole for letting out the developer contained in a rotating container is provided, the exhausting hole is also rotated together with the rotation of the container. Therefore, in order to prevent the developer let out from the rotating exhausting hole from leaking to an undesired potion, it is necessary to provide sealing means between the rotating container and the image forming apparatus. On the other hand, in an embodiment of the technology disclosed herein, the developer contained in the developer container main body is guided out from the through hole of the supporting member that is not rotated with the developer container main body, and therefore the developer is easily prevented from leaking between the through hole that is not displaced and the image forming apparatus as much as possible. Furthermore, simply rotating the developer container main body can achieve both conveying the developer contained in the developer container main body and letting out the developer to the outside at the same time.

According to the technology disclosed herein, the exhausting hole of the developer container main body is provided in a substantially intermediate portion, so that the developer that is conveyed toward the exhausting hole by rotating the developer container main body and is contained on one end side in the axial line direction of the developer container main body and the developer that is contained on the other end side in the axial line direction of the developer container main body collide with each other near the exhausting hole in the developer container main body. For example, in a conventional structure in which the developer is conveyed to one end in the axial line direction of a container, there is a risk that the conveyed developer may aggregate by being pressed against the inner wall perpendicular to the axial line direction in the one end in the axial line direction of the container. In an embodiment of the technology disclosed herein, the developer from one side in the axial line direction that is contained in the developer container main body and the developer from the other side in the axial line direction collide with each other near the exhausting hole in the developer container main body, that is, in a substantially intermediate portion in the axial line direction where there is no wall perpendicular to the axial line, unlike the conventional container, so that the developer can be agitated. Thus, even if the developer contained in the developer container main body is aggregated, the developer can be agitated and turned into a powder by rotating the developer container main body.

According to an embodiment of the technology disclosed herein, the developer container main body includes a first container portion formed into a cylindrical shape having a bottom, a second container portion formed into a cylindrical shape having a bottom and a coupling member formed into a cylindrical shape and provided with an exhausting hole. One end in the axial line direction of the coupling member is coupled removably with an open end of the first container portion. The other end in the axial line direction of the coupling member is coupled removably with an open end of the second container portion. Thus, a cylindrical developer container main body that is provided with an exhausting hole in an intermediate portion in the axial line direction and whose opposite ends in the axial line direction are closed can be realized. Furthermore, for example, when the contained developer is all let out and any one of the first container portion, the second container portion and the coupling member is worn out or damaged, then only the worn-out or damaged component can be replaced, and the developer can be contained again. Consequently, the recycling properties of the developer container can be improved.

According to an embodiment of the technology disclosed herein, a first protrusion portion projecting inward in the radial direction and extends in one direction spirally around the axial line from a bottom to an open end is provided in an inner circumferential portion of the first container portion. Thus, rotating the developer container main body around the axial line easily achieves conveying the developer contained in the first container portion on the one end side in the axial line direction of the developer container main body toward the exhausting hole of the coupling member by the first protrusion portion. A second protrusion portion projecting inward in the radial direction and extending in a direction opposite to the one direction spirally around the axial line from a bottom to an open end is provided in an inner circumferential portion of the second container portion. Thus, rotating the developer container main body around the axial line easily achieves conveying the developer contained in the second container portion on the other end side in the axial line direction of the developer container main body toward the exhausting hole of the coupling member by the second protrusion portion. This easily achieves that the developer from one side in the axial line direction that is contained in the developer container main body and the developer from the other side in the axial line direction collide with each other in a substantially intermediate portion, that is, near the exhausting hole in the developer container main body so that the developer can be agitated.

According to an embodiment of the technology disclosed herein, sealing means extending throughout the full circumference in the circumferential direction is provided between the developer container main body and the supporting member on the one end side in the axial line direction and the other end side in the axial line direction of the developer container main body from the exhausting hole and the through hole, and therefore, the developer is prevented from leaking from between the developer container main body and the supporting member.

According to an embodiment of the technology disclosed herein, a holding portion for holding a developer between an outer circumferential portion of the developer container main body and an inner circumferential portion of the supporting member is provided on the upstream side in the rotation direction from the exhausting hole of the developer container main body. Therefore, when the developer container main body is rotated, the holding portion provided on the upstream side in the rotation direction from the exhausting hole of the developer container main body is positioned at a position facing the through hole, supplies the developer held in the holding portion to the through hole and lets out the developer through the through hole. When the developer container main body is disposed such that its axial line is parallel to the horizontal plane and the through hole of the supporting member is disposed near a central portion in the vertical direction, even if the amount of the developer contained in the developer container main body is reduced, the developer remaining in a lower portion in the coupling member of the developer container main body is also held by the holding portion and is conveyed to the through hole. Thus, the amount of the developer remaining without being conveyed to the through hole can be reduced, and all the developer can be guided out from the through hole as much as possible.

According to an embodiment of the technology disclosed herein, when the developer container main body that is supported rotatably around the axial line by the supporting member is rotated around the axial line, the contained developer is conveyed to the exhausting hole provided in the developer container main body. Since the supporting member supports the developer container main body in this manner, even if a driving force for rotating the developer container main body is applied to the developer container main body, the developer container main body rotating around the axial line can be supported stably. The developer container main body is provided with a recess that is recessed inward in the radial direction in its outer circumferential portion. Therefore, in a state where the portion including at least recess of the developer container main body is supported rotatably around the axial line by the supporting member, a space facing the recess and the exhausting hole of the developer container main body and the inner circumferential portion of the supporting member (hereinafter, which may be referred to as "holding space") is formed. The developer that is conveyed toward the exhausting hole by rotating the developer container main body and is let out from the exhausting hole is let out to the holding space. Furthermore, the supporting member is provided with a through hole for guiding out the developer let out from the exhausting hole of the developer container main body. The volume of the space is not changed, so that a change in the amount of the developer let out from the exhausting hole to the holding space and held therein, which depends on the amount of the developer contained in the developer container main body, can be prevented as much as possible. Therefore, when the developer container main body is rotated, the developer is let out from the exhausting hole to the holding space, and the developer in an amount based on the volume of the holding space is held in the holding space. The developer held in the holding space in this manner is guided out by the through hole, so that the amount of the developer let out per one rotation of the developer container main body can be kept as constant as possible. For example, in the case of a conventional structure in which only an exhausting hole for letting out the developer contained in a rotating container is provided, the exhausting hole is also rotated together with the rotation of the container. Therefore, in order to prevent the developer let out from the rotating exhausting hole from leaking to an undesired potion, it is necessary to provide sealing means between the rotating container and the image forming apparatus. On the other hand, in an embodiment of the technology disclosed herein, the developer contained in the developer container main body is guided out from the through hole of the supporting member that is not rotated with the developer container main body, and therefore the developer is easily prevented from leaking between the through hole that is not displaced and the image forming apparatus as much as possible. Furthermore, simply rotating the developer container main body can achieve both conveying the developer contained in the developer container main body and letting out the developer to the outside at the same time. Conventionally, the amount of the developer contained in the developer container main body affected the amount of the developer that is to let out from the developer container main body when the developer container main body makes one rotation. However, by letting the holding space whose volume is not changed hold the developer let out from the exhausting hole, the amount of the developer let out per one rotation of the developer container main body can be kept as constant as possible without depending the amount of the developer contained in the developer container main body.

According to an embodiment of the technology disclosed herein, the exhausting hole is formed on the downstream side in the rotation direction of the recess. Therefore, by rotating the developer container main body in the rotation direction, the developer in the developer container main body can be easily let out from the exhausting hole to the holding space. Furthermore, the recess is formed, extending in the rotation direction, and the size thereof in the axial line direction is smaller than the size in the rotation direction. Therefore, the holding space also can be formed, extending in the rotation direction, and the size thereof in the axial line direction is smaller than the size in the rotation direction. Consequently, the developer held in the holding space can be prevented from returning to the developer container main body through the exhausting hole as much as possible. Since the holding space is formed extending in the rotation direction, by setting the size in the rotation direction of the recess as appropriate, a desired amount of the developer can be held in the holding space.

According to an embodiment of the technology disclosed herein, the recess has an end wall portion intersecting the rotation direction at an end on the downstream side in the rotation direction, and the exhausting hole is formed in a portion of the end wall portion. For example, when the exhausting hole is opened entirely in the end wall portion, the developer is let out from the exhausting hole to the holding space while being forced out densely along the recess portion of the developer container main body and the inner circumferential portion of the supporting member by the developer container main body being rotated. In such a state, by the developer container main body being further rotated, there is a risk that the developer held in the holding space may be aggregated by being pressed by the recess portion of the developer container main body and the inner circumferential portion of the supporting member. In this embodiment, as described above, the exhausting hole is formed in a portion of the end wall portion. In other words, the exhausting hole can be formed such that the opening area thereof is smaller than the area of the end wall portion, so that the developer is let out to the holding space while being diffused near the exhausting hole in the holding space. Thus, the developer that is let out to the holding space can be turned into a powder, and aggregation of the developer due to the rotation of the developer container main body as described above can be prevented as much as possible. Thus, the powdered developer can be guided out by the through hole.

According to an embodiment of the technology disclosed herein, lead-out means for guiding the developer let out from the exhausting hole of the developer container main body to the through hole is provided in the inner circumferential portion of the supporting member. Thus, the developer let out from the exhausting hole of the developer container main body and held in the holding space can be guided to the through hole by the lead-out means.

According to an embodiment of the technology disclosed herein, the lead-out means is formed into a sheet form having flexibility and elasticity, and extends on the upstream side in the rotation direction with its fixed end provided in a portion facing the through hole of the supporting member and with its free end capable of being elastically contacted with the outer circumferential portion of the recess of the developer container main body. In the state where the developer container main body is being rotated, by the free end of the lead-out means extending on the upstream side in the rotation direction and is elastically in contact with the outer circumferential surface of the recess of the developer container main body, the developer is scraped sequentially from the developer held in the holding space on the downstream in the rotation direction so as to be detached from the outer circumferential surface of the recess, and guided to the fixed end, and further guided to the through hole. In this manner, the developer that is let out from the exhausting hole of the developer container main body and held in the holding space can be guided to the through hole reliably by the lead-out means.

According to an embodiment of the technology disclosed herein, the free end of the lead-out means is in contact with the outer circumferential surface of the recess with an angle of more than 90 degrees. Therefore, in the state where the developer container main body is being rotated, the lead-out means prevents the free end from being curved to the downstream side in the rotation direction and being detached from the outer circumferential surface of the recess by the frictional force applied from the outer circumferential surface of the recess, so that the free end can be in contact with the outer circumferential surface of the recess stably. In this manner, the developer that is let out from the exhausting hole of the developer container main body and held in the holding space can be guided to the through hole reliably by the lead-out means.

According to an embodiment of the technology disclosed herein, blocking means closes the exhausting hole when the developer container main body is in an initial state with respect to the supporting member and opens the exhausting hole by rotating the developer container main body from the initial state. Thus, in the initial state, the developer can be prevented from being let out undesirably from the developer container main body, and the exhausting hole can be opened easily to let out the developer in the developer container main body, not by the user directly removing the blocking means, but by rotating the developer container main body.

According to an embodiment of the technology disclosed herein, the recess and the exhausting hole of the developer container main body are provided in a substantially intermediate portion in the axial line direction, and therefore, the developer that is conveyed toward the exhausting hole by rotating the developer container main body and is contained on the one end side in the axial line direction of the developer container main body and the developer that is contained on the other end side in the axial line direction of the developer container main body collide with each other near the exhausting hole in the developer container main body. For example, in a conventional structure in which the developer is conveyed to the one end in the axial line direction of a container, there is a risk that the conveyed developer may aggregate by being pressed against the inner wall perpendicular to the axial line direction in the one end in the axial line direction of the container. In an embodiment of the technology disclosed herein, the developer from one side in the axial line direction that is contained in the developer container main body and the developer from the other side in the axial line direction collide with each other near the exhausting hole in the developer container main body, that is, in a substantially intermediate portion in the axial line direction where there is no wall perpendicular to the axial line, unlike the conventional container, so that the developer can be agitated. Thus, even if the developer contained in the developer container main body is aggregated, the developer can be agitated and turned into a powder by rotating the developer container main body.

According to an embodiment of the technology disclosed herein, the developer container main body includes a first container portion formed into a cylindrical shape having a bottom, a second container portion formed into a cylindrical shape having a bottom and a third container portion formed into a cylindrical shape and provided with a recess and an exhausting hole. The developer container main body is formed into one piece by coupling one end in the axial line direction of the third container portion with an open end of the first container portion, and coupling the other end in the axial line direction of the third container portion with an open end of the second container portion. Thus, a cylindrical developer container main body that is provided with a recess and an exhausting hole in an intermediate portion in the axial line direction and whose opposite ends in the axial line direction are closed can be realized. Furthermore, the contained developer including the first container portion, the second container portion and the third container portion can be produced easily by, for example blow molding for integral formation. Thus, the number of the components of the developer container can be reduced.

According to an embodiment of the technology disclosed herein, a first protrusion portion projecting inward in the radial direction and extending in one direction spirally around the axial line from a bottom to an open end is provided in an inner circumferential portion of the first container portion. Thus, rotating the developer container main body around the axial line easily achieves conveying the developer contained in the first container portion on the one end side in the axial line direction of the developer container main body toward the exhausting hole of the third container portion by the first protrusion portion. A second protrusion portion projecting inward in the radial direction and extending in a direction opposite to the one direction spirally around the axial line from a bottom to an open end is provided in an inner circumferential portion of the second container portion. Thus, rotating the developer container main body around the axial line easily achieves conveying the developer contained in the second container portion on the other end side in the axial line direction of the developer container main body toward the exhausting hole of the third container portion by the second protrusion portion. This easily achieves that the developer from one side in the axial line direction that is contained in the developer container main body and the developer from the other side in the axial line direction collide with each other in a substantially intermediate portion, that is, near the exhausting hole in the developer container main body so that the developer can be agitated.

According to an embodiment of the technology disclosed herein, sealing means extending throughout the full circumference in the circumferential direction is provided between the developer container main body and the supporting member on the one end side in the axial line direction and the other end side in the axial line direction of the developer container main body from the recess and the exhausting hole of the developer container main body and the through hole of the supporting member, and therefore the developer is prevented from leaking from between the developer container main body and the supporting member.

According to an embodiment of the technology disclosed herein, the inner diameter of the third container portion of the developer container main body is larger than the inner diameter of the remaining portions. The powdered developer has a property that even if the developer is mounted on a horizontal surface in a sharp hill shape, the hill shape immediately becomes moderate. For example, in the case where the inner diameter of the third container portion of the developer container main body is formed so as to be equal to or smaller than the inner diameters of the remaining portions, the developer conveyed toward the exhausting hole by the rotation of the developer container main body becomes away from the third container portion when the rotation of the developer container main body stops. In this case, when the amount of the developer contained in the developer container main body becomes very small, it is difficult to convey a sufficient amount of the developer toward the exhausting hole immediately after the rotation of the developer container main body is started again. In this embodiment, the inner diameter of the third container portion of the developer container main body is formed so as to be larger than the inner diameters of the remaining portions, and therefore it is prevented as much as possible that the developer conveyed to the third container portion becomes away from the third container portion. Thus, even if the amount of the developer contained in the developer container main body becomes very small, a sufficient amount of the developer can be conveyed toward the exhausting hole as much as possible, immediately after the rotation of the developer container main body is started again. Furthermore, all the developer contained in the developer container main body can be let out as much as possible.

According to an embodiment of the technology disclosed herein, a plurality of recesses are provided in the circumferential direction of the developer container main body with intervals, and therefore, even if the developer has leaked on the upstream side in the rotation direction from the holding space facing the recess in which the exhausting hole of the developer container main body is formed and the inner circumferential portion of the supporting member, the leaked developer can be held by a holding space facing another recess that is disposed on the upstream side in the rotation direction with an interval in the circumferential direction of the recess and the inner circumferential portion of the supporting member. Thus, the predetermined amount of the developer that is let out for every rotation of the developer container main body can be kept as constant as possible.

According to an embodiment of the technology disclosed herein, when the developer container main body that is supported by the supporting member rotatably around the axial line is rotated around the axial line, the contained developer is conveyed to the exhausting hole provided in the outer circumferential portion of the developer container main body. Since the supporting member supports the developer container main body in this manner, the supporting member can support stably the developer container main body rotating around the axial line, even if a driving force for rotating the developer container main body is supplied to the developer container main body. Furthermore, the supporting member is provided with a through hole for guiding the developer let out from the exhausting hole of the developer container main body to the outside. For example, in the case of a conventional structure in which only an exhausting hole for letting out the developer contained in a rotating container is provided, the exhausting hole is also rotated together with the rotation of the container. Therefore, in order to prevent the developer let out from the rotating exhausting hole from leaking to an undesired potion, it is necessary to provide sealing means between the rotating container and the image forming apparatus. On the other hand, in an embodiment of the technology disclosed herein, the developer contained in the developer container main body is guided outside from the through hole of the supporting member that is not rotated with the developer container main body, and therefore the developer is easily prevented from leaking between the through hole that is not displaced and the image forming apparatus as much as possible. Furthermore, simply rotating the developer container main body can achieve both conveying the developer contained in the developer container main body and letting out the developer to an external portion at the same time. Furthermore, the through hole is disposed above the axial line of the developer container main body when the container is mounted in an image forming apparatus. For example, in the case where the through hole is disposed below the axial line of the developer container main body when the container is mounted in an image forming apparatus, since the amount of the developer that is guided from the through hole to the outside depends on the self-weight of the developer layer, that is, the amount of the contained developer, when the amount of the contained developer is large, then the amount of the developer that is guided outside becomes large. When the amount of the contained developer is small, then the amount of the developer that is guided outside becomes small. Therefore, in an embodiment of the technology disclosed herein, by disposing the through hole above the axial line of the developer container main body when the container is mounted in an image forming apparatus, the developer can be supplied to the image forming apparatus main body with the developer supplied to the image forming apparatus as constant as possible regardless of the amount of the contained developer.

According to an embodiment of the technology disclosed herein, an angle formed by a virtual straight line connecting the axial line of the developer container main body and the center of the through hole with respect to a horizontal plane is from 30 degrees to 70 degrees when the container is mounted in an image forming apparatus. For example, in the case where an angle formed by a virtual straight line connecting the axial line of the developer container main body and the center of the through hole with respect to a horizontal plane is less than 30 degrees when the container is mounted in an image forming apparatus, when a large amount of the developer is present in the developer container, a large amount of the developer tends to be let out. In the case where the angle exceeds 70 degrees, when the amount of the developer in the developer container is reduced, the amount of the developer let out may be reduced. Therefore, when an angle formed by a virtual straight line connecting the axial line of the developer container main body and the center of the through hole with respect to a horizontal plane is from 30 degrees to 70 degrees when the container is mounted in an image forming apparatus, the developer can be supplied to the image forming apparatus main body with the developer supplied to the image forming apparatus as constant as possible regardless of the amount of the contained developer.

According to an embodiment of the technology disclosed herein, since the main body of an image forming apparatus comprises a supply port opening/closing means for switching a developer supply port that is connected thereto via a passage for guiding a developer to a developing portion between an open state and a close state, by letting the developer supply port open, the developer can be supplied to the developing portion. Even if the developer flows back to the developer supply port via the passage from the developing portion, it is ensured to prevent the developer that has flown back from the developer supply port from leaking out by keeping the developer supply port closed. Furthermore, the supporting member is provided with a through hole opening/closing means for switching the through hole between the open state and the closed state. Therefore, the developer contained in the developer container can be led out from the through hole by rotating the developer container main body around the axial line with the through hole open. Furthermore, by letting the through hole closed, even if the developer container main body is rotated around the axial line by mistake, it is ensured to prevent the developer contained in the developer container from being led out from the through hole. Moreover, the developer container is mounted in an image forming apparatus with the through hole facing the developer supply port. Therefore, the developer contained in the developer container can be supplied to the developing portion of the image forming apparatus through the through hole and the passage by mounting the developer container in the image forming apparatus and rotating the developer container main body around the axial line with the developer supply port and the through hole open.

According to an embodiment of the technology disclosed herein, when the developer container is mounted in the image forming apparatus, the through hole opening/closing means switches the through hole to the open state in connection with an operation of the supply port opening/closing means switching the developer supply port to the open state, and therefore, it is not necessary to let the developer supply port and the through hole open in advance, before mounting the developer container on the image forming apparatus. Thus, for example, it is ensured to prevent the developer contained in the developer container from being let out through the through hole undesirably by rotating the developer container main body of the developer container around the axial line by mistake with the through hole being opened before mounting the developer container on the image forming apparatus. Furthermore, the developer container is mounted in the image forming apparatus with the through hole facing the developer supply port of the image forming apparatus and with sealing achieved between the peripheral portion facing the through hole of the developer container and the peripheral portion facing the developer supply port of the image forming apparatus. Thus, it is ensured to prevent the developer from leaking to an undesired portion when supplying the developer contained in the developer container to the developing portion of the image forming apparatus through the through hole and the passage by rotating the developer container main body around the axial line with the developer container mounted in the image forming apparatus.

According to an embodiment of the technology disclosed herein, the supporting member can be divided into a plurality of pieces in the circumferential direction. Therefore, when supporting the developer container main body, the supporting member is previously divided, and the divided pieces of the supporting member support a portion including the exhausting hole of the developer container main body or a portion including the recess portion and the exhausting hole of the developer container main body from the outer side in the radial direction, so that the developer container main body can be supported throughout the full circumference of the developer container main body, and such assembling work can be easily performed.

According to an embodiment of the technology disclosed herein, the supporting member comprises a support stand having at least three contact portions on a virtual plane that is parallel to the axial line, so that by bringing the contact portions into contact with the horizontal plane, the supporting member can support the developer container main body stably such that its axial line is parallel to the horizontal plane.

According to an embodiment of the technology disclosed herein, a coupling portion that is coupled removably to a driving source provided in an image forming apparatus is formed in one end in the axial line direction of the developer container main body. By coupling the coupling portion to the driving source of the image forming apparatus, a driving force from the driving source is supplied to the developer container main body so that the developer container main body can be rotated around the axial line.

According to an embodiment of the technology disclosed herein, the supporting member is disposed in the substantially central portion in the axial line direction of the developer container main body. Therefore, the developer container is attached to the central portion in the front-back direction of the image forming apparatus main body such that the through hole of the supporting member is in communication with the developer supply port. Thus, the developer container main body can be extended from the central portion in the front-back direction to the front portion of the image forming apparatus main body and extended from the central portion in the front-back direction to the back portion, and thus the capacity can be increased significantly compared with the conventional container. Furthermore, when the length from the supporting member of the developer container main body to the end face of the one end in the axial line direction is smaller than the length from the supporting member to the end face of the other end in the axial line direction, a region in which the driving portion coupled to the coupling portion of the one end in the axial line direction of the developer container main body is provided can be ensured in the back portion of the apparatus main body.

According to an embodiment of the technology disclosed herein, in the image forming apparatus, the developer container that can achieve the above-described functions can be removably mounted.

The invention claimed is:

1. A developer container that is mounted removably in an image forming apparatus, comprising:

a developer container main body that is formed into a cylindrical shape for containing a developer for use in image formation, is provided with an exhausting hole through which the developer is let out, and conveys the contained developer toward the exhausting hole by being rotated around its axial line; and a supporting member that supports the developer container main body rotatably around the axial line throughout a full circumference from an outer side in a radial direction of the developer container main body and is provided with a through hole for guiding the developer let out from the exhausting hole of the developer container main body to the outside, wherein the developer container main body includes a first container portion formed into a cylindrical shape having a bottom, a second container portion formed into a cylindrical shape having a bottom and a coupling member formed into a cylindrical and provided with an exhausting hole, and wherein one end in an axial line direction of the coupling member is coupled removably with an open end of the first container portion, and the other end in the axial line direction of the coupling member is coupled removably with an open end of the second container portion.

2. The developer container of claim 1, wherein the exhausting hole of the developer container main body is provided in a substantially intermediate portion in the axial line direction of the developer container main body, and the supporting member supports the substantially intermediate portion in the axial line direction of the developer container main body including at least the exhausting hole throughout the full circumference from the outer side in the radial direction of the developer container main body.

3. The developer container of claim 1, wherein in an inner circumferential portion of the first container portion is provided a first protrusion portion projecting inward in the radial direction of the first container portion and extending in one direction spirally around the axial line from the bottom to the open end thereof, and in an inner circumferential portion of the second container portion is provided a second protrusion portion projecting inward in the radial direction and extending in a direction opposite to the one direction spirally around the axial line from the bottom to the open end thereof.

4. The developer container of claim 1, wherein sealing means extending throughout the full circumference in the circumferential direction is provided between the developer container main body and the supporting member on the one end side in the axial line direction and the other end side in the axial line direction of the developer container main body from the exhausting hole and the through hole.

5. The developer container of claim 1, wherein the developer container main body is provided with a recess that is recessed inward in the radial direction in its outer circumferential portion, and the exhausting hole is formed in the recess, and wherein sealing means extending throughout the full circumference in the circumferential direction of the developer container main body are provided between the developer container main body and the supporting member on one end side and the other end side in the axial line direction of the developer container main body with respect to the recess and the exhausting hole of the developer container main body and the through hole of the supporting member.

6. The developer container of claim 1, wherein the supporting member supports a portion including at least an exhausting hole of the developer container main body rotatably around the axial line throughout the full circumference from the outer side in the radial direction, and the through hole is disposed above the axial line of the developer container main body when the container is mounted in an image forming apparatus.

7. The developer container of claim 6, wherein an angle formed by a virtual straight line connecting the axial line of the developer container main body and the center of the through hole with respect to a horizontal plane is from 30 degrees to 70 degrees when the container is mounted in an image forming apparatus.

8. The developer container of claim 6, wherein a main body of an image forming apparatus comprises a supply port opening/closing means for switching a developer supply port that is connected thereto via a passage for guiding a developer to a developing portion between an open state and a close state, the developer container is mounted in the image forming apparatus with the through hole facing the developer supply port, and the supporting member comprises a through hole opening/closing means for switching the through hole between an open state and a close state.

9. The developer container of claim 8, wherein the developer container is mounted in the image forming apparatus so that the through hole faces the developer supply port of the image forming apparatus and sealing is achieved between a periphery facing the through hole of the developer container and a periphery facing the developer supply port of the image forming apparatus, and when the developer container is mounted in the image forming apparatus, the through hole opening/closing means switches the through hole to the open state in connection with an operation of the supply port opening/closing means switching the developer supply port to the open state.

10. The developer container of claim 1, wherein the supporting member can be divided into a plurality of pieces in the circumferential direction.

11. The developer container of claim 1, wherein the supporting member comprises a support stand having at least three contact portions on a virtual plane that is parallel to the axial line.

12. The developer container of claim 1, wherein a coupling portion that is coupled removably to a driving source provided in an image forming apparatus is formed in the developer container main body.

13. The developer container of claim 12, wherein a coupling portion is provided in one end in the axial line direction of the developer container main body, the length from the supporting member of the developer container main body to an end face of the one end in the axial line direction is smaller than the length from the supporting member to an end face of the other end in the axial line direction, and the supporting member is attached to the image forming apparatus main body such that the through hole is in communication with a developer supply port that is in communication with a developing portion of an image forming apparatus main body.

14. An image forming apparatus in which the developer container of claim 1 is removably mounted.

15. A developer container that is mounted removably in an image forming apparatus, comprising:

a developer container main body that is formed into a cylindrical shape for containing a developer for use in image formation, is provided with an exhausting through which the developer is let out, and conveys the contained developer toward the exhausting hole by being rotated around its axial line; and a supporting member that supports the developer container main body rotatably around the axial line throughout a full circumference from an outer side in a radial direction of the developer container main body arid is provided with a through hole for guiding the developer let out from the exhausting hole of the developer container main body to the outside, wherein a holding portion for holding a developer between an outer circumferential portion of the developer container main body and an inner circumferential portion of the supporting member is provided on the upstream side in the rotation direction from the exhausting hole of the developer container main body.

16. An image forming apparatus in which the developer containing of claim 15 is removably mounted.

17. A developer container that is mounted removably in an image forming apparatus, comprising:

a developer container main that is formed into a cylindrical shape for containing a developer for use in image formation, is provided with an exhausting hole through which the developer is let out, and conveys the contained developer toward the exhausting hole by being rotated around its axial line; and a supporting member that supports the developer container main body rotatably around the axial line throughout a full circumference from an outer side in a radial direction of the developer container main body and is provided with a through hole for guiding the developer let out from the exhausting hole of the developer container main body to the outside, wherein the developer container main body is provided with a recess that is recessed inward in the radial direction in its outer circumferential portion, and the exhausting hole is formed in the recess, and the supporting member supports a portion including at least the recess of the developer container main body rotatably around the axial line throughout the full circumference from the outer side in the radial direction of the developer container main body.

18. The developer container of claim 17, wherein the recess is formed, extending in the rotation direction, and the size thereof in the axial line direction is smaller than the size in the rotation direction, and the exhausting hole is formed on the downstream side in the rotation direction of the recess.

19. The developer container of claim 17, wherein the recess has an end wall portion intersecting the rotation direction at an end on the downstream side in the rotation direction, and the exhausting hole is formed in a portion of the end wall portion.

20. The developer container of claim 17, wherein lead-out means for guiding the developer let out from the exhausting hole of the developer container main body to the through hole is provided in the inner circumferential portion of the supporting member.

21. The developer container of claim 20, wherein the lead-out means is formed into a sheet form having flexibility and elasticity, and extends on the upstream side in the rotation direction with its fixed end provided in a portion facing the through hole of the supporting member and with its free end capable of being elastically contacted with the outer circumferential portion of the recess of the developer container main body.

22. The developer container of claim 21, wherein the free end of the lead-out means is in contact with the outer circumferential surface of the recess with an angle of more than 90 degrees.

23. The developer container of claim 17, further comprising blocking means for closing the exhausting hole when the developer container main body is in an initial state with respect to the supporting member and opening the exhausting hole by rotating the developer container main body from the initial state.

24. The developer container of claim 17, wherein the recess and the exhausting hole of the developer container main body are provided in a substantially intermediate portion in the axial line direction.

25. The developer container of claim 17, wherein the developer container main body includes a first container portion formed into a cylindrical shape having a bottom, a second container portion formed into a cylindrical shape having a bottom and a third container portion formed into a cylindrical shape and provided with the recess and the exhausting hole, and the developer container main body is formed into one piece by coupling one end in the axial line direction of the third container portion with an open end of the first container portion, and coupling the other end in the axial line direction of the third container portion with an open end of the second container portion.

26. The developer container of claim 25, wherein in an inner circumferential portion of the first container portion is provided a first protrusion portion projecting inward in the radial direction and extending in one direction spirally around the axial line from the bottom to the open end of the first container portion, and in an inner circumferential portion of the second container portion is provided a second protrusion portion projecting inward in the radial direction and extending in a direction opposite to the one direction spirally around the axial line from the bottom to the open end of the second container portion is provided.

27. The developer container of claim 17, wherein the developer container main body includes a first container portion formed into a cylindrical shape; a second container portion formed into a cylindrical shape; and a third container portion formed into a cylindrical shape and provided with the recess and the exhausting hole; and wherein an inner diameter of the third container portion of the developer container main body is larger than an inner diameter of the first container portion and the second container portion.

28. The developer container of claim 17, wherein as the recess, a plurality of recesses are provided in the circumferential direction of the developer container main body with intervals.

29. An image forming apparatus in which the developer containing of claim 17 is removably mounted.

* * * * *